US009540882B2

(12) United States Patent
Chen et al.

(10) Patent No.: US 9,540,882 B2
(45) Date of Patent: Jan. 10, 2017

(54) SYSTEM AND METHOD OF CONFIGURING DRILLING TOOLS UTILIZING A CRITICAL DEPTH OF CUT CONTROL CURVE

(75) Inventors: Shilin Chen, Montgomery, TX (US); James R. Ashby, Conroe, TX (US); Robert W. Arfele, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 718 days.

(21) Appl. No.: 13/884,523

(22) PCT Filed: Nov. 10, 2011

(86) PCT No.: PCT/US2011/060173

§ 371 (c)(1),
(2), (4) Date: May 9, 2013

(87) PCT Pub. No.: WO2012/064948

PCT Pub. Date: May 18, 2012

(65) Prior Publication Data

US 2013/0238245 A1 Sep. 12, 2013

Related U.S. Application Data

(60) Provisional application No. 61/416,160, filed on Nov. 22, 2010, provisional application No. 61/412,173, filed on Nov. 10, 2010.

(51) Int. Cl.

| | |
|---|---|
| ***E21B 47/04*** | (2012.01) |
| ***E21B 10/43*** | (2006.01) |
| ***E21B 10/55*** | (2006.01) |

(52) U.S. Cl.
CPC ..... *E21B 10/43* (2013.01); *E21B 10/55* (2013.01); *E21B 47/04* (2013.01)

(58) Field of Classification Search
CPC ..... E21B 10/43; E21B 47/04; E21B 10/55
(Continued)

(56) References Cited

U.S. PATENT DOCUMENTS 3,153,458 A 10/1964 Short
4,554,986 A 11/1985 Jones
(Continued)

OTHER PUBLICATIONS

Canadian Office Action; Application No. 2,817,695; pp. 4, Jul. 24, 2014.

(Continued)

*Primary Examiner* — Carol S Tsai
(74) *Attorney, Agent, or Firm* — Baker Botts L.L.P.

(57) ABSTRACT

According to some embodiments of the present disclosure, a method of determining a critical depth of cut of a drill bit comprises selecting a radial swath associated with an area of a bit face of a drill bit. The method further comprises identifying a plurality of cutting elements disposed on the bit face that each include at least a portion located within the radial swath. The method also comprises identifying a depth of cut controller (DOCC) disposed on the bit face and configured to control a depth of cut of the portions of the plurality of cutting elements located within the radial swath. The method additionally comprises calculating a critical depth of cut associated with the radial swath and DOCC based on a depth of cut associated with each portion of the plurality of cutting elements located within the radial swath and controlled by the DOCC.

16 Claims, 39 Drawing Sheets

(58) Field of Classification Search
USPC ..... 702/9; 175/374, 428, 431, 420.2, 435, 175/434, 327, 325.2, 331, 108.2, 57, 16
See application file for complete search history.

(56) References Cited

U.S. PATENT DOCUMENTS

| | | | | |
|---|---|---|---|---|
| 4,991,670 | A | 2/1991 | Fuller et al. | |
| 5,090,492 | A | 2/1992 | Keith | |
| 5,238,074 | A * | 8/1993 | Tibbitts | E21B 10/46 175/428 |
| 5,238,075 | A * | 8/1993 | Keith | E21B 10/55 175/431 |
| 5,244,039 | A * | 9/1993 | Newton, Jr. | E21B 10/43 175/431 |
| 5,549,171 | A * | 8/1996 | Mensa-Wilmot | E21B 10/43 175/431 |
| 5,551,522 | A * | 9/1996 | Keith | E21B 10/55 175/420.2 |
| 5,582,261 | A * | 12/1996 | Keith | E21B 10/43 175/431 |
| 5,592,996 | A * | 1/1997 | Keith | E21B 10/55 175/430 |
| 5,595,252 | A | 1/1997 | O'Hanlon | |
| 5,607,024 | A * | 3/1997 | Keith | E21B 10/43 175/431 |
| 5,960,896 | A * | 10/1999 | Barr | E21B 10/43 175/431 |
| 6,173,797 | B1 * | 1/2001 | Dykstra | E21B 10/46 175/325.2 |
| 6,230,828 | B1 * | 5/2001 | Beuershausen | E21B 10/43 175/431 |
| 6,298,930 | B1 | 10/2001 | Sinor et al. | |
| 6,460,631 | B2 | 10/2002 | Dykstra et al. | |
| 6,481,511 | B2 * | 11/2002 | Matthias | B22F 7/06 175/431 |
| 6,536,543 | B2 * | 3/2003 | Meiners | E21B 10/55 175/336 |
| 6,779,613 | B2 | 8/2004 | Dykstra et al. | |
| 6,935,441 | B2 | 8/2005 | Dykstra et al. | |
| 7,096,978 | B2 | 8/2006 | Dykstra et al. | |
| 7,784,563 | B2 * | 8/2010 | Rodland | E21B 7/15 175/16 |
| 8,448,725 | B2 * | 5/2013 | Mensa-Wilmot | E21B 10/46 175/428 |
| 2006/0124358 | A1 * | 6/2006 | Mensa-Wilmot | E21B 10/46 175/57 |
| 2006/0278436 | A1 * | 12/2006 | Dykstra | E21B 10/42 175/57 |
| 2007/0186639 | A1 | 8/2007 | Spross et al. | |
| 2008/0041629 | A1 | 2/2008 | Aronstam et al. | |
| 2009/0090556 | A1 | 4/2009 | Chen | |
| 2009/0133929 | A1 * | 5/2009 | Rodland | E21B 10/60 175/16 |
| 2010/0000800 | A1 | 1/2010 | Chen et al. | |

OTHER PUBLICATIONS

Canadian Office Action; Application No. 2,817,693; pp. 4, Jul. 24, 2014.
Australian Office Action; Application No. 2011326406; 3 pages, Feb. 21, 2015.
Australian Office Action; Application No. 2011326415; 3 pages, Feb. 21, 2015.
Australian Office Action; Application No. 2011326492; 3 pages, Feb. 21, 2015.
International Search Report and Written Opinion, Application No. PCT/US11/60173, 16 pages, Mar. 27, 2012.
International Search Report and Written Opinion, Application No. PCT/US11/60184, 12 pages, Mar. 28, 2012.
U.S. Appl. No. 13/884,505; pp. 113, May 9, 2013.
International Search Report and Written Opinion, Application No. PCT/US11/60194, 11 pages, Mar. 28, 2012.
U.S. Appl. No. 13/884,538; pp. 111, May 9, 2013.
U.S. Appl. No. 13/892,016; pp. 127, May 10, 2013.
International Preliminary Report on Patentability; PCT/US11/60184; pp. 10, May 14, 2013.
International Preliminary Report on Patentability; PCT/US11/60194; pp. 9, May 14, 2013.
International Preliminary Report on Patentability; PCT/US11/60173; pp. 14, Aug. 6, 2013.
Canadian Office Action; Application No. 2,817,696; pp. 4, Jul. 24, 2014.

* cited by examiner

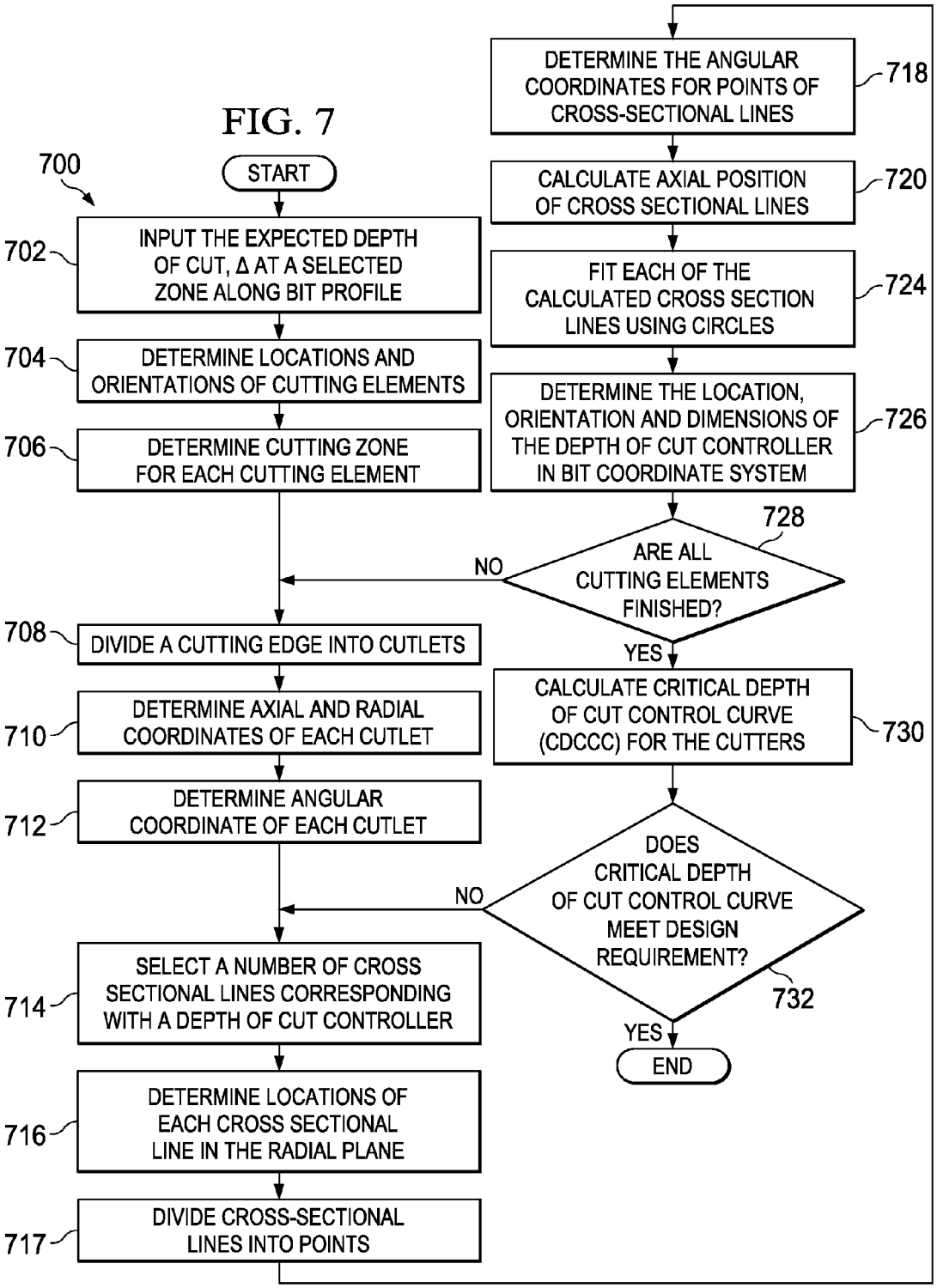
FIG. 7
700
START
702
INPUT THE EXPECTED DEPTH OF CUT, Δ AT A SELECTED ZONE ALONG BIT PROFILE
704
DETERMINE LOCATIONS AND ORIENTATIONS OF CUTTING ELEMENTS
706
DETERMINE CUTTING ZONE FOR EACH CUTTING ELEMENT
708
DIVIDE A CUTTING EDGE INTO CUTLETS
710
DETERMINE AXIAL AND RADIAL COORDINATES OF EACH CUTLET
712
DETERMINE ANGULAR COORDINATE OF EACH CUTLET
714
SELECT A NUMBER OF CROSS SECTIONAL LINES CORRESPONDING WITH A DEPTH OF CUT CONTROLLER
716
DETERMINE LOCATIONS OF EACH CROSS SECTIONAL LINE IN THE RADIAL PLANE
717
DIVIDE CROSS-SECTIONAL LINES INTO POINTS
718
DETERMINE THE ANGULAR COORDINATES FOR POINTS OF CROSS-SECTIONAL LINES
720
CALCULATE AXIAL POSITION OF CROSS SECTIONAL LINES
724
FIT EACH OF THE CALCULATED CROSS SECTION LINES USING CIRCLES
726
DETERMINE THE LOCATION, ORIENTATION AND DIMENSIONS OF THE DEPTH OF CUT CONTROLLER IN BIT COORDINATE SYSTEM
728
ARE ALL CUTTING ELEMENTS FINISHED?
NO
YES
730
CALCULATE CRITICAL DEPTH OF CUT CONTROL CURVE (CDCCC) FOR THE CUTTERS
732
DOES CRITICAL DEPTH OF CUT CONTROL CURVE MEET DESIGN REQUIREMENT?
NO
YES
END

SYSTEM AND METHOD OF CONFIGURING DRILLING TOOLS UTILIZING A CRITICAL DEPTH OF CUT CONTROL CURVE

RELATED APPLICATIONS

This application is a U.S. National Stage Application of International Application No. PCT/US2011/060173 filed Nov. 10, 2011, which designates the United States and claims the benefit of U.S. Provisional Patent Application Ser. No. 61/412,173 filed Nov. 10, 2010 and U.S. Provisional Patent Application Ser. No. 61/416,160 filed Nov. 22, 2010, which are incorporated herein by reference in their entirety.

TECHNICAL FIELD

The present disclosure relates generally to downhole drilling tools and, more particularly, to a system and method of configuring drilling tools utilizing a critical depth of cut control curve.

BACKGROUND

Various types of downhole drilling tools including, but not limited to, rotary drill bits, reamers, core bits, and other downhole tools have been used to form wellbores in associated downhole formations. Examples of such rotary drill bits include, but are not limited to, fixed cutter drill bits, drag bits, polycrystalline diamond compact (PDC) drill bits, and matrix drill bits associated with forming oil and gas wells extending through one or more downhole formations. Fixed cutter drill bits such as a PDC bit may include multiple blades that each include multiple cutting elements.

In typical drilling applications, a PDC bit may be used to drill through various levels or types of geological formations with longer bit life than non-PDC bits. Typical formations may generally have a relatively low compressive strength in the upper portions (e.g., lesser drilling depths) of the formation and a relatively high compressive strength in the lower portions (e.g., greater drilling depths) of the formation. Thus, it typically becomes increasingly more difficult to drill at increasingly greater depths. As well, the ideal bit for drilling at any particular depth is typically a function of the compressive strength of the formation at that depth. Accordingly, the ideal bit for drilling typically changes as a function of drilling depth.

A drilling tool may include one or more depth of cut controllers (DOCCs) configured to control the amount that a drilling tool cuts into the side of a geological formation. However, conventional DOCC configurations may cause an uneven depth of cut control of the cutting elements of the drilling tool. This uneven depth of cut control may allow for portions of the DOCCs to wear unevenly. Also, uneven depth of cut control may cause the drilling tool to vibrate, which may damage parts of the drill string or slow the drilling process.

SUMMARY

According to some embodiments of the present disclosure, a method of determining a critical depth of cut of a drill bit comprises selecting a radial swath associated with an area of a bit face of a drill bit. The method further comprises identifying a plurality of cutting elements disposed on the bit face that each include at least a portion located within the radial swath. The method also comprises identifying a depth of cut controller (DOCC) disposed on the bit face and configured to control a depth of cut of the portions of the plurality of cutting elements located within the radial swath. The method additionally comprises calculating a critical depth of cut associated with the radial swath and DOCC based on a depth of cut associated with each portion of the plurality of cutting elements located within the radial swath and controlled by the DOCC.

BRIEF DESCRIPTION OF THE DRAWINGS

For a more complete understanding of the present disclosure and its features and advantages, reference is now made to the following description, taken in conjunction with the accompanying drawings, in which:

FIG. 7 illustrates a flow chart of an example method for designing one or more DOCCs according to the cutting zones of one or more cutting elements, in accordance with some embodiments of the present disclosure;

DETAILED DESCRIPTION

Embodiments of the present disclosure and its advantages are best understood by referring to FIGS. 1 through 21, where like numbers are used to indicate like and corresponding parts.

Figure 1:
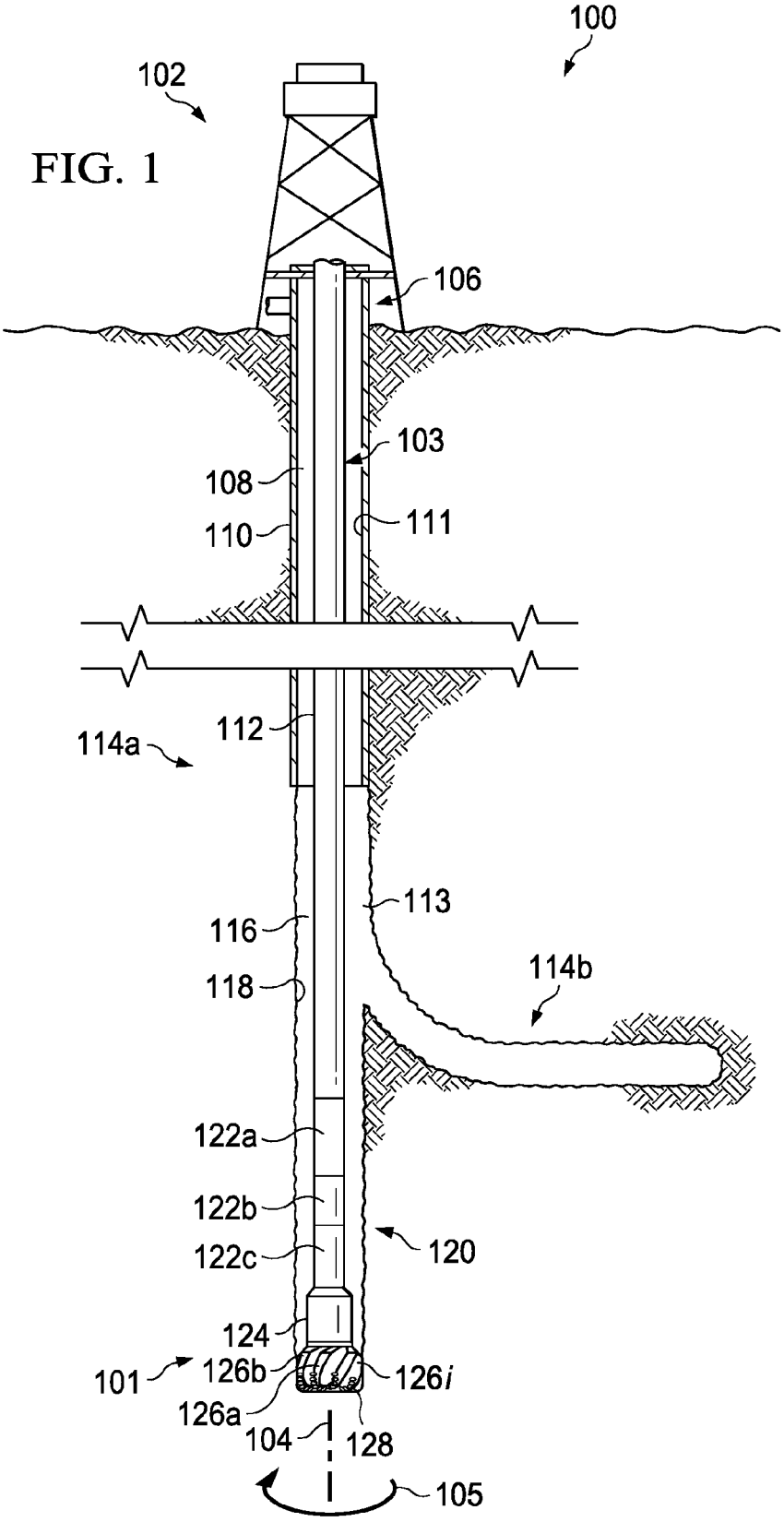
FIG. 1 illustrates an example embodiment of a drilling system in accordance with some embodiments of the present disclosure.

FIG. 1 illustrates an example embodiment of a drilling system 100 configured to drill into one or more geological formations, in accordance with some embodiments of the present disclosure. While drilling into different types of geological formations it may be advantageous to control the amount that a downhole drilling tool cuts into the side of a geological formation in order to reduce wear on the cutting elements of the drilling tool, prevent uneven cutting into the formation, increase control of penetration rate, reduce tool vibration, etc. As disclosed in further detail below, drilling system 100 may include downhole drilling tools (e.g., a drill bit, a reamer, a hole opener, etc.) that may include one or more cutting elements with a depth of cut that may be controlled by one or more depth of cut controllers (DOCC).

As disclosed in further detail below and according to some embodiments of the present disclosure, a DOCC may be configured to control the depth of cut of a cutting element (sometimes referred to as a "cutter") according to the location of a cutting zone and cutting edge of the cutting element. Additionally, according to some embodiments of the present disclosure, a DOCC may be configured according to a plurality of cutting elements that may overlap a radial swath of the drill bit associated with a rotational path of the DOCC, as disclosed in further detail below. In the same or alternative embodiments, the DOCC may be configured to control the depth of cut of the plurality of cutting elements according to the locations of the cutting zones of the cutting elements. In contrast, a DOCC configured according to traditional methods may not be configured according to a plurality of cutting elements that overlap the rotational path of the DOCC, the locations of the cutting zones of the cutting elements or any combination thereof. Accordingly, a DOCC designed according to the present disclosure may provide a more constant and even depth of cut control of the drilling tool than those designed using conventional methods.

Drilling system 100 may include a rotary drill bit ("drill bit") 101. Drill bit 101 may be any of various types of fixed cutter drill bits, including PDC bits, drag bits, matrix drill bits, and/or steel body drill bits operable to form a wellbore 114 extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 (e.g., blades 126*a*-126*i*) that may be disposed outwardly from exterior portions of a rotary bit body 124 of drill bit 101. Rotary bit body 124 may have a generally cylindrical body and blades 126 may be any suitable type of projections extending outwardly from rotary bit body 124. For example, a portion of a blade 126 may be directly or indirectly coupled to an exterior portion of bit body 124, while another portion of the blade 126 is projected away from the exterior portion of bit body 124. Blades 126 formed in accordance with teachings of the present disclosure may have a wide variety of configurations including, but not limited to, substantially arched, helical, spiraling, tapered, converging, diverging, symmetrical, and/or asymmetrical. Various configurations of blades 126 may be used and designed to form cutting structures for drill bit 101 that may provide a more constant depth of cut control incorporating teachings of the present disclosure, as explained further below. For example, in some embodiments one or more blades 126 may be configured to control the depth of cut of cutting elements 128 that may overlap the rotational path of at least a portion of blades 126, as explained in detail below.

In some cases, blades 126 may have substantially arched configurations, generally helical configurations, spiral shaped configurations, or any other configuration satisfactory for use with each downhole drilling tool. One or more blades 126 may have a substantially arched configuration extending from proximate a rotational axis 104 of bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

In an embodiment of drill bit 101, blades 126 may include primary blades disposed generally symmetrically about the bit rotational axis. For example, one embodiment may include three primary blades oriented approximately 120 degrees relative to each other with respect to bit rotational axis 104 in order to provide stability for drill bit 101. In some embodiments, blades 126 may also include at least one secondary blade disposed between the primary blades. The number and location of secondary blades and primary blades may vary substantially. Blades 126 may be disposed symmetrically or asymmetrically with regard to each other and bit rotational axis 104 where the disposition may be based on the downhole drilling conditions of the drilling environment.

Each of blades 126 may include a first end disposed proximate or toward bit rotational axis 104 and a second end disposed proximate or toward exterior portions of drill bit 101 (i.e., disposed generally away from bit rotational axis 104 and toward uphole portions of drill bit 101). The terms "downhole" and "uphole" may be used in this application to describe the location of various components of drilling system 100 relative to the bottom or end of a wellbore. For example, a first component described as "uphole" from a second component may be further away from the end of the wellbore than the second component. Similarly, a first component described as being "downhole" from a second component may be located closer to the end of the wellbore than the second component.

Each blade may have a leading (or front) surface disposed on one side of the blade in the direction of rotation of drill bit 101 and a trailing (or back) surface disposed on an opposite side of the blade away from the direction of rotation of drill bit 101. Blades 126 may be positioned along bit body 124 such that they have a spiral configuration relative to rotational axis 104. In other embodiments, blades 126 may be positioned along bit body 124 in a generally parallel configuration with respect to each other and bit rotational axis 104.

Blades 126 may have a general arcuate configuration extending radially from rotational axis 104. The arcuate configurations of blades 126 may cooperate with each other to define, in part, a generally cone shaped or recessed portion disposed adjacent to and extending radially outward from the bit rotational axis. Exterior portions of blades 126, cutting elements 128 and DOCCs (not expressly shown) may be described as forming portions of the bit face.

Blades 126 may include one or more cutting elements 128 disposed outwardly from exterior portions of each blade 126. For example, a portion of a cutting element 128 may be directly or indirectly coupled to an exterior portion of a blade 126 while another portion of the cutting element 128 may be projected away from the exterior portion of the blade 126. Cutting elements 128 may be any suitable device configured to cut into a formation, including but not limited to, primary cutting elements, backup cutting elements or any combination thereof. By way of example and not limitation, cutting elements 128 may be various types of cutters, compacts, buttons, inserts, and gage cutters satisfactory for use with a wide variety of drill bits 101.

Cutting elements 128 may include respective substrates with a layer of hard cutting material disposed on one end of each respective substrate. The hard layer of cutting elements 128 may provide a cutting surface that may engage adjacent portions of a downhole formation to form a wellbore 114. The contact of the cutting surface with the formation may form a cutting zone associated with each of cutting elements 128, as described in further detail with respect to FIGS. 4A-4D. The edge of the cutting surface located within the cutting zone may be referred to as the cutting edge of a cutting element 128.

Each substrate of cutting elements 128 may have various configurations and may be formed from tungsten carbide or other materials associated with forming cutting elements for rotary drill bits. Tungsten carbides may include, but are not limited to, monotungsten carbide (WC), ditungsten carbide ($W_2C$), macrocrystalline tungsten carbide and cemented or sintered tungsten carbide. Substrates may also be formed using other hard materials, which may include various metal alloys and cements such as metal borides, metal carbides, metal oxides and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds.

Blades 126 may also include one or more DOCCs (not expressly shown) configured to control the depth of cut of cutting elements 128. A DOCC may comprise an impact arrestor, a backup cutter and/or an MDR (Modified Diamond Reinforcement). As mentioned above, in the present disclosure, a DOCC may be designed and configured according to the location of a cutting zone associated with the cutting edge of a cutting element. In the same or alternative embodiments, one or more DOCCs may be configured according to a plurality of cutting elements overlapping the rotational paths of the DOCCs. Accordingly, one or more DOCCs of a drill bit may be configured according to the present disclosure to provide a constant depth of cut of cutting elements 128. Additionally, as disclosed in further detail below, one or more of blades 126 may also be similarly configured to control the depth of cut of cutting elements 128.

Blades 126 may further include one or more gage pads (not expressly shown) disposed on blades 126. A gage pad may be a gage, gage segment, or gage portion disposed on exterior portion of a blade 126. Gage pads may often contact adjacent portions of a wellbore 114 formed by drill bit 101. Exterior portions of blades 126 and/or associated gage pads may be disposed at various angles, either positive, negative, and/or parallel, relative to adjacent portions of a straight wellbore (e.g., wellbore 114*a*). A gage pad may include one or more layers of hardfacing material.

Drilling system 100 may also include a well surface or well site 106. Various types of drilling equipment such as a rotary table, mud pumps and mud tanks (not expressly shown) may be located at a well surface or well site 106. For example, well site 106 may include a drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may include a drill string 103 associated with drill bit 101 that may be used to form a wide variety of wellbores or bore holes such as generally vertical wellbore 114*a* or generally horizontal wellbore 114*b* as shown in FIG. 1. Various directional drilling techniques and associated components of a bottom hole assembly (BHA) 120 of drill string 103 may be used to form horizontal wellbore 114*b*. For example, lateral forces may be applied to drill bit 101 proximate kickoff location 113 to form horizontal wellbore 114*b* extending from generally vertical wellbore 114*a*.

BHA 120 may be formed from a wide variety of components configured to form a wellbore 114. For example, components 122*a*, 122*b* and 122*c* of BHA 120 may include, but are not limited to, drill bits (e.g., drill bit 101) drill collars, rotary steering tools, directional drilling tools, downhole drilling motors, reamers, hole enlargers or stabilizers. The number of components such as drill collars and different types of components 122 included in BHA 120 may depend upon anticipated downhole drilling conditions and the type of wellbore that will be formed by drill string 103 and rotary drill bit 100.

A wellbore 114 may be defined in part by a casing string 110 that may extend from well surface 106 to a selected downhole location. Portions of a wellbore 114, as shown in FIG. 1, that do not include casing string 110 may be described as "open hole." Various types of drilling fluid may be pumped from well surface 106 through drill string 103 to attached drill bit 101. Such drilling fluids may be directed to flow from drill string 103 to respective nozzles (not expressly shown) included in rotary drill bit 100. The drilling fluid may be circulated back to well surface 106 through an annulus 108 defined in part by outside diameter 112 of drill string 103 and inside diameter 118 of wellbore 114*a*. Inside diameter 118 may be referred to as the "sidewall" of wellbore 114*a* Annulus 108 may also be defined by outside diameter 112 of drill string 103 and inside diameter 111 of casing string 110.

The rate of penetration (ROP) of drill bit 101 is often a function of both weight on bit (WOB) and revolutions per minute (RPM). Drill string 103 may apply weight on drill bit 101 and may also rotate drill bit 101 about rotational axis 104 to form a wellbore 114 (e.g., wellbore 114*a* or wellbore 114*b*). For some applications a downhole motor (not expressly shown) may be provided as part of BHA 120 to also rotate drill bit 101. The depth of cut controlled by DOCCs (not expressly shown) and blades 126 may also be based on the ROP and RPM of a particular bit. Accordingly, as described in further detail below, the configuration of the DOCCs and blades 126 to provide a constant depth of cut of cutting elements 128 may be based in part on the desired ROP and RPM of a particular drill bit 101.

Figure 2:
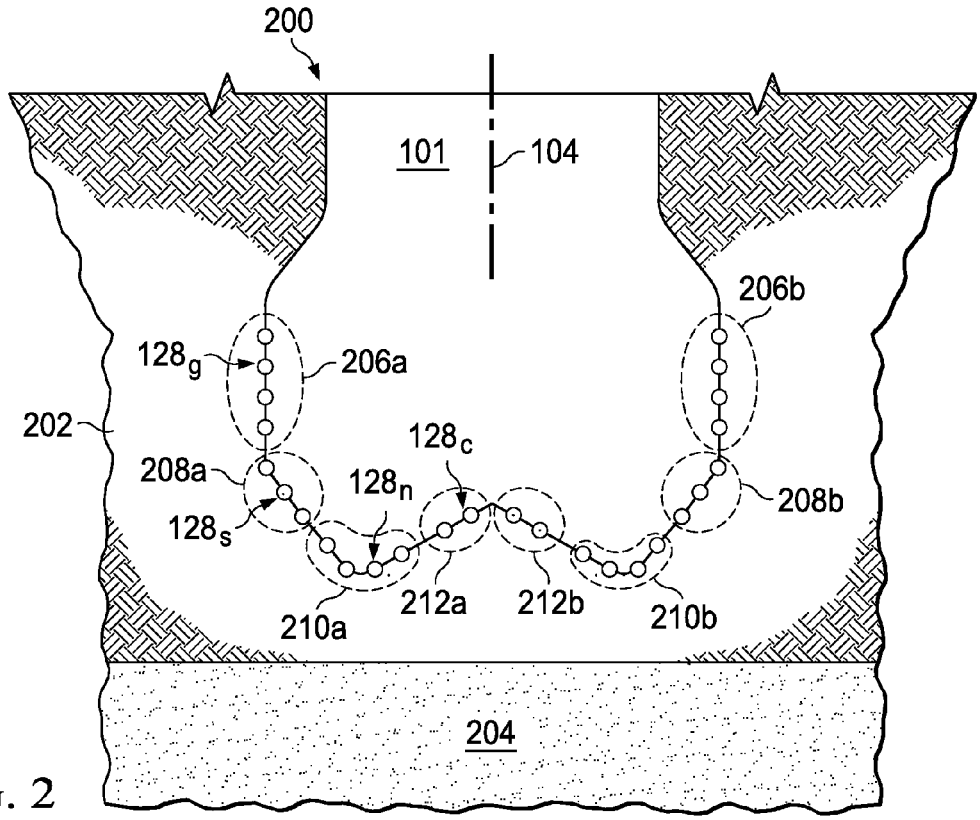
FIG. 2 illustrates a bit face profile of a drill bit forming a wellbore, in accordance with some embodiments of the present disclosure.

FIG. 2 illustrates a bit face profile 200 of drill bit 101 configured to form a wellbore through a first formation layer 202 into a second formation layer 204, in accordance with some embodiments of the present disclosure. Exterior portions of blades (not expressly shown), cutting elements 128 and DOCCs (not expressly shown) may be projected rotationally onto a radial plane to form bit face profile 200. In the illustrated embodiment, formation layer 202 may be described as "softer" or "less hard" when compared to downhole formation layer 204. As shown in FIG. 2, exterior portions of drill bit 101 that contact adjacent portions of a downhole formation may be described as a "bit face." Bit face profile 200 of drill bit 101 may include various zones or segments. Bit face profile 200 may be substantially symmetric about bit rotational axis 104 due to the rotational projection of bit face profile 200, such that the zones or segments on one side of rotational axis 104 may be substantially similar to the zones or segments on the opposite side of rotational axis 104.

For example, bit face profile 200 may include a gage zone 206*a* located opposite a gage zone 206*b*, a shoulder zone 208*a* located opposite a shoulder zone 208*b*, a nose zone 210*a* located opposite a nose zone 210*b*, and a cone zone 212*a* located opposite a cone zone 212*b*. The cutting elements 128 included in each zone may be referred to as cutting elements of that zone. For example, cutting elements $\mathbf{128}_g$ included in gage zones 206 may be referred to as gage cutting elements, cutting elements $\mathbf{128}_s$ included in shoulder zones 208 may be referred to as shoulder cutting elements, cutting elements $\mathbf{128}_n$ included in nose zones 210 may be referred to as nose cutting elements, and cutting elements 128, included in cone zones 212 may be referred to as cone cutting elements. As discussed in further detail below with respect to FIGS. 3 and 4, each zone or segment along bit face profile 200 may be defined in part by respective portions of associated blades 126.

Cone zones 212 may be generally convex and may be formed on exterior portions of each blade (e.g., blades 126 as illustrated in FIG. 1) of drill bit 101, adjacent to and extending out from bit rotational axis 104. Nose zones 210 may be generally convex and may be formed on exterior portions of each blade of drill bit 101, adjacent to and extending from each cone zone 212. Shoulder zones 208 may be formed on exterior portions of each blade 126 extending from respective nose zones 210 and may terminate proximate to a respective gage zone 206.

According to the present disclosure, a DOCC (not expressly shown) may be configured along bit face profile 200 to provide a substantially constant depth of cut control for cutting elements 128. Additionally, in the same or alternative embodiments, a blade surface of a blade 126 may be configured at various points on the bit face profile 200 to provide a substantially constant depth of cut control. The design of each DOCC and blade surface configured to control the depth of cut may be based at least partially on the location of each cutting element 128 with respect to a particular zone of the bit face profile 200 (e.g., gage zone 206, shoulder zone 208, nose zone 210 or cone zone 212). Further, as mentioned above, the various zones of bit face profile 200 may be based on the profile of blades 126 of drill bit 101.

Figure 3:
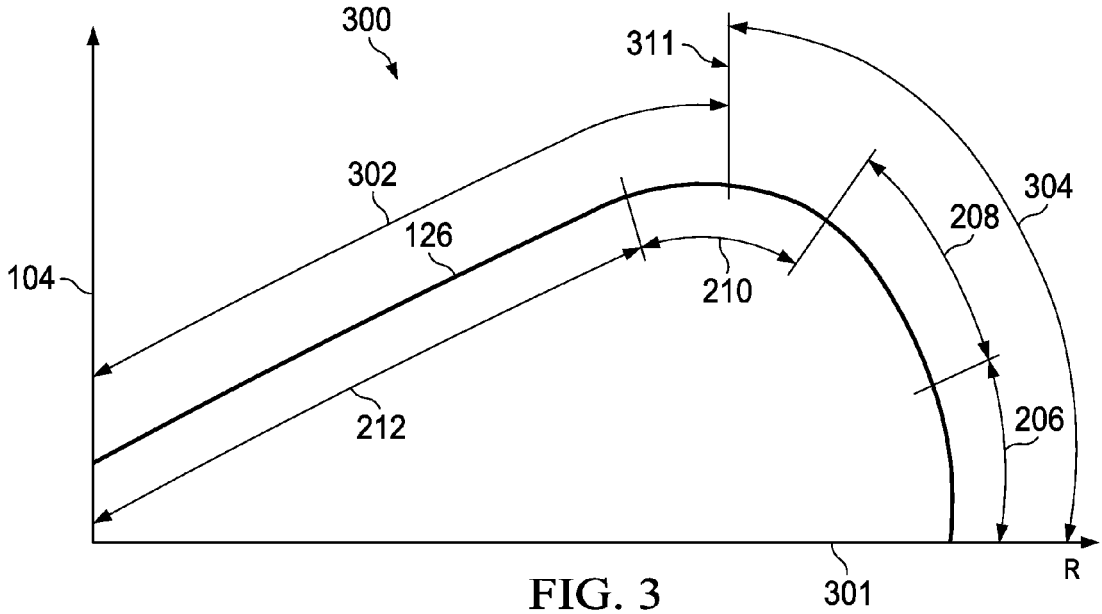
FIG. 3 illustrates a blade profile that may represent a cross-sectional view of a blade of a drill bit, in accordance with some embodiments of the present disclosure.

FIG. 3 illustrates a blade profile 300 that represents a cross-sectional view of a blade 126 of drill bit 101. Blade profile 300 includes a cone zone 212, nose zone 210, shoulder zone 208 and gage zone 206 as described above with respect to FIG. 2. Cone zone 212, nose zone 210, shoulder zone 208 and gage zone 206 may be based on their location along blade 126 with respect to rotational axis 104 and a horizontal reference line 301 that may indicate a distance from rotational axis 104 in a plane perpendicular to rotational axis 104. A comparison of FIGS. 2 and 3 shows that blade profile 300 of FIG. 3 is upside down with respect to bit face profile 200 of FIG. 2.

Blade profile 300 may include an inner zone 302 and an outer zone 304. Inner zone 302 may extend outward from rotational axis 104 to nose point 311. Outer zone 304 may extend from nose point 311 to the end of blade 126. Nose point 311 may be the location on blade profile 300 within nose zone 210 that has maximum elevation as measured by bit rotational axis 104 (vertical axis) from reference line 301 (horizontal axis). A coordinate on the graph in FIG. 3 corresponding to rotational axis 104 may be referred to as an axial coordinate or position. A coordinate on the graph in FIG. 3 corresponding to reference line 301 may be referred to as a radial coordinate or radial position that may indicate a distance extending orthogonally from rotational axis 104 in a radial plane passing through rotational axis 104. For example, in FIG. 3 rotational axis 104 may be placed along a z-axis and reference line 301 may indicate the distance (R) extending orthogonally from rotational axis 104 to a point on a radial plane that may be defined as the ZR plane.

FIGS. 2 and 3 are for illustrative purposes only and modifications, additions or omissions may be made to FIGS. 2 and 3 without departing from the scope of the present disclosure. For example, the actual locations of the various zones with respect to the bit face profile may vary and may not be exactly as depicted.

FIGS. 4A-4D illustrate cutting edges 406 (not expressly labeled in FIG. 4A) and cutting zones 404 of various cutting elements 402 disposed along a blade 400, as modeled by a drilling bit simulator. The location and size of cutting zones 404 (and consequently the location and size of cutting edges 406) may depend on factors including the ROP and RPM of the bit, the size of cutting elements 402, and the location and orientation of cutting elements 402 along the blade profile of blade 400, and accordingly the bit face profile of the drill bit.

Figure 4A:
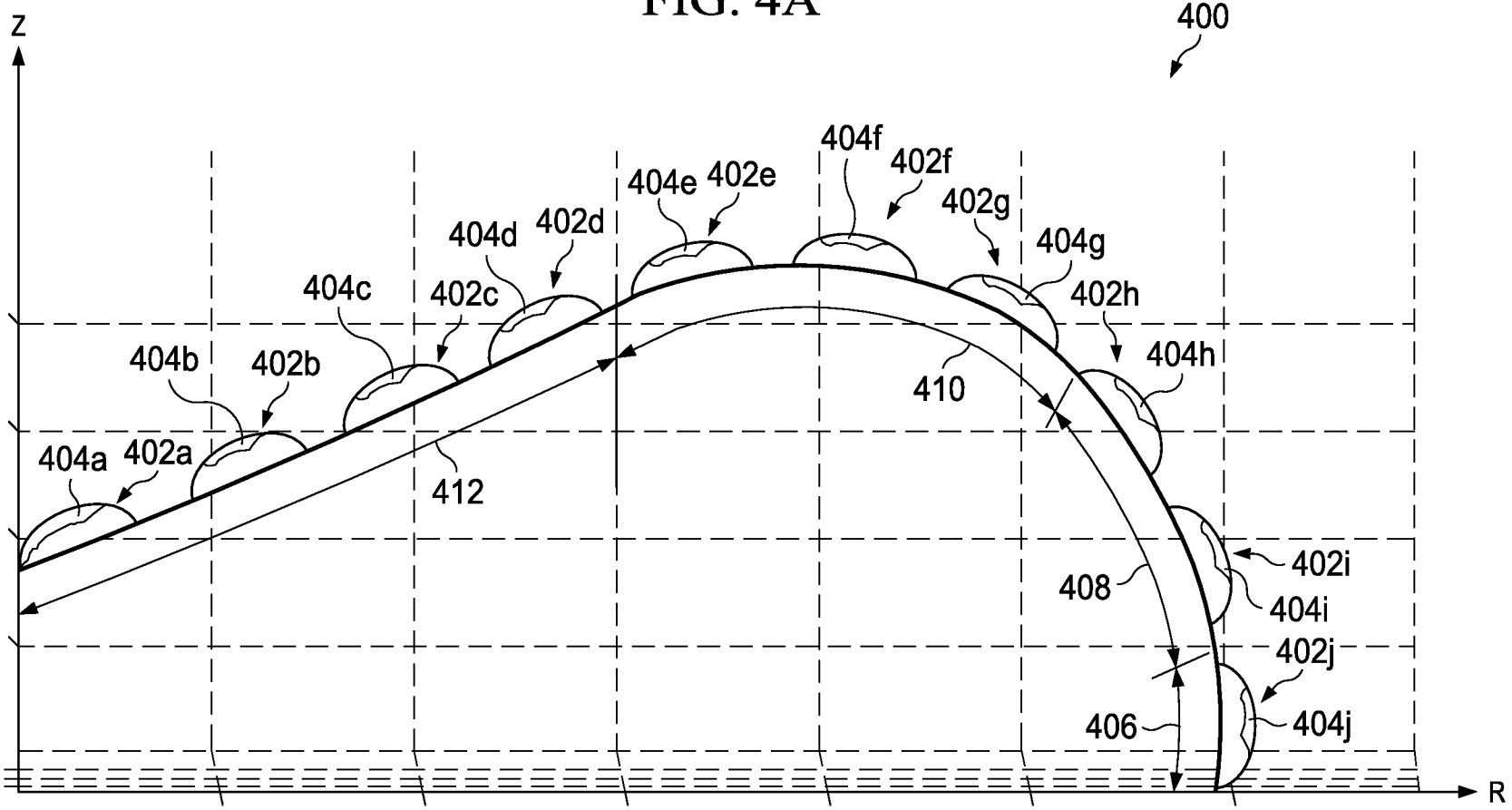
FIGS. 4A-4D illustrate cutting zones of various cutting elements disposed along a blade, in accordance with some embodiments of the present disclosure.

FIG. 4A illustrates a graph of a profile of a blade 400 indicating radial and axial locations of cutting elements 402*a*-402*j* along blade 400. The vertical axis depicts the axial position of blade 400 along a bit rotational axis and the horizontal axis depicts the radial position of blade 400 from the bit rotational axis in a radial plane passing through and perpendicular to the bit rotational axis. Blade 400 may be substantially similar to one of blades 126 described with respect to FIGS. 1-3 and cutting elements 402 may be substantially similar to cutting elements 128 described with respect to FIGS. 1-3. In the illustrated embodiment, cutting elements 402*a*-402*d* may be located within a cone zone 412 of blade 400 and cutting elements 402*e*-402*g* may be located within a nose zone 410 of blade 400. Additionally, cutting elements 402*h*-402*i* may be located within a shoulder zone 408 of blade 400 and cutting element 402*j* may be located within a gage zone 406 of blade 400. Cone zone 412, nose zone 410, shoulder zone 408 and gage zone 406 may be substantially similar to cone zone 212, nose zone 210, shoulder zone 208 and gage zone 206, respectively, described with respect to FIGS. 2 and 3.

FIG. 4A illustrates cutting zones 404*a*-404*j*, with each cutting zone 404 corresponding with a respective cutting element 402. As mentioned above, each cutting element 202 may have a cutting edge (not expressly shown) located within a cutting zone 404. From FIG. 4A it can be seen that the cutting zone 404 of each cutting element 402 may be based on the axial and radial locations of the cutting element 402 on blade 400, which may be related to the various zones of blade 400.

Figure 4B:
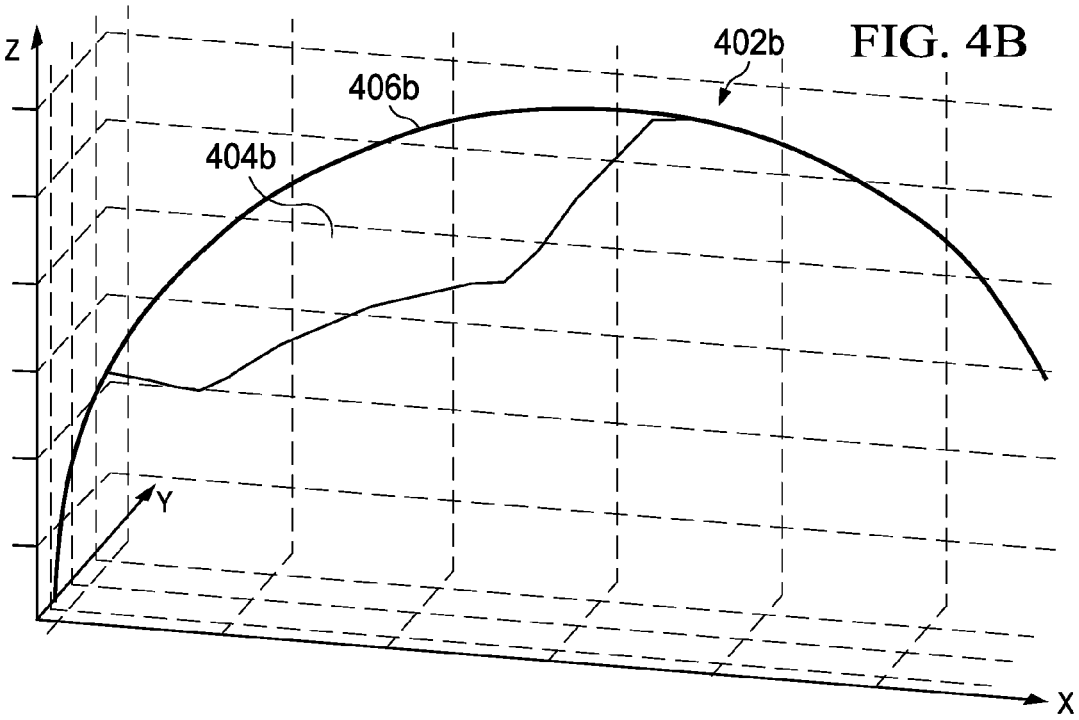

FIG. 4B illustrates an exploded graph of cutting element 402*b* of FIG. 4A to better illustrate cutting zone 404*b* and cutting edge 406*b* associated with cutting element 402*b*. From FIG. 4A it can be seen that cutting element 402*b* may be located in cone zone 412. Cutting zone 404*b* may be based at least partially on cutting element 402*b* being located in cone zone 412 and having axial and radial positions corresponding with cone zone 412. As mentioned above, cutting edge 406*b* may be the edge of the cutting surface of cutting element 402*b* that is located within cutting zone 404*b*.

Figure 4C:
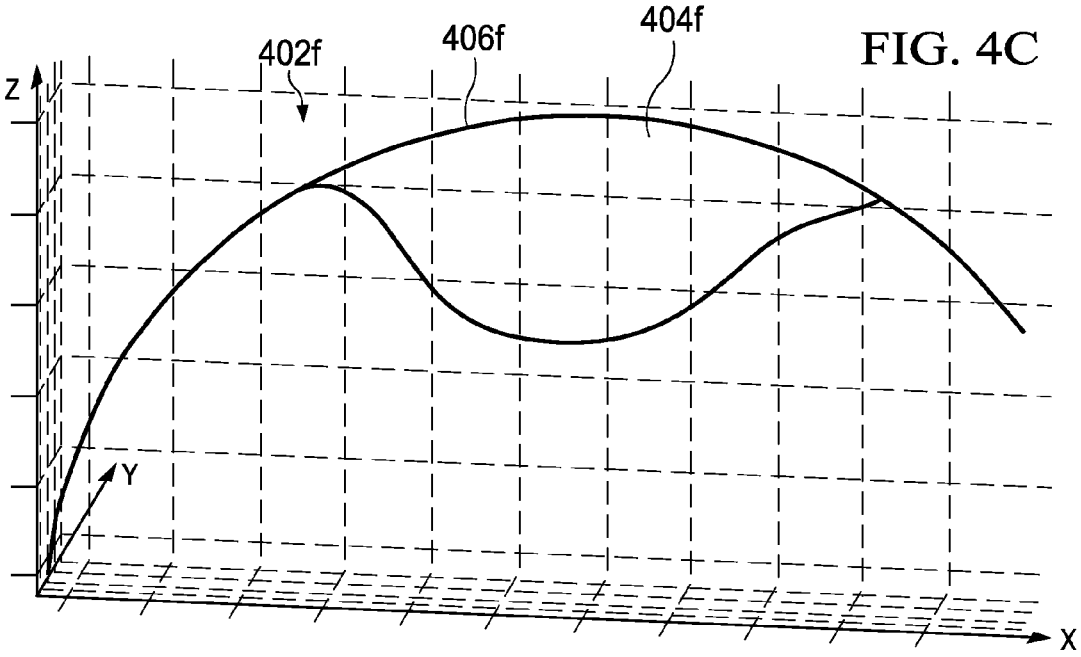

FIG. 4C illustrates an exploded graph of cutting element 402*f* of FIG. 4A to better illustrate cutting zone 404*f* and cutting edge 406*f* associated with cutting element 402*f*. From FIG. 4A it can be seen that cutting element 402*f* may be located in nose zone 410. Cutting zone 404*f* may be based at least partially on cutting element 402*f* being located in nose zone 410 and having axial and radial positions corresponding with nose zone 410.

Figure 4D:
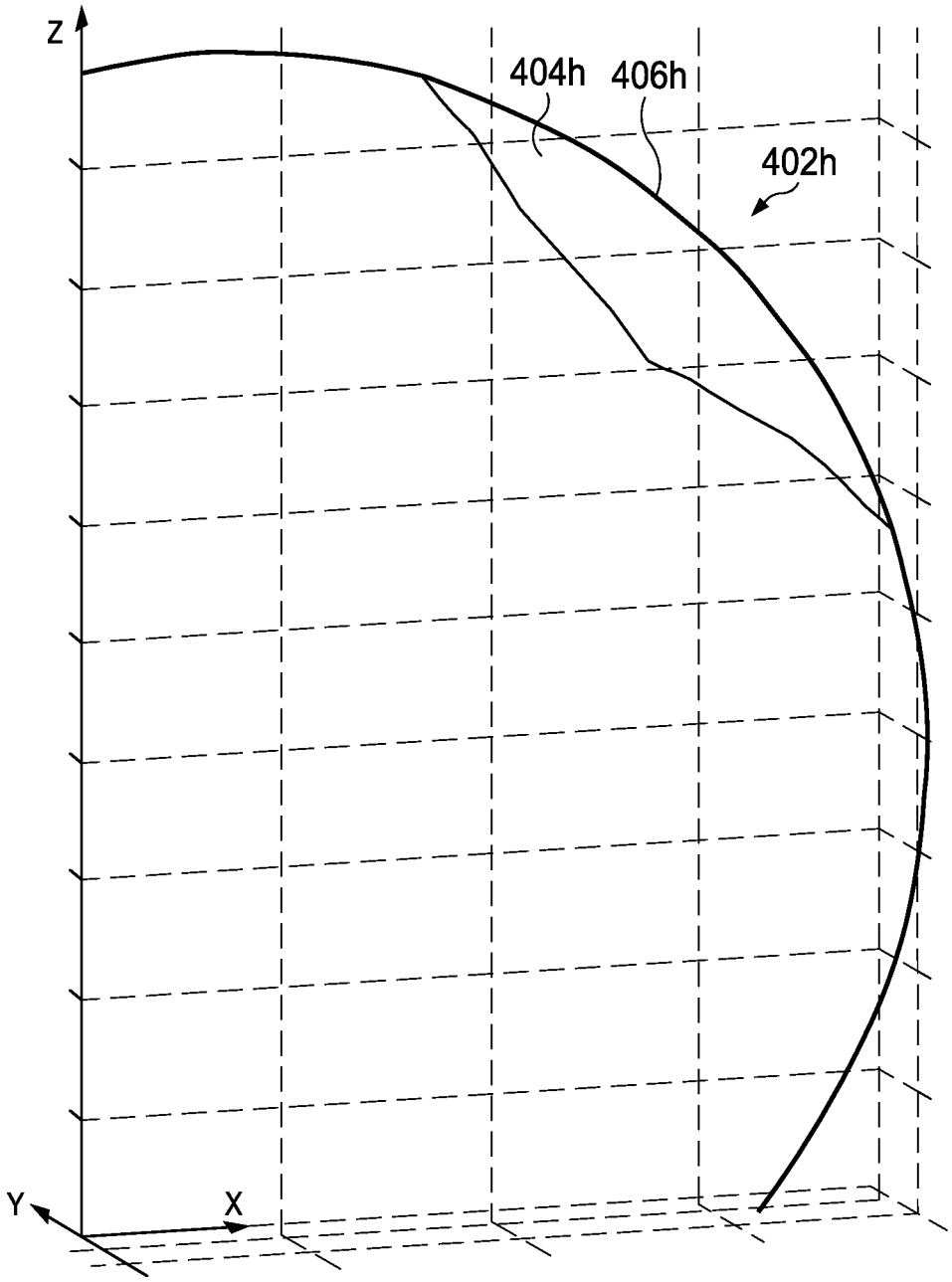

FIG. 4D illustrates an exploded graph of cutting element 402*h* of FIG. 4A to better illustrate cutting zone 404*h* and cutting edge 406*h* associated with cutting element 402*h*. From FIG. 4A it can be seen that cutting element 402*h* may be located in shoulder zone 408. Cutting zone 404*h* may be based partially on cutting element 402*h* being located in shoulder zone 408 and having axial and radial positions corresponding with shoulder zone 408.

An analysis of FIG. 4A and a comparison of FIGS. 4B-4D reveal that the locations of cutting zones 404 of cutting elements 402 may vary at least in part on the axial and radial positions of cutting elements 402 with respect to rotational axis 104. Accordingly, the location, orientation and configuration of a DOCC (or blade configured to control the depth of cut) for a drill bit may take into consideration the locations of the cutting zones (and their associated cutting edges) of the cutting elements that may overlap the rotational path of a DOCC (or blade configured to control the depth of cut).

Figure 5A:
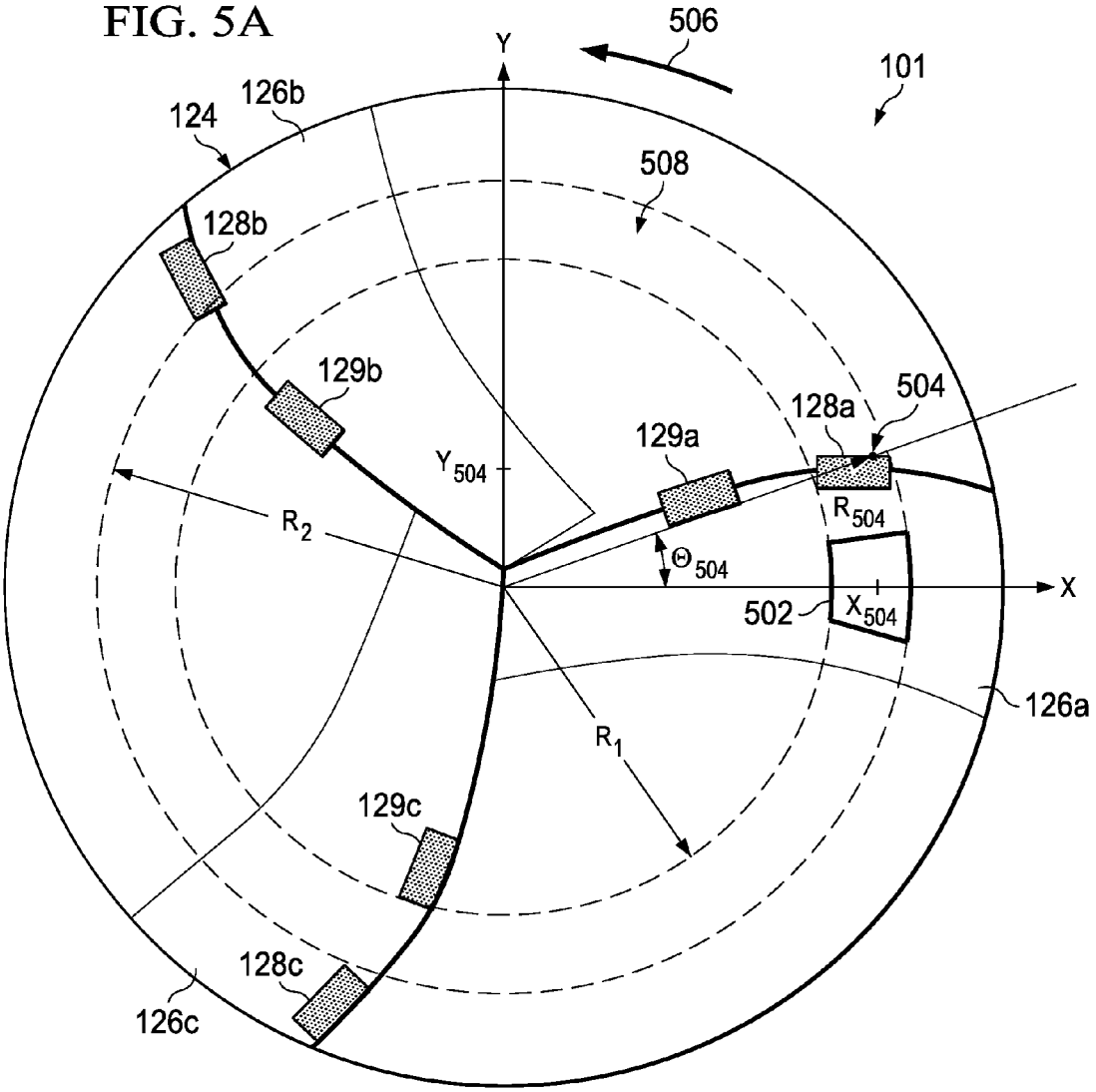
FIG. 5A illustrates the face of a drill bit that may be designed and manufactured to provide an improved depth of cut control, in accordance with some embodiments of the present disclosure.
Figure 5B:
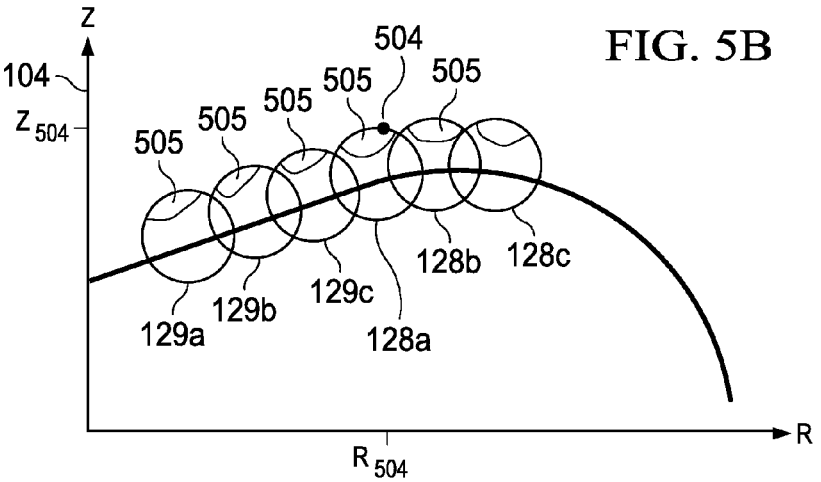
FIG. 5B illustrates the locations of cutting elements of the drill bit of FIG. 5A along the bit profile of the drill bit, in accordance with some embodiments of the present disclosure.

FIG. 5A illustrates the face of a drill bit 101 that may be designed and manufactured according to the present disclosure to provide an improved depth of cut control. FIG. 5B illustrates the locations of cutting elements 128 and 129 of drill bit 101 along the bit profile of drill bit 101. As discussed in further detail below, drill bit 101 may include a DOCC 502 that may be configured to control the depth of cut of a cutting element according to the location of a cutting zone and the associated cutting edge of the cutting element. Additionally, DOCC 502 may be configured to control the depth of cut of cutting elements that overlap the rotational path of DOCC 502. In the same or alternative embodiments, DOCC 502 may be configured based on the cutting zones of cutting elements that overlap the rotational path of DOCC 502.

To provide a frame of reference, FIG. 5A includes an x-axis and a y-axis and FIG. 5B includes a z-axis that may be associated with rotational axis 104 of drill bit 101 and a radial axis (R) that indicates the orthogonal distance from the center of bit 101 in the xy plane. Accordingly, a coordinate or position corresponding to the z-axis may be referred to as an axial coordinate or axial position of the bit face profile. Additionally, a location along the bit face may be described by x and y coordinates of an xy-plane substantially perpendicular to the z-axis. The distance from the center of bit 101 (e.g., rotational axis 104) to a point in the xy plane of the bit face may indicate the radial coordinate or radial position of the point on the bit face profile of bit 101. For example, the radial coordinate, r, of a point in the xy plane having an x coordinate, x, and a y coordinate, y, may be expressed by the following equation:

$$r=\sqrt{x^2+y^2}$$

Additionally, a point in the xy plane may have an angular coordinate that may be an angle between a line extending from the center of bit 101 (e.g., rotational axis 104) to the point and the x-axis. For example, the angular coordinate (θ) of a point in the xy plane having an x-coordinate, x, and a y-coordinate, y, may be expressed by the following equation:

$$\theta=\arctan(y/x)$$

As a further example, a point 504 located on the cutting edge of cutting element 128*a* (as depicted in FIGS. 5A and 5B) may have an x-coordinate ($X_{504}$) and a y-coordinate ($Y_{504}$) in the xy plane that may be used to calculate a radial coordinate ($R_{504}$) of point 504 (e.g., $R_{504}$ may be equal to the square root of $X_{504}$ squared plus $Y_{504}$ squared). $R_{504}$ may accordingly indicate an orthogonal distance of point 504 from rotational axis 104. Additionally, point 504 may have an angular coordinate ($\theta_{504}$) that may be the angle between the x-axis and the line extending from rotational axis 104 to point 504 (e.g., $\theta_{504}$ may be equal to arctan ($X_{504}/Y_{504}$)). Further, as depicted in FIG. 5B, point 504 may have an axial coordinate ($Z_{504}$) that may represent a position along the z-axis that may correspond to point 504. It is understood that the coordinates are used for illustrative purposes only, and that any other suitable coordinate system or configuration, may be used to provide a frame of reference of points along the bit face and bit face profile of drill bit 101. Additionally, any suitable units may be used. For example, the angular position may be expressed in degrees or in radians.

Drill bit 101 may include bit body 124 with a plurality of blades 126 positioned along bit body 124. In the illustrated embodiment, drill bit 101 may include blades 126*a*-126*c*, however it is understood that in other embodiments, drill bit 101 may include more or fewer blades 126. Blades 126 may include outer cutting elements 128 and inner cutting elements 129 disposed along blades 126. For example, blade 126*a* may include outer cutting element 128*a* and inner cutting element 129*a*, blade 126*b* may include outer cutting element 128*b* and inner cutting element 129*b* and blade 126*c* may include outer cutting element 128*c* and inner cutting element 129*c*.

As mentioned above, drill bit 101 may include one or more DOCCs 502. In the present illustration, only one DOCC 502 is depicted, however drill bit 101 may include more DOCCs 502. Drill bit 101 may rotate about rotational axis 104 in direction 506. Accordingly, DOCC 502 may be placed behind cutting element 128*a* on blade 126*a* with respect to the rotational direction 506. However, in alternative embodiments DOCC 502 may placed in front of cutting element 128*a* (e.g., on blade 126*b*) such that DOCC 502 is in front of cutting element 128*a* with respect to the rotational direction 506.

As drill bit 101 rotates, DOCC 502 may follow a rotational path indicated by radial swath 508 of drill bit 101. Radial swath 508 may be defined by radial coordinates $R_1$ and $R_2$. $R_1$ may indicate the orthogonal distance from rotational axis 104 to the inside edge of DOCC 502 (with respect to the center of drill bit 101). $R_2$ may indicate the orthogonal distance from rotational axis 104 to the outside edge of DOCC 502 (with respect to the center of drill bit 101).

As shown in FIGS. 5A and 5B, cutting elements 128 and 129 may each include a cutting zone 505. In the illustrated embodiment, cutting zones 505 of cutting elements 128 and 129 may not overlap at a specific depth of cut. This lack of overlap may occur for some bits with a small number of blades and a small number of cutting elements at a small depth of cut. The lack of overlap between cutting zones may also occur for cutting elements located within the cone zone of fixed cutter bits because the number of blades within the cone zone is usually small. In such instances, a DOCC 502 or a portion of a blade 126 may be designed and configured according to the location of the cutting zone 505 and cutting edge of a cutting element 128 or 129 with a depth of cut that may be controlled by the DOCC 502 or blade 126.

For example, cutting element 128*a* may include a cutting zone 505 and associated cutting edge that overlaps the rotational path of DOCC 502 such that DOCC 502 may be configured according to the location of the cutting edge of cutting element 128*a*, as described in detail with respect to FIGS. 6 and 7. In the same or alternative embodiments, the surface of a blade 126 (e.g., the surface of blade 126*b*) may also be configured according to the location of the cutting edge of cutting element 128*a* to control the depth of cut of cutting element 128*a*, as described in detail with respect to FIGS. 8 and 9.

Therefore, as discussed further below, DOCC 502 may be configured to control the depth of cut of cutting element 128*a* that may intersect or overlap radial swath 508. Additionally, as described in detail below, in the same or alternative embodiments, the surface of one or more blades 126 within radial swath 508 may be configured to control the depth of cut of cutting element 128*a* located within radial swath 508. Further, DOCC 502 and the surface of one or more blades 126 may be configured according to the location of the cutting zone and the associated cutting edge of cutting elements 128*a* that may be located within radial swath 508.

Modifications, additions or omissions may be made to FIGS. 5A and 5B without departing from the scope of the present disclosure. For example, the number of blades 126, cutting elements 128 and DOCCs 502 may vary according to the various design constraints and considerations of drill bit 101. Additionally, radial swath 508 may be larger or smaller than depicted or may be located at a different radial location, or any combination thereof.

Further, in alternative embodiments, the cutting zones 505 of cutting elements 128 and 129 may overlap and a DOCC 502 or a portion of a blade 126 may be designed and configured according to a plurality of cutting elements 128 and/or 129 that may be located within the rotational path of the DOCCs 502 and/or the blades 126 as depicted in FIGS. 10-19. However, the principles and ideas described with respect to FIGS. 6-9 (configuring a DOCC and/or a blade according to cutting zones and cutting edges) may be implemented with respect to the principles and ideas of FIGS. 10-19 (configuring a DOCC and/or a blade according to a plurality of cutting elements that may overlap the rotational path of the DOCC and/or the blade) and vice versa.

Figure 6A:
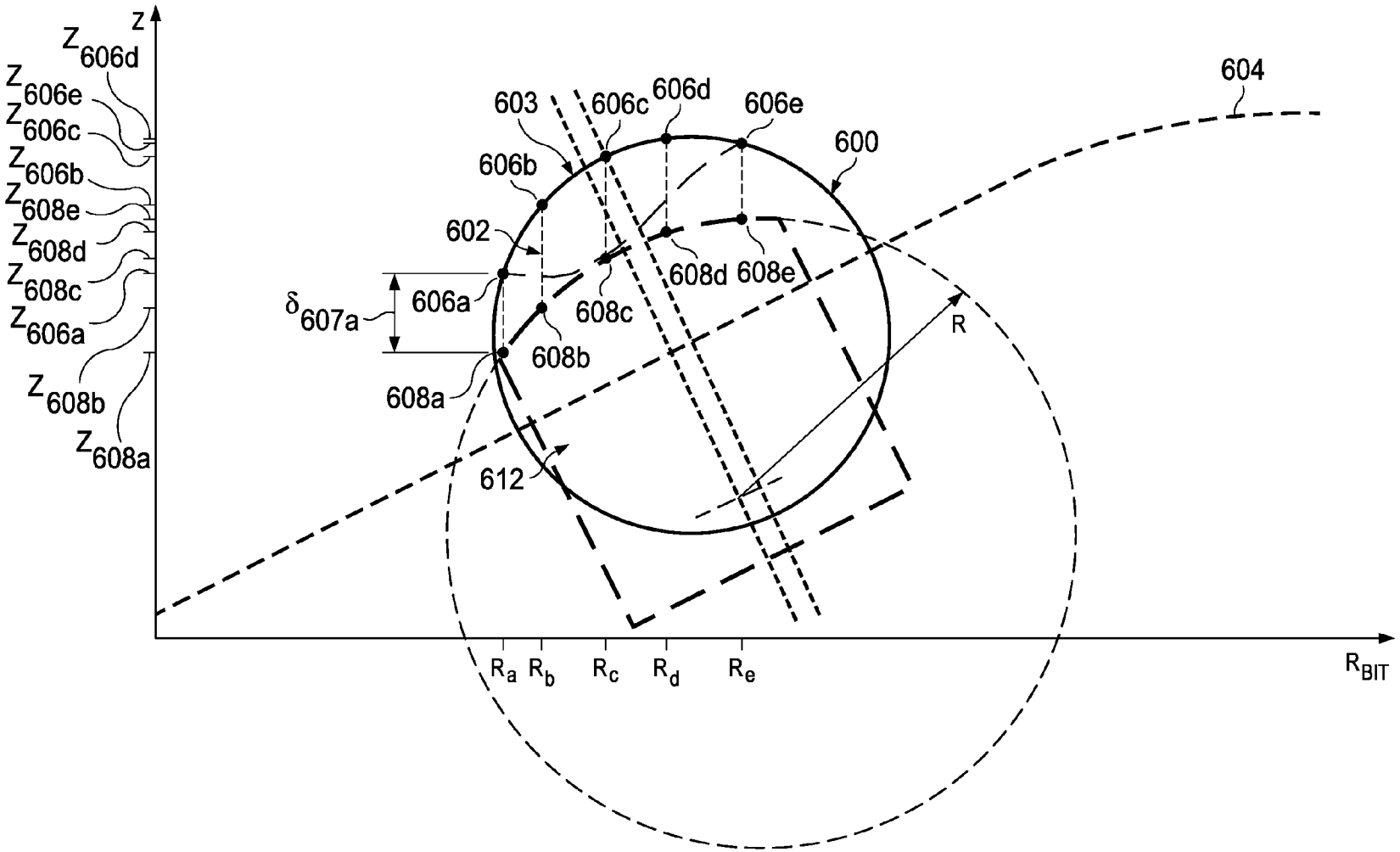
FIG. 6A illustrates a graph of the bit face profile of a cutting element having a cutting zone with a depth of cut that may be controlled by a depth of cut controller (DOCC) designed in accordance with some embodiments of the present disclosure.
Figure 6B:
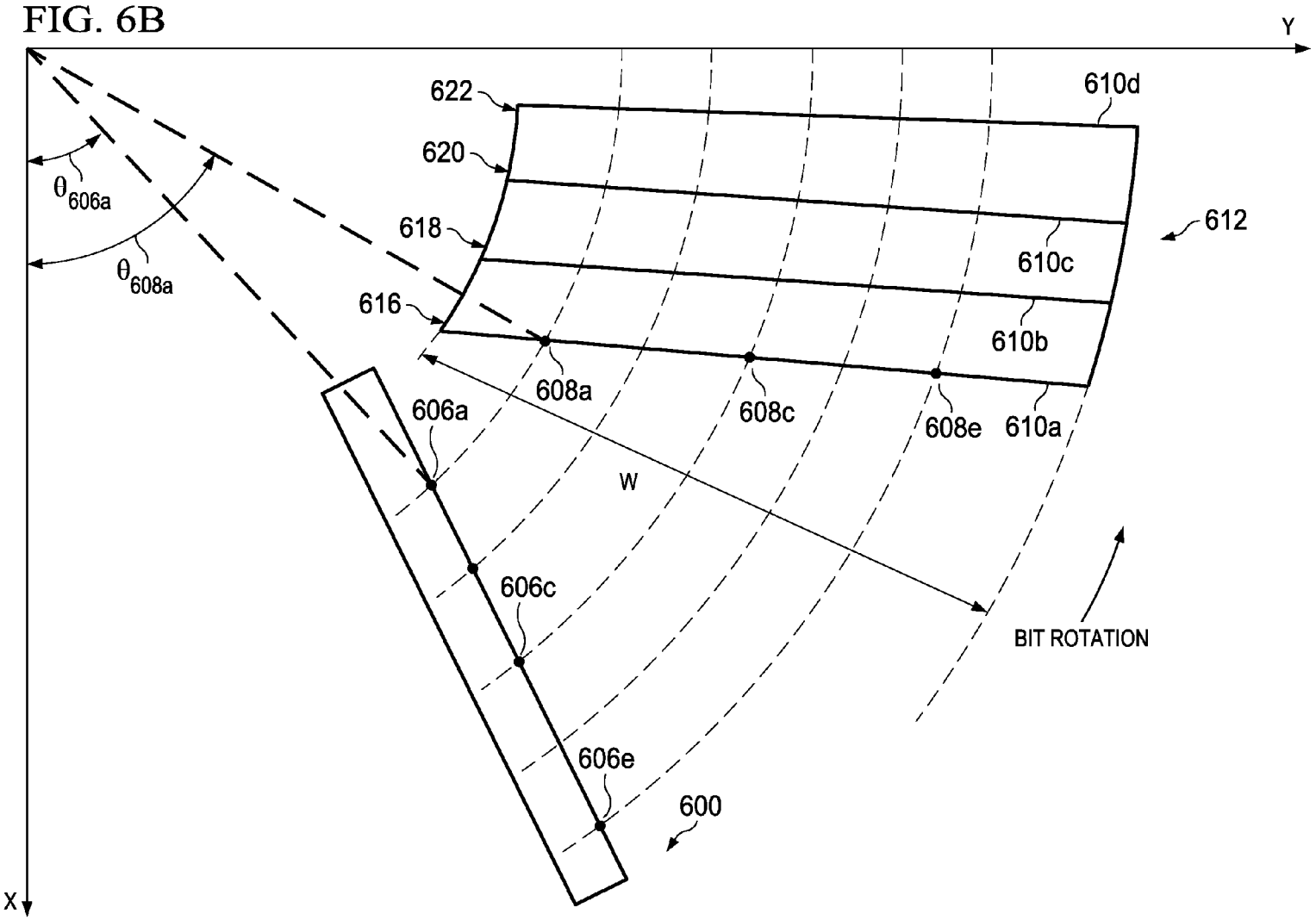
FIG. 6B illustrates a graph of the bit face illustrated in the bit face profile of FIG. 6A, in accordance with some embodiments of the present disclosure.
Figure 6C:
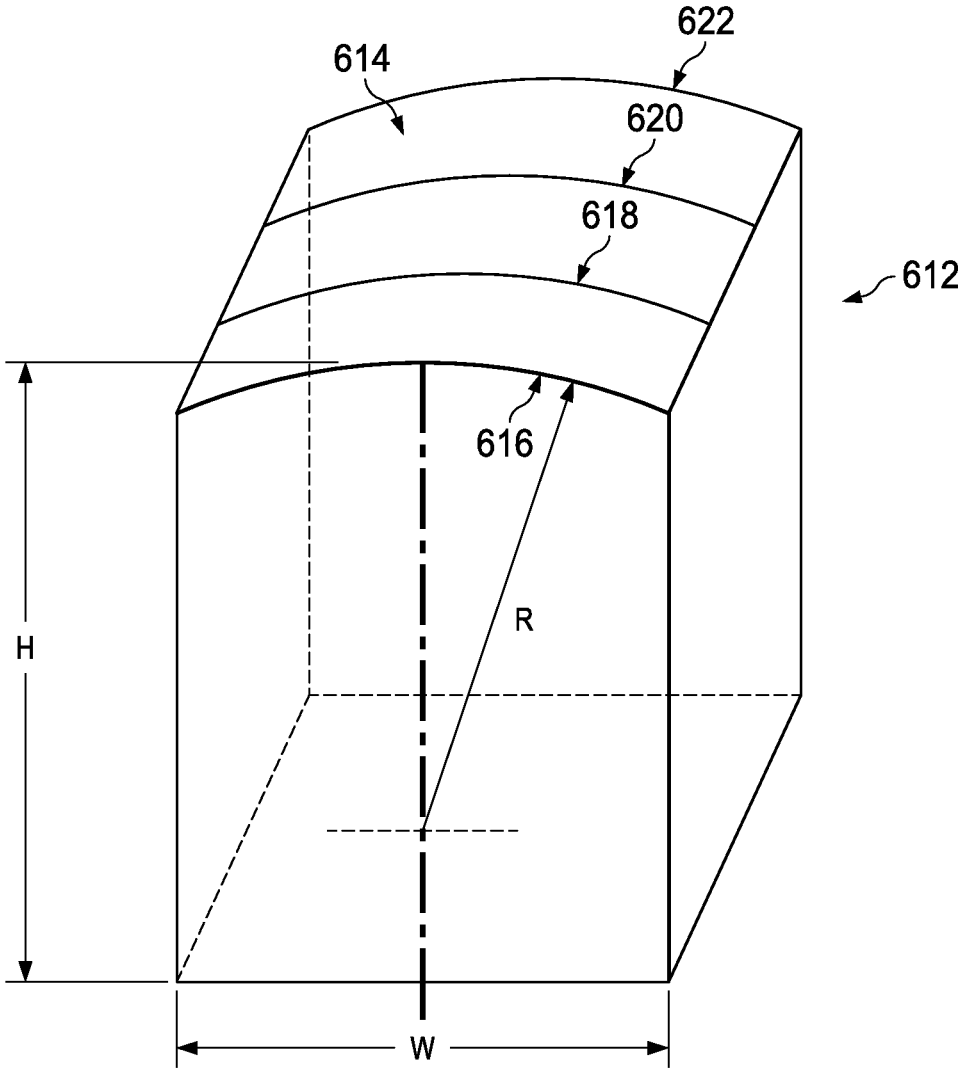
FIG. 6C illustrates the DOCC of FIG. 6A designed according to some embodiments of the present disclosure.

FIGS. 6A-6C illustrate a DOCC 612 that may be designed according to the location of a cutting zone 602 of a cutting element 600 of a drill bit such as that depicted in FIGS. 5A and 5B. The coordinate system used in FIGS. 6A-6C may be substantially similar to that described with respect to FIGS. 5A and 5B. Therefore, the rotational axis of the drill bit corresponding with FIGS. 6A-6C may be associated with the z-axis of a Cartesian coordinate system to define an axial position with respect to the drill bit. Additionally, an xy plane of the coordinate system may correspond with a plane of the bit face of the drill bit that is substantially perpendicular to the rotational axis. Coordinates on the xy plane may be used to define radial and angular coordinates associated with the drill bit of FIGS. 6A-6C.

FIG. 6A illustrates a graph of a bit face profile of a cutting element 600 that may be controlled by a depth of cut controller (DOCC) 612 located on a blade 604 and designed in accordance with some embodiments of the present disclosure. FIG. 6A illustrates the axial and radial coordinates of cutting element 600 and DOCC 612 configured to control the depth of cut of cutting element 600 based on the location of a cutting zone 602 (and its associated cutting edge 603) of cutting element 600. In some embodiments, DOCC 612 may be located on the same blade 604 as cutting element 600, and, in other embodiments, DOCC 612 may be located on a different blade 604 as cutting element 600. Cutting edge 603 of cutting element 600 that corresponds with cutting zone 602 may be divided according to cutlets 606*a*-606*e* that have radial and axial positions depicted in FIG. 6A. Additionally, FIG. 6A illustrates the radial and axial positions of control points 608*a*-608*e* that may correspond with a back edge 616 of DOCC 612, as described in further detail with respect to FIG. 6B.

As depicted in FIG. 6A, the radial coordinates of control points 608*a*-608*e* may be determined based on the radial coordinates of cutlets 606*a*-606*e* such that each of control points 608*a*-608*e* respectively may have substantially the same radial coordinates as cutlets 606*a*-606*e*. By basing the radial coordinates of control points 608*a*-608*e* on the radial coordinates of cutlets 606*a*-606*e*, DOCC 612 may be configured such that its radial swath substantially overlaps the radial swath of cutting zone 602 to control the depth of cut of cutting element 600. Additionally, as discussed in further detail below, the axial coordinates of control points 608*a*-608*e* may be determined based on a desired depth of cut, Δ, of cutting element 600 and a corresponding desired axial underexposure, $\delta_{607i}$, of control points 608*a*-608*e* with respect to cutlets 606*a*-606*e*. Therefore, DOCC 612 may be configured according to the location of cutting zone 602 and cutting edge 603.

FIG. 6B illustrates a graph of the bit face illustrated in the bit face profile of FIG. 6A. DOCC 612 may be designed according to calculated coordinates of cross-sectional lines 610 that may correspond with cross-sections of DOCC 612. For example, the axial, radial and angular coordinates of a back edge 616 of DOCC 612 may be determined and designed according to determined axial, radial and angular coordinates of cross-sectional line 610*a*. In the present disclosure, the term "back edge" may refer to the edge of a component that is the trailing edge of the component as a drill bit associated with the drill bit rotates. The term "front edge" may refer to the edge of a component that is the leading edge of the component as the drill bit associated with the component rotates. The axial, radial and angular coordinates of cross-sectional line 610*a* may be determined according to cutting edge 603 associated with cutting zone 602 of cutting element 600, as described below.

As mentioned above, cutting edge 603 may be divided into cutlets 606*a*-606*e* that may have various radial coordinates defining a radial swath of cutting zone 602. A location of cross-sectional line 610*a* in the xy plane may be selected such that cross-sectional line 610*a* is associated with a blade 604 where DOCC 612 may be disposed. The location of cross-sectional line 610*a* may also be selected such that cross-sectional line 610*a* intersects the radial swath of cutting edge 603. Cross-sectional line 610*a* may be divided into control points 608*a*-608*e* having substantially the same radial coordinates as cutlets 606*a*-606*e*, respectively. Therefore, in the illustrated embodiment, the radial swaths of cutlets 606*a*-606*e* and control points 608*a*-608*e*, respectively, may be substantially the same. With the radial swaths of cutlets 606*a*-606*e* and control points 608*a*-608*e* being substantially the same, the axial coordinates of control points 608*a*-608*e* at back edge 616 of DOCC 612 may be determined for cross-sectional line 610*a* to better obtain a desired depth of cut control of cutting edge 603 at cutlets 606*a*-606*e*, respectively. Accordingly, in some embodiments, the axial, radial and angular coordinates of DOCC 612 at back edge 616 may be designed based on calculated axial, radial and angular coordinates of cross-sectional line 610*a* such that DOCC 612 may better control the depth of cut of cutting element 600 at cutting edge 603.

The axial coordinates of each control point 608 of cross-sectional line 610*a* may be determined based on a desired axial underexposure $\delta_{607i}$ between each control point 608 and its respective cutlet 606. The desired axial underexposure $\delta_{607i}$ may be based on the angular coordinates of a control point 608 and its respective cutlet 606 and the desired depth of cut Δ of cutting element 600. For example, the desired axial underexposure $\delta_{607a}$ of control point 608*a* with respect to cutlet 606*a* (depicted in FIG. 6A) may be based on the angular coordinate ($\theta_{608a}$) of control point 608*a*, the angular coordinate ($\theta_{606a}$) of cutlet 606*a* and the desired depth of cut Δ of cutting element 600. The desired axial underexposure $\delta_{607a}$ of control point 608*a* may be expressed by the following equation:

$$\delta_{607a}=\Delta*(360-(\theta_{608a}-\theta_{606a}))/360$$

In this equation, the desired depth of cut Δ may be expressed as a function of rate of penetration (ROP, ft/hr) and bit rotational speed (RPM) by the following equation:

$$\Delta=ROP/(5*RPM)$$

The desired depth of cut Δ may have a unit of inches per bit revolution. The desired axial underexposures of control points 608*b*-608*e* ($\delta_{607b}$–$\delta_{607e}$, respectively) may be similarly determined. In the above equation, $\theta_{606a}$ and $\theta_{608a}$ may be expressed in degrees, and "360" may represent one full revolution of approximately 360 degrees. Accordingly, in instances where $\theta_{606a}$ and $\theta_{608a}$ may be expressed in radians, "360" may be replaced by "2π." Further, in the above equation, the resultant angle of "($\theta_{608a}$–$\theta_{606a}$)" ($\Delta_\theta$) may be defined as always being positive. Therefore, if resultant angle $\Delta_\theta$ is negative, then $\Delta_\theta$ may be made positive by adding 360 degrees (or 2π radians) to $\Delta_\theta$.

Additionally, the desired depth of cut (Δ) may be based on the desired ROP for a given RPM of the drill bit, such that DOCC 612 may be designed to be in contact with the formation at the desired ROP and RPM, and, thus, control the depth of cut of cutting element 600 at the desired ROP and RPM. The desired depth of cut Δ may also be based on the location of cutting element 600 along blade 604. For example, in some embodiments, the desired depth of cut Δ may be different for the cone portion, the nose portion, the shoulder portion the gage portion, or any combination thereof, of the bit profile portions. In the same or alternative embodiments, the desired depth of cut Δ may also vary for subsets of one or more of the mentioned zones along blade 604.

In some instances, cutting elements within the cone portion of a drill bit may wear much less than cutting elements within the nose and gauge portions. Therefore, the desired depth of cut Δ for a cone portion may be less than that for the nose and gauge portions. Thus, in some embodiments, when the cutting elements within the nose and/or gauge portions wear to some level, then a DOCC 612 located in the nose and/or gauge portions may begin to control the depth of cut of the drill bit.

Once the desired underexposure $\delta_{607i}$ of each control point 608 is determined, the axial coordinate ($Z_{608i}$) of each control point 608 as illustrated in FIG. 6A may be determined based on the desired underexposure $\delta_i$ of the control point 608 with respect to the axial coordinate ($Z_{606i}$) of its corresponding cutlet 606. For example, the axial coordinate of control point 608*a* ($Z_{608a}$) may be determined based on the desired underexposure of control point 608*a* ($\delta_{607a}$) with respect to the axial coordinate of cutlet 606 ($Z_{606a}$), which may be expressed by the following equation:

$$Z_{608a}=Z_{606a}-\delta_{607a}$$

Once the axial, radial and angular coordinates for control points 608 are determined for cross-sectional line 610*a*, back edge 616 of DOCC 612 may be designed according to these points such that back edge 616 has approximately the same axial, radial and angular coordinates of cross-sectional line 610*a*. In some embodiments, the axial coordinates of control points 608 of cross-sectional line 610*a* may be smoothed by curve fitting technologies. For example, if an MDR is designed based on the calculated coordinates of control points 608, then the axial coordinates of control points 608 may be fit by one or more circular lines. Each of the circular lines may have a center and a radius that may be used to design the MDR. The surface of DOCC 612 at intermediate cross-sections 618 and 620 and at front edge 622 may be similarly designed based on determining radial, angular, and axial coordinates of cross-sectional lines 610*b*, 610*c*, and 610*d*, respectively.

Accordingly, the surface of DOCC 612 may be configured at least partially based on the locations of cutting zone 602 and cutting edge 603 of cutting element 600 to improve the depth of cut control of cutting element 600. Additionally, the height and width of DOCC 612 and its placement in the radial plane of the drill bit may be configured based on cross-sectional lines 610, as described in further detail with respect to FIG. 6C. Therefore, the axial, radial and angular coordinates of DOCC 612 may be such that the desired depth of cut control of cutting element 600 is improved. As shown in FIGS. 6A and 6B, configuring DOCC 612 based on the locations of cutting zone 602 and cutting edge 603 may cause DOCC 612 to be radially aligned with the radial swath of cutting zone 602 but may also cause DOCC 612 to be radially offset from the center of cutting element 600, which may differ from traditional DOCC placement methods.

FIG. 6C illustrates DOCC 612 designed according to the present disclosure. DOCC 612 may include a surface 614 with back edge 616, a first intermediate cross-section 618, a second intermediate cross-section 620 and a front edge 622. As discussed with respect to FIG. 6B, back edge 616 may correspond with cross-sectional line 610*a*. Additionally, first intermediate cross-section 618 may correspond with cross-sectional line 610*b*, second intermediate cross-section 620 may correspond with cross-sectional line 610*c* and front edge 622 may correspond with cross-sectional line 610*d*.

As mentioned above, the curvature of surface 614 may be designed according to the axial curvature made by the determined axial coordinates of cross-sectional lines 610. Accordingly, the curvature of surface 614 along back edge 616 may have a curvature that approximates the axial curvature of cross-sectional line 610*a*; the curvature of surface 614 along first intermediate cross-section 618 may approximate the axial curvature of cross-sectional line 610*b*; the curvature of surface 614 along second intermediate cross-section 620 may approximate the axial curvature of cross-sectional line 610*c*; and the curvature of surface 614 along front edge 622 may approximate the axial curvature of cross-sectional line 610*d*. In the illustrated embodiment and as depicted in FIGS. 6A and 6C, the axial curvature of cross-sectional line 610*a* may be approximated by the curvature of a circle with a radius "R," such that the axial curvature of back edge 616 may be substantially the same as the circle with radius "R."

The axial curvature of cross-sectional lines 610*a*-610*d* may or may not be the same, and accordingly the curvature of surface 614 along back edge 616, intermediate cross-sections 618 and 620, and front edge 622 may or may not be the same. In some instances where the curvature is not the same, the approximated curvatures of surface 614 along back edge 616, intermediate cross-sections 618 and 620, and front edge 622 may be averaged such that the overall curvature of surface 614 is the calculated average curvature. Therefore, the determined curvature of surface 614 may be substantially constant to facilitate manufacturing of surface 614. Additionally, although shown as being substantially fit by the curvature of a single circle, it is understood that the axial curvature of one or more cross-sectional lines 610 may be fit by a plurality of circles, depending on the shape of the axial curvature.

DOCC 612 may have a width W that may be large enough to cover the width of cutting zone 602 and may correspond to the length of a cross-sectional line 610. Additionally, the height H of DOCC 612, as shown in FIG. 6C, may be configured such that when DOCC 612 is placed on blade 604, the axial positions of surface 614 sufficiently correspond with the calculated axial positions of the cross-sectional lines used to design surface 614. The height H may correspond with the peak point of the curvature of surface 614 that corresponds with a cross-sectional line. For example, the height H of DOCC 612 at back edge 616 may correspond with the peak point of the curvature of DOCC 612 at back edge 616. Additionally, the height H at back edge 616 may be configured such that when DOCC 612 is placed at the calculated radial and angular positions on blade 604 (as shown in FIG. 6B), surface 614 along back edge 616 may have approximately the same axial, angular and radial positions as control points 608*a*-608*e* calculated for cross-sectional line 610*a*.

In some embodiments where the curvature of surface 614 varies according to different curvatures of the cross-sectional lines, the height H of DOCC 612 may vary according to the curvatures associated with the different cross-sectional lines. For example, the height with respect to back edge 616 may be different than the height with respect to front edge 622. In other embodiments where the curvature of the cross-sectional lines is averaged to calculate the curvature of surface 614, the height H of DOCC 612 may correspond with the peak point of the curvature of the entire surface 614.

In some embodiments, the surface of DOCC 612 may be designed using the three dimensional coordinates of the control points of all the cross-sectional lines. The axial coordinates may be smoothed using a two dimensional interpolation method such as a MATLAB® function called interp2.

Modifications, additions or omissions may be made to FIGS. 6A-6C without departing from the scope of the present disclosure. Although a specific number of cross-sectional lines, points along the cross-sectional lines and cutlets are described, it is understood that any appropriate number may be used to configure DOCC 612 to acquire the desired depth of cut control. In one embodiment, the number of cross-sectional lines may be determined by the size and the shape of a DOCC. For example, if a hemi-spherical component is used as a DOCC, (e.g., an MDR) then only one cross sectional line may be needed. If an impact arrestor (semi-cylinder like) is used, then more cross-sectional lines (e.g., at least two) may be used. Additionally, although the curvature of the surface of DOCC 612 is depicted as being substantially round and uniform, it is understood that the surface may have any suitable shape that may or may not be uniform, depending on the calculated surface curvature for the desired depth of cut. Further, although the above description relates to a DOCC designed according to the cutting zone of one cutting element, a DOCC may be designed according to the cutting zones of a plurality of cutting elements to control the depth of cut of more than one cutting element, as described in further detail below.

FIG. 7 illustrates a flow chart of an example method 700 for designing one or more DOCCs (e.g., DOCC 612 of FIGS. 6A-6C) according to the location of the cutting zone and its associated cutting edge of a cutting element. In the illustrated embodiment the cutting structures of the bit including at least the locations and orientations of all cutting elements may have been previously designed. However in other embodiments, method 700 may include steps for designing the cutting structure of the drill bit.

The steps of method 700 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering tool" or "engineering tool."

Method 700 may start and, at step 702, the engineering tool may determine a desired depth of cut ("Δ") at a selected zone along a bit profile. As mentioned above, the desired depth of cut Δ may be based on the desired ROP for a given RPM, such that the DOCCs within the bit profile zone (e.g., cone zone, shoulder zone, etc.) may be designed to be in contact with the formation at the desired ROP and RPM, and, thus, control the depth of cut of cutting elements in the cutting zone at the desired ROP and RPM.

At step 704, the locations and orientations of cutting elements within the selected zone may be determined. At step 706, the engineering tool may create a 3D cutter/rock interaction model that may determine the cutting zone for each cutting element in the design based at least in part on the expected depth of cut Δ for each cutting element. As noted above, the cutting zone and cutting edge for each cutting element may be based on the axial and radial coordinates of the cutting element.

At step 708, using the engineering tool, the cutting edge within the cutting zone of each of the cutting elements may be divided into cutting points ("cutlets") of the bit face profile. For illustrative purposes, the remaining steps are described with respect to designing a DOCC with respect to one of the cutting elements, but it is understood that the steps may be followed for each DOCC of a drill bit, either at the same time or sequentially.

At step 710, the axial and radial coordinates for each cutlet along the cutting edge of a selected cutting element associated with the DOCC may be calculated with respect to the bit face (e.g., the axial and radial coordinates of cutlets 606 of FIGS. 6A and 6B may be determined). Additionally, at step 712, the angular coordinate of each cutlet may be calculated in the radial plane of the bit face.

At step 714, the locations of a number of cross-sectional lines in the radial plane corresponding to the placement and design of a DOCC associated with the cutting element may be determined (e.g., cross-sectional lines 610 associated with DOCC 612 of FIGS. 6A-6C). The cross-sectional lines may be placed within the radial swath of the cutting zone of the cutting element such that they intersect the radial swath of the cutting zone, and, thus have a radial swath that substantially covers the radial swath of the cutting zone. In some embodiments, the length of the cross-sectional lines may be based on the width of the cutting zone and cutting edge such that the radial swath of the cutting zone and cutting edge is substantially intersected by the cross-sectional lines. Therefore, as described above, the cross-sectional lines may be used to model the shape, size and configuration of the DOCC such that the DOCC controls the depth of cut of the cutting element at the cutting edge of the cutting element.

Further, the number of cross-sectional lines may be determined based on the desired size of the DOCC to be designed as well as the desired precision in designing the DOCC. For example, the larger the DOCC, the more cross-sectional lines may be used to adequately design the DOCC within the radial swath of the cutting zone and thus provide a more consistent depth of cut control for the cutting zone.

At step 716, the locations of the cross-sectional lines disposed on a blade may be determined (e.g., the locations of cross-sectional lines 610 in FIG. 6B) such that the radial coordinates of the cross-sectional lines substantially intersect the radial swath of the cutting zone of the cutting element. At step 717, each cross-sectional line may be divided into points with radial coordinates that substantially correspond with the radial coordinates of the cutlets determined in step 708 (e.g., cross-sectional line 610*a* divided into points 608 of FIGS. 6A-6C). At step 718, the engineering tool may be used to determine the angular coordinate for each point of each cross-sectional line in a plane substantially perpendicular to the bit rotational axis (e.g., the xy plane of FIGS. 6A-6C). At step 720, the axial coordinate for each point on each cross-sectional line may also be determined by determining a desired axial underexposure between the cutlets of the cutting element and each respective point of the cross-sectional lines corresponding with the cutlets, as described above with respect to FIGS. 6A-6C. After determining the axial underexposure for each point of each cross-sectional line, the axial coordinate for each point may be determined by applying the underexposure of each point to the axial coordinate of the cutlet associated with the point, also as described above with respect to FIGS. 6A-6C.

After calculating the axial coordinate of each point of each cross-sectional line based on the cutlets of a cutting zone of an associated cutting element, (e.g., the axial coordinates of points 608*a*-608*e* of cross-sectional line 610*a* based on cutlets 606*a*-606*e* of FIGS. 6A-6C) at step 720, method 700 may proceed to steps 724 and 726 where a DOCC may be designed according to the axial, angular, and radial coordinates of the cross-sectional lines.

In some embodiments, at step 724, for each cross-sectional line, the curve created by the axial coordinates of the points of the cross-sectional line may be fit to a portion of a circle. Accordingly, the axial curvature of each cross-sectional line may be approximated by the curvature of a circle. Thus, the curvature of each circle associated with each cross-sectional line may be used to design the three-dimensional surface of the DOCC to approximate a curvature for the DOCC that may improve the depth of cut control. In some embodiments, the surface of the DOCC may be approximated by smoothing the axial coordinates of the surface using a two dimensional interpolation method, such as a MATLAB® function called interp2.

In step 726, the width of the DOCC may also be configured. In some embodiments, the width of the DOCC may be configured to be as wide as the radial swath of the cutting zone of a corresponding cutting element. Thus, the cutting zone of the cutting element may be located within the rotational path of the DOCC such that the DOCC may provide the appropriate depth of cut control for the cutting element. Further, at step 726, the height of the DOCC may be designed such that the surface of the DOCC is approximately at the same axial position as the calculated axial coordinates of the points of the cross-sectional lines. Therefore, the engineering tool may be used to design a DOCC according to the location of the cutting zone and cutting edge of a cutting element.

After determining the location, orientation and dimensions of a DOCC at step 726, method 700 may proceed to step 728. At step 728, it may be determined if all the DOCCs have been designed. If all of the DOCCs have not been designed, method 700 may repeat steps 708-726 to design another DOCC based on the cutting zones of one or more other cutting elements.

At step 730, once all of the DOCCs are designed, a critical depth of cut control curve (CDCCC) may be calculated using the engineering tool. The CDCCC may be used to determine how even the depth of cut is throughout the desired zone. At step 732, using the engineering tool, it may be determined whether the CDCCC indicates that the depth of cut control meets design requirements. If the depth of cut control meets design requirements, method 700 may end. Calculation of the CDCCC is described in further detail with respect to FIGS. 20A-20C and FIG. 21.

If the depth of cut control does not meet design requirements, method 700 may return to step 714, where the design parameters may be changed. For example, the number of cross-sectional lines may be increased to better design the surface of the DOCC according to the location of the cutting zone and cutting edge. Further, the angular coordinates of the cross-sectional line may be changed. In other embodiments, if the depth of cut control does not meet design requirements, method 700 may return to step 708 to determine a larger number of cutlets for dividing the cutting edge, and thus better approximate the cutting edge. Additionally, as described further below, the DOCC may be designed according to the locations of the cutting zones and cutting edges of more than one cutting element that may be within the radial swath of the DOCC.

Additionally, method 700 may be repeated for configuring one or more DOCCs to control the depth of cut of cutting elements located within another zone along the bit profile by inputting another expected depth of cut, Δ, at step 702. Therefore, one or more DOCCs may be configured for the drill bit within one or more zones along the bit profile of a drill bit according to the locations of the cutting edges of the cutting elements to improve the depth of cut control of the drill bit.

Modifications, additions or omissions may be made to method 700 without departing from the scope of the disclosure. For example, the order of the steps may be changed. Additionally, in some instances, each step may be performed with respect to an individual DOCC and cutting element until that DOCC is designed for the cutting element and then the steps may be repeated for other DOCCs or cutting elements. In other instances, each step may be performed with respect to each DOCC and cutting element before moving onto the next step. Similarly, steps 716 through 724 may be done for one cross-sectional line and then repeated for another cross-sectional line, or steps 716 through 724 may be performed for each cross-sectional line at the same time, or any combination thereof. Further, the steps of method 700 may be executed simultaneously, or broken into more steps than those described. Additionally, more steps may be added or steps may be removed without departing from the scope of the disclosure.

Once one or more DOCCs are designed using method 700, a drill bit may be manufactured according to the calculated design constraints to provide a more constant and even depth of cut control of the drill bit. The constant depth of cut control may be based on the placement, dimensions and orientation of DOCCs, such as impact arrestors, in both the radial and axial positions with respect to the cutting zones and cutting edges of the cutting elements. In the same or alternative embodiments, the depth of cut of a cutting element may be controlled by a blade.

Figure 8A:
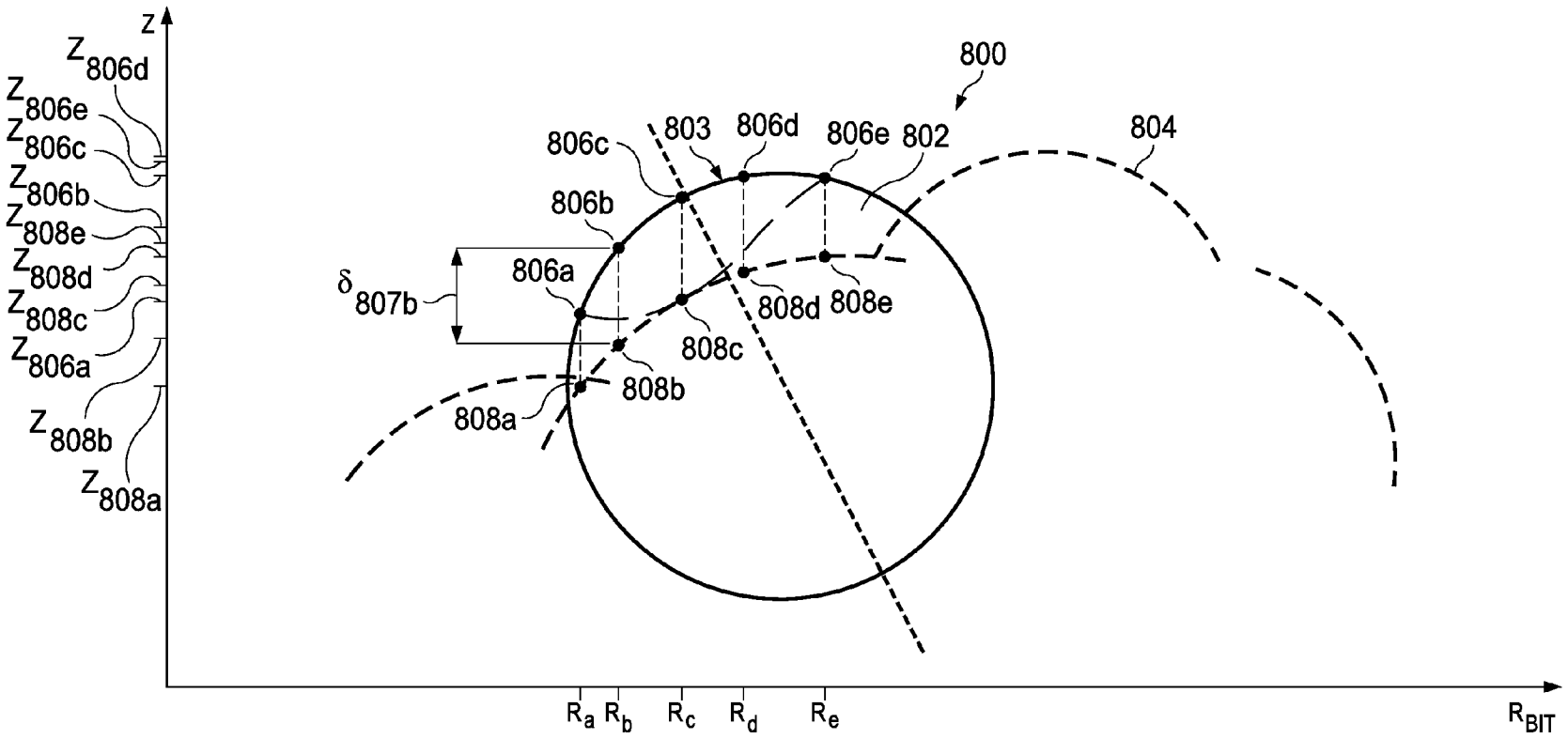
FIG. 8A illustrates a graph of the bit face profile of a cutting element having a cutting zone with a depth of cut that may be controlled by a blade, in accordance with some embodiments of the present disclosure.

FIG. 8A illustrates a graph of the bit face profile of a cutting element with a depth of cut that may be controlled by a blade 804. FIG. 8A illustrates the axial and radial coordinates of cutting element 800 and blade 804 configured to control the depth of cut of cutting element 800 based on the location of a cutting zone 802 (and its associated cutting edge 803) of cutting element 800. Similar to FIG. 6A, the axial coordinates of points in FIG. 8A may correspond to the vertical z-axis and the radial coordinates of points in FIG. 8A may correspond to the horizontal axis and may be expressed as an orthogonal distance R from the center of the drill bit. Additionally, the radial and angular coordinates may correspond to a location in an xy plane such that the radial and angular coordinates may be determined using corresponding x and y coordinates as described above. Cutting edge 803 may be divided into cutlets 806*a*-806*e*, having axial and radial coordinates as shown in FIG. 8A, similar to cutting edge 603 divided into cutlets 606*a*-606*e* in FIGS. 6A and 6B.

Additionally, the cross-sectional view of blade 804 shown in FIG. 8A may be at a trailing edge 816 of blade 804. Blade points 808*a*-808*e* on trailing edge 816 having substantially the same radial coordinates as cutlets 806*a*-806*e* (e.g., blade point 808*a* may have the same radial coordinate as cutlet 806*a*, blade point 808*b* may have the same radial coordinate as cutlet 806*b*, etc.) may be selected to configure blade 804 to control the depth of cut of cutting element 800.

Figure 8B:
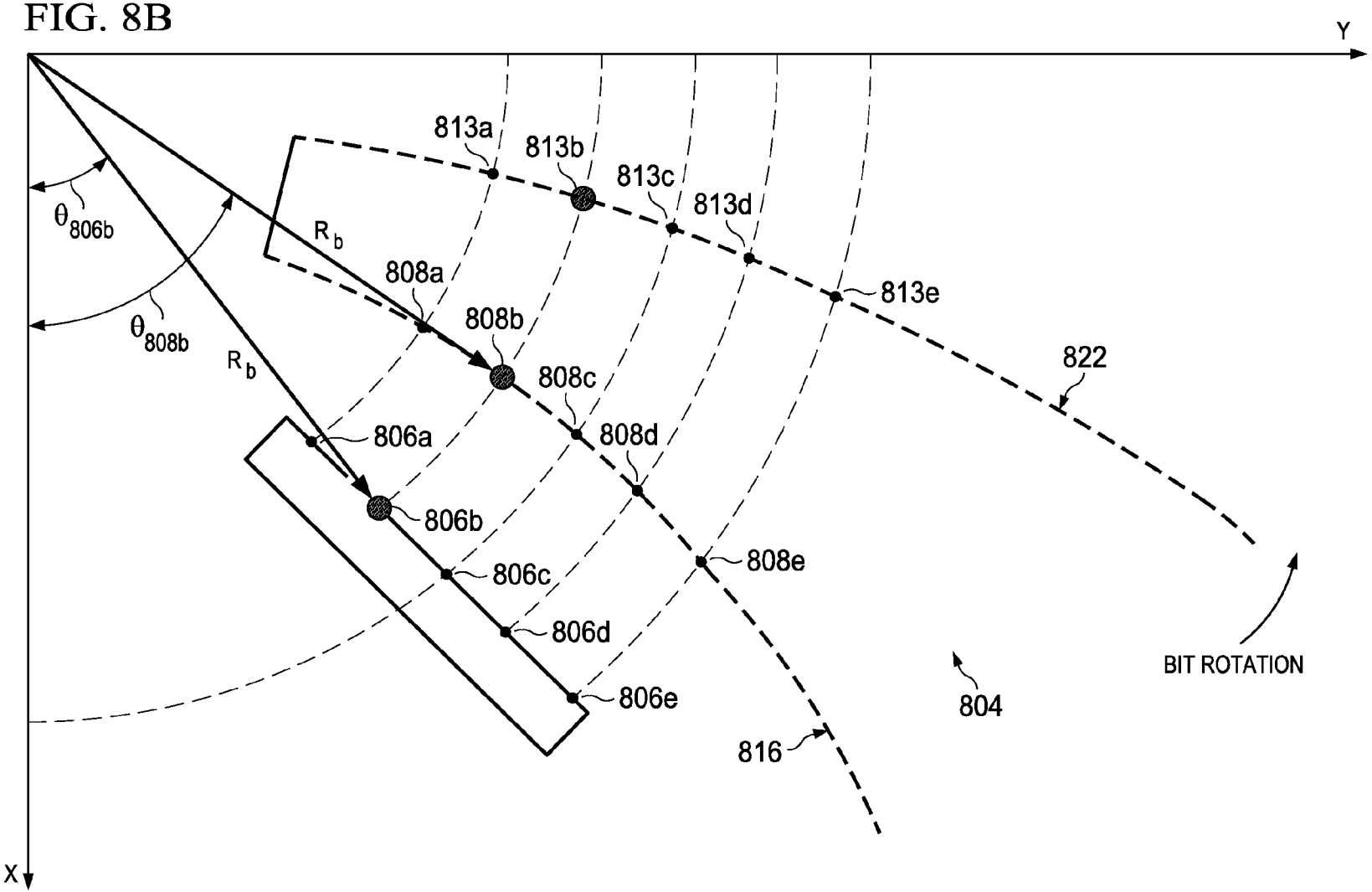
FIG. 8B illustrates a graph of the bit face illustrated in the bit face profile of FIG. 8A, in accordance with some embodiments of the present disclosure.

FIG. 8B illustrates a graph of the bit face illustrated in the bit face profile of FIG. 8A. Similar to FIG. 6B, the graph of FIG. 8B may be based on an xy plane represented by x and y axes. The center of the drill bit in the xy plane may correspond to the intersection of the x and y axes and the rotational axis of the drill bit. Cutlets 806*a*-806*e* in the xy plane may be expressed in terms of x and y coordinates that may be used to determine the angular and radial coordinates of cutlets 806*a*-806*e*. FIG. 8B illustrates the angular coordinate of cutlet 806*b* ($\theta_{806b}$) in the xy plane based on the location of cutlet 806*b* in the xy plane. FIG. 8B also illustrates the locations of blade points 808*a*-808*e* in the xy plane that have the same radial coordinates as their corresponding cutlets 806. Additionally, as shown in FIG. 8B, blade points 808*a*-808*e* may have angular coordinates that, along with the radial coordinates, may indicate the locations of blade points 808*a*-808*e* in the xy plane. Specifically, in FIG. 8B, the angular and radial coordinates of blade point 808*b* ($\theta_{808b}$ and $R_b$, respectively) are shown. As with the angular coordinate of cutlet 806*b* ($\theta_{806b}$), the angular coordinate of blade point 808*b* may be determined with respect to the depicted x-axis. However, the angular coordinates may be determined with respect to another frame of reference without departing from the scope of the present disclosure.

The desired axial coordinates of each blade point 808 may be determined based on a desired underexposure ($\delta_{807i}$) of the blade point 808 with respect to its associated cutlet 806. The desired underexposure $\delta_{807i}$ of a blade point 808 may be determined based on a desired depth of cut $\Delta$ in the corresponding blade zone and the angular coordinates of the blade point 808 and its respective cutlet 806, similar to as described above with respect to the desired underexposure $\delta_{607i}$ of points 608 described above with respect to FIGS. 6A-6C. For example, in FIG. 8A, the axial coordinate of blade point 808*b* may be calculated such that the difference between the axial position of cutlet 806*b* and blade point 808*b* is underexposure $\delta_{807b}$. The axial coordinates of the remaining blade points 806 may be determined in a similar manner.

The surface of blade 804 may be configured such that the axial coordinates of the surface of blade 804 are substantially similar to the calculated axial coordinates of blade points 806. Accordingly, the surface of blade 804 at the trailing edge 816 may be configured according to cutting zone 802 of cutting element 800. The surface of blade 804 at leading edge 822 and at any other intermediate cross sections between trailing edge 816 and leading edge 822 may be similarly designed. In some embodiments, the three-dimensional surface of blade 804 may be configured based on the calculated axial, radial, and angular coordinates of blade points 806 using methods described above with respect to DOCC 612 in FIG. 6C. For example, the surface of blade 804 may be designed using curve fitting technologies applied to the determined axial coordinates of blade points 806.

Figure 9:
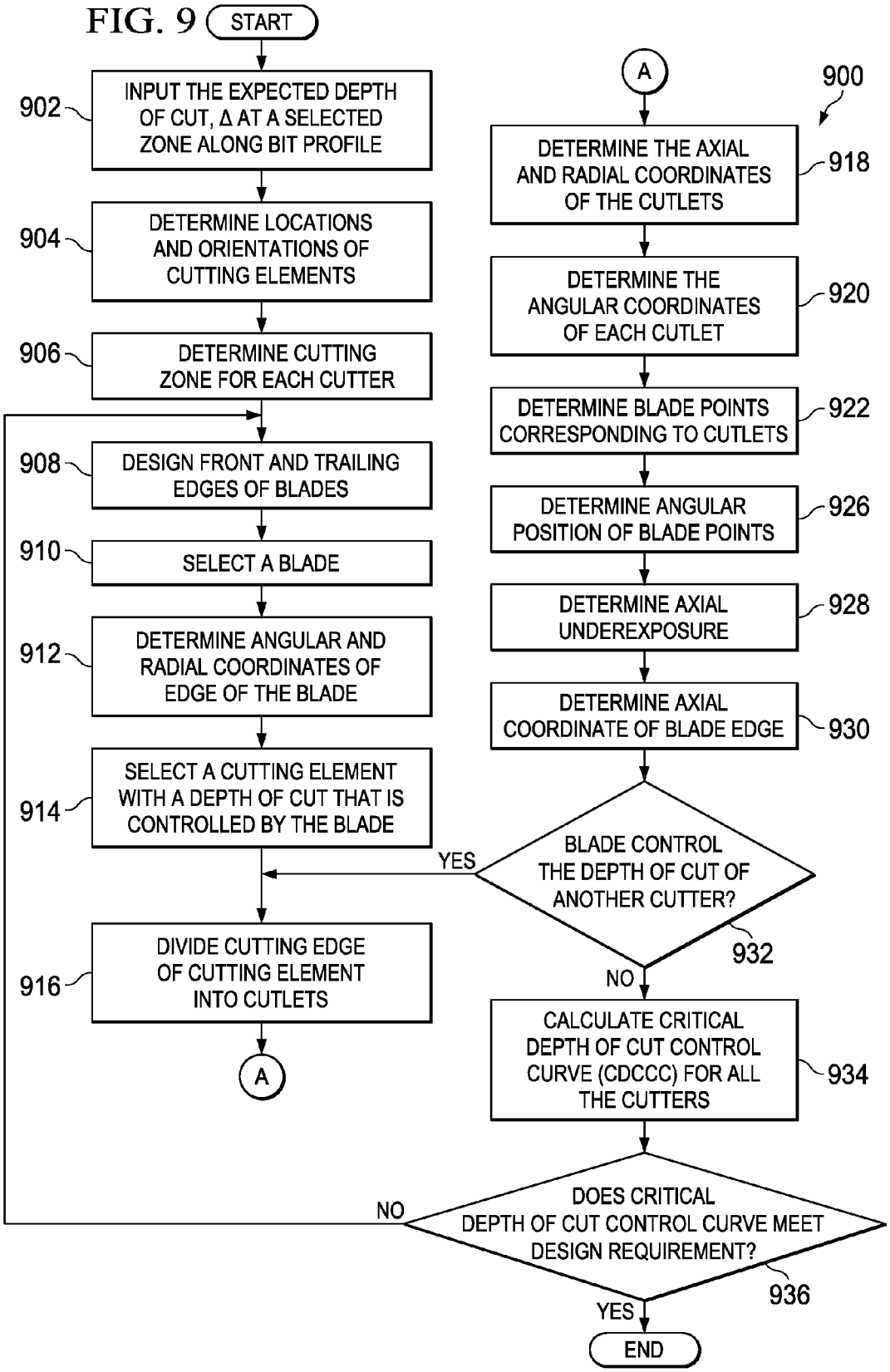
FIG. 9 illustrates a flow chart of an example method for designing blade surfaces according to the cutting zones of one or more cutting elements, in accordance with some embodiments of the present disclosure.

FIG. 9 illustrates a flow chart of an example method 900 for designing blade surfaces according to the cutting zones of one or more cutting elements. In the illustrated embodiment the cutting structures of the bit including at least the locations and orientations of all cutting elements may have been previously designed. However in other embodiments, method 900 may include steps for designing the cutting structure of the drill bit. Similar to method 700, method 900 may be performed by any suitable engineering tool as described above.

Method 900 may start, and at step 902, the engineering tool may determine a desired critical depth of cut control, $\Delta$, at a selected zone along a bit profile in a substantially similar manner as described with respect to step 702 of method 700. At step 904, the locations and orientations of cutting elements within the selected zone may be determined in a substantially similar manner as described with respect to step 704 of method 700. Additionally, step 906 may be substantially similar to step 706 of method 700 where the engineering tool may create a 3D cutter/rock interaction model that may determine the cutting zone and cutting edge associated with each cutting element. At step 908, an initial 3D depiction of the front and trailing edges of the blades and blade surfaces may also be designed using the engineering tool.

At step 910, one of the blades that may control the depth of cut of a cutting element may be selected, and at step 912, the angular and radial coordinates of the trailing edge of the blade may be determined using the engineering tool. At step 914, using the engineering tool, a cutting element with a depth of cut that may be controlled by the trailing edge of the blade may be determined and selected.

At step 916, using the engineering tool, the cutting edge of the cutting element that may be controlled by the trailing edge of the blade may be divided into cutlets in a similar manner as described with respect to step 708 of method 700. At step 918, the axial and radial coordinates for each cutlet may be calculated with respect to the bit face profile. At step 920, the angular coordinate in a plane substantially perpendicular to the rotational axis of the drill bit (e.g., the xy plane of FIG. 8B) may be calculated.

At step 922, blade points on the trailing edge of the blade having the same radial coordinates as the cutlets may be determined and selected. At step 926, the angular coordinate of each blade point may be determined.

At step 928, the axial underexposure for each blade point such that the blade may provide a constant depth of cut control for the cutting element may be determined. The axial underexposure may be based on the angular coordinate of the blade point and the angular coordinate of the cutlet having the same radial coordinate as the blade point. The axial underexposure may be calculated in a manner substantially similar to the calculation of the axial underexposure described above with respect to FIGS. 6-8.

At step 930, axial coordinates of each blade point may be calculated based on the axial coordinate of each respective cutlet having the same radial coordinate as each respective blade point and based on the calculated axial underexposure of each blade point. In some instances, the curvature of the surface of the blade may be configured to approximate the axial curvature of the cross-sectional line. Therefore, the trailing edge of the blade may be designed to control the depth of cut of a cutting element according to the location of the cutting zone and cutting edge of the cutting element. In some instances, steps 916 through 930 may be repeated for the leading edge of the blade or any other cross-sectional areas of the blade that are associated with the radial swath of the cutting zone of the cutting element such that the surface of the blade within the radial path of the cutting zone may be configured according to the location of the cutting zone of the cutting element. For example, the surface of blade 804 at leading edge 822 may be configured in a similar manner as trailing edge 816, as described above.

At step 932, it may be determined if there is another cutting element with a depth of cut that may be controlled by the selected blade. If there is another cutting element that may be controlled by the blade, the portion of the surface of the blade corresponding with the cutting zone of the other cutting element may be configured according to steps 916-930. If it is determined that the blade does not control the depth of cut of any more cutting elements, method 900 may proceed from step 932 to step 934.

At step 934, it may be determined if the surfaces of all of the blades have been configured to provide a depth of cut control for cutting elements with depths of cut that may be affected by the blades, if all of the blades have not been configured, method 900 may repeat steps 912-932 with respect to a blade that has not been configured. If all of the blades have been configured, method 900 may proceed to step 936.

At step 936, a critical depth of cut control curve for the blades (CDCCC) may be calculated. At step 938, it may be determined whether or not the CDCCC indicates that the depth of cut control substantially meets design requirements and specifications. The calculation of the CDCCC is described further below with respect to FIGS. 20A-20C and FIG. 21. If the CDCCC indicates that the depth of cut control does not meet the design requirements, method 900 may return to step 908, where various changes may be made to the design of the blade surface. If the depth of cut control does meet design requirements, method 900 may end.

Additionally, method 900 may be repeated for configuring one or more blade surfaces to control the depth of cut of cutting elements located within another zone along the bit profile by inputting another expected depth of cut, Δ, at step 902. Therefore, one or more blade surfaces may be configured for the drill bit within one or more zones along the bit profile of a drill bit according to the locations of the cutting edges of the cutting elements to improve the depth of cut control of the drill bit.

Modifications, additions or omissions may be made to method 900 and FIGS. 8A and 8B without departing from the scope of the present disclosure. For example, the order of the steps of method 900 may be changed. Additionally, each step may be performed with respect to each blade or each edge of a blade before moving on to the next step, every step may be performed with respect to one blade or edge of one blade and then repeated, or any combination thereof. Further, the steps of method 900 may be executed simultaneously, or broken into more steps than those described. Additionally, more steps may be added or steps may be removed without departing from the scope of the disclosure.

As mentioned above, methods 700 and 900 (and the associated FIGS. 6-9) are described with respect to an instance where the cutting zone of a cutting element may not overlap with the cutting zone of another cutting element. As previously described, such an instance may occur when the number of blades is small, the number of cutters is small and the depth of cut is also small. Such an instance may also occur with respect to cutting elements within the cone zone of fixed cutter bits because the number of blades within the cone is usually small. Further, methods 700 and 900 (and the associated FIGS. 6-9) may be used when a DOCC (or blade surface configured to control the depth of cut) is located immediately behind a cutting element and the radial length of the DOCC (or blade surface configured to control the depth of cut of the cutting element) is fully within the cutting zone of the cutting element.

However, in other instances, the radial swath associated with a DOCC or blade may intersect a plurality of cutting zones associated with a plurality of cutting elements. Therefore, the DOCC and/or the blade may affect the depth of cut of more than one cutting element, and not merely a single cutting element that may be located closest to the DOCC or portion of the blade configured to act as a DOCC. Therefore, in some embodiments of the present disclosure, a DOCC and/or blade of a drill bit may be configured to control the depth of cut of a drill bit based on the cutting zones of a plurality of cutting elements.

Figure 10A:
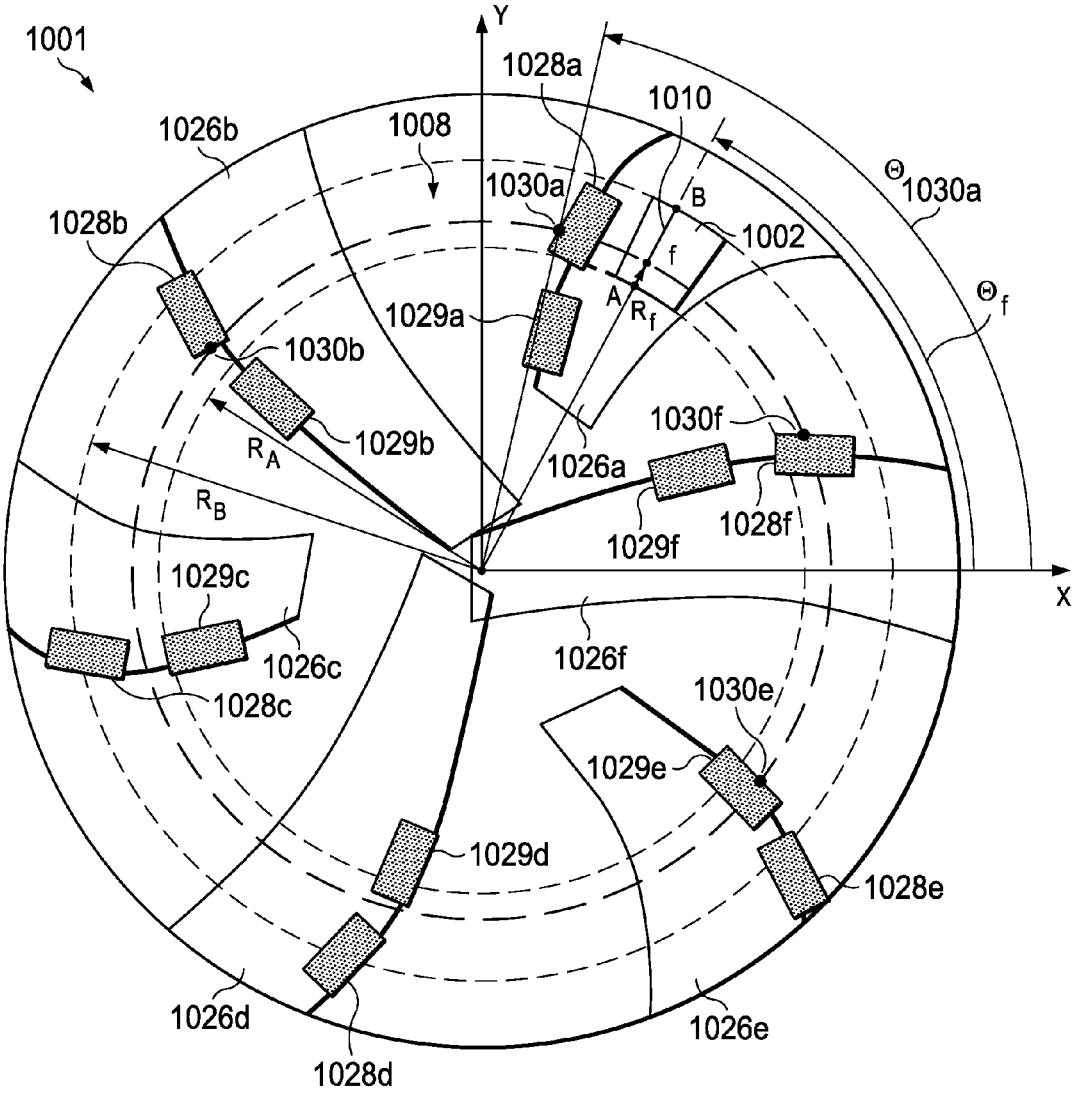
FIG. 10A illustrates the face of a drill bit with a DOCC configured in accordance with some embodiments of the present disclosure.
Figure 10B:
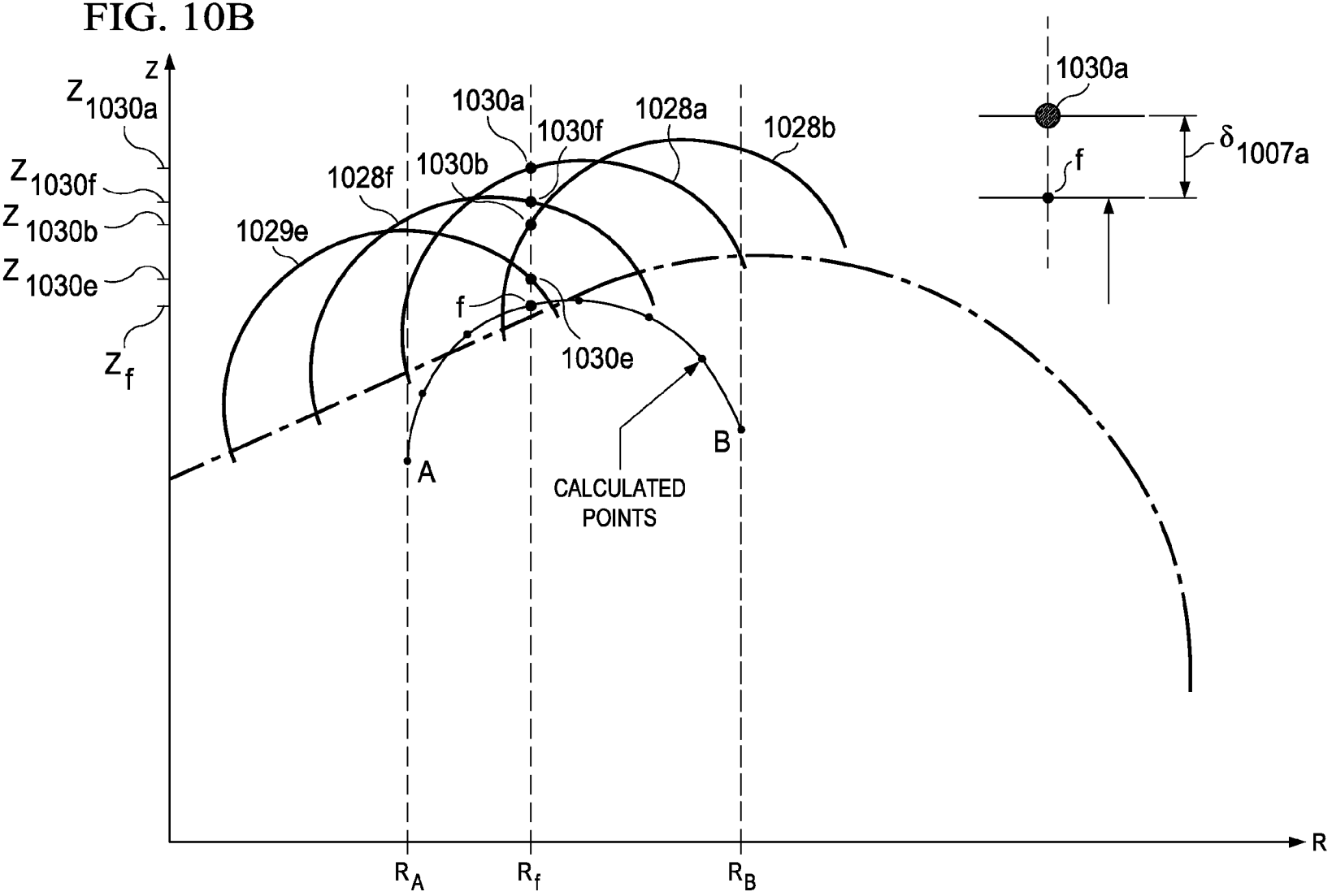
FIG. 10B, illustrates a graph of a bit face profile of the bit face illustrated in FIG. 10A, in accordance with some embodiments of the present disclosure.
Figure 10C:
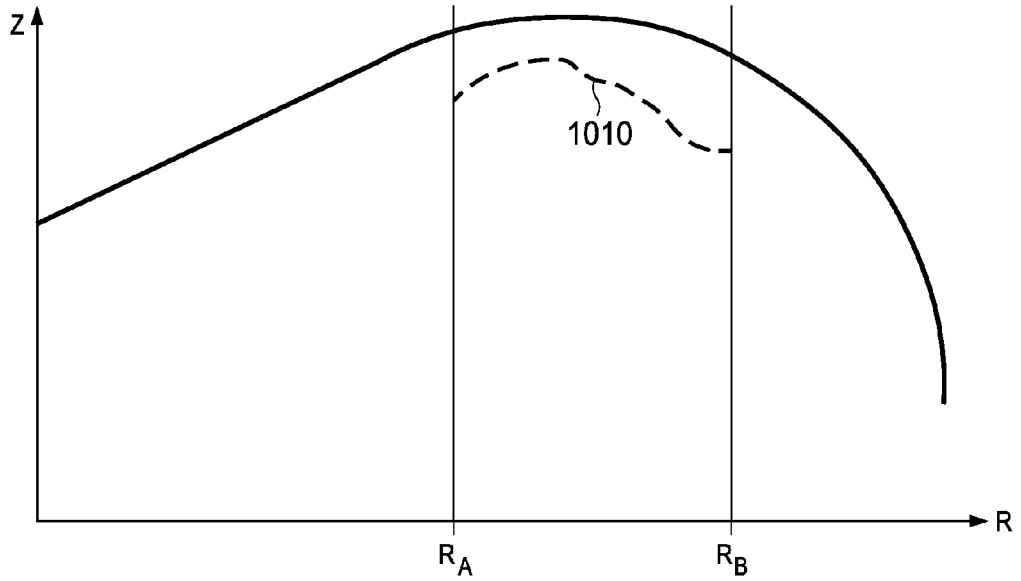
FIG. 10C illustrates an example of the axial coordinates and curvature of a cross-sectional line configured such that a DOCC may control the depth of cut of a drill bit to a desired depth of cut, in accordance with some embodiments of the present disclosure.

FIGS. 10A-10C illustrate a DOCC 1002 configured to control the depth of cut of cutting elements 1028 and 1029 located within a swath 1008 of drill bit 1001. FIG. 10A illustrates the face of drill bit 1001 that may include blades 1026, outer cutting elements 1028 and inner cutting elements 1029 disposed on blades 1026. In the illustrated embodiment, DOCC 1002 is located on a blade 1026*a* and configured to control the depth of cut of all cutting elements 1028 and 1029 located within swath 1008 of drill bit 1001.

A desired critical depth of cut $\Delta_1$ per revolution (shown in FIG. 10D) may be determined for the cutting elements 1028 and 1029 within radial swath 1008 of drill bit 1001. Radial swath 1008 may be located between a first radial coordinate $R_A$ and a second radial coordinate $R_B$. $R_A$ and $R_B$ may be determined based on the available sizes that may be used for DOCC 1002. For example, if an MDR is used as DOCC 1002, then the width of radial swath 1008 (e.g., $R_B-R_A$) may be equal to the diameter of the MDR. As another example, if an impact arrestor is selected as DOCC 1002, then the width of radial swath 1008 may be equal to the width of the impact arrestor. $R_A$ and $R_B$ may also be determined based on the dull conditions of previous bit runs. In some instances radial swath 1008 may substantially include the entire bit face such that $R_A$ is approximately equal to zero and $R_B$ is approximately equal to the radius of drill bit 1008.

Once radial swath 1008 is determined, the angular location of DOCC 1002 within radial swath 1008 may be determined. In the illustrated embodiment where only one DOCC 1002 is depicted, DOCC 1002 may be placed on any blade (e.g., blade 1026*a*) based on the available space on that blade for placing DOCC 1002. In alternative embodiments, if more than one DOCC is used to provide a depth of cut control for cutting elements 1028 and 1029 located within swath 1008 (e.g., all cutting elements 1028 and 1029 located within the swath 1008), the angular coordinates of the DOCCs may be determined based on a "rotationally symmetric rule" in order to reduce frictional imbalance forces. For example, if two DOCCs are used, then one DOCC may be placed on blade 1026*a* and another DOCC may be placed on blade 1026*d*. If three DOCCs are used, then a first DOCC may be placed on blade 1026*a*, a second DOCC may be placed on blade 1026*c* and a third DOCC may be placed on blade 1026*e*. The determination of angular locations of DOCCs is described below with respect to various embodiments.

Returning to FIG. 10A, once the radial and the angular locations of DOCC 1002 are determined, the x and y coordinates of any point on DOCC 1002 may also be determined. For example, the surface of DOCC 1002 in the xy plane of FIG. 10A may be meshed into small grids. The surface of DOCC 1002 in the xy plane of FIG. 10A may also be represented by several cross sectional lines. For simplicity, each cross sectional line may be selected to pass through the bit axis or the origin of the coordinate system. Each cross sectional line may be further divided into several points. With the location on blade 1026*a* for DOCC 1002 selected, the x and y coordinates of any point on any cross sectional line associated with DOCC 1002 may be easily determined and the next step may be to calculate the axial coordinates, z, of any point on a cross sectional line.

In the illustrated embodiment, DOCC 1002 may be placed on blade 1026*a* and configured to have a width that corresponds to radial swath 1008. Additionally, a cross sectional line 1010 associated with DOCC 1002 may be selected, and in the illustrated embodiment may be represented by a line "AB." In some embodiments, cross-sectional line 1010 may be selected such that all points along cross-sectional line 1010 have the same angular coordinates. The inner end "A" of cross-sectional line 1010 may have a distance from the center of bit 1001 in the xy plane indicated by radial coordinate $R_A$ and the outer end "B" of cross-sectional line 1010 may have a distance from the center of drill bit 1001 indicated by radial coordinate $R_B$, such that the radial position of cross-sectional line 1010 may be defined by $R_A$ and $R_B$. Cross-sectional line 1010 may be divided into a series of points between inner end "A" and outer end "B" and the axial coordinates of each point may be determined based on the radial intersection of each point with one or more cutting edges of cutting elements 1028 and 1029, as described in detail below. In the illustrated embodiment, the determination of the axial coordinate of a control point "f" along cross-sectional line 1010 is described. However, it is understood that the same procedure may be applied to determine the axial coordinates of other points along cross-sectional line 1010 and also to determine the axial coordinates of other points of other cross-sectional lines that may be associated with DOCC 1002.

The axial coordinate of control point "f" may be determined based on the radial and angular coordinates of control point "f" in the xy plane. For example, the radial coordinate of control point "f" may be the distance of control point "f" from the center of drill bit 1001 as indicated by radial coordinate $R_f$. Once $R_f$ is determined, intersection points 1030 associated with the cutting edges of one or more cutting elements 1028 and/or 1029 having radial coordinate $R_f$ may be determined. Accordingly, intersection points 1030 of the cutting elements may have the same rotational path as control point "f" and, thus, may have a depth of cut that may be affected by control point "f" of DOCC 1002. In the illustrated embodiment, the rotational path of control point "f" may intersect the cutting edge of cutting element 1028*a* at intersection point 1030*a*, the cutting edge of cutting element 1028*b* at intersection point 1030*b*, the cutting edge of cutting element 1029*e* at intersection point 1030*e* and the cutting edge of cutting element 1028*f* at intersection point 1030*f*.

The axial coordinate of control point "f" may be determined according to a desired underexposure ($\delta_{1007i}$) of control point "f" with respect to each intersection point 1030. FIG. 10B depicts the desired underexposure $\delta_{1007i}$ of control point "f" with respect to each intersection point 1030. The desired underexposure $\delta_{1007i}$ of control point "f" with respect to each intersection point 1030 may be determined based on the desired critical depth of cut $\Delta_1$ and the angular coordinates of control point "f" ($\theta_f$) and each point 1030 ($\theta_{1030i}$). For example, the desired underexposure of control point "f" with respect to intersection point 1030*a* may be expressed by the following equation:

$$\delta_{1007a}=\Delta_1*(360-(\theta_f-\theta_{1030a}))/360$$

In the above equation, $\theta_f$ and $\theta_{1030a}$ may be expressed in degrees, and "360" may represent one full revolution of approximately 360 degrees. Accordingly, in instances where $\theta_f$ and $\theta_{1030a}$ may be expressed in radians, "360" may be replaced by "2π." Further, in the above equation, the resultant angle of "$(\theta_f-\theta_{1030a})$" ($\Delta_\theta$) may be defined as always being positive. Therefore, if resultant angle $\Delta_\theta$ is negative, then $\Delta_\theta$ may be made positive by adding 360 degrees (or 2π radians) to $\Delta_\theta$. The desired underexposure of control point "f" with respect to points 1030*b*, 1030*e* and 1030*f*, ($\delta_{1007b}$, $\delta_{1007e}$, $\delta_{1007f}$, respectively) may be similarly determined.

Once the desired underexposure of control point "f" with respect to each intersection point is determined ($\delta_{1007i}$), the axial coordinate of control point "f" may be determined. The axial coordinate of control point "f" may be determined based on the difference between the axial coordinates of each intersection point 1030 and the desired underexposure with respect to each intersection point 1030. For example, in FIG. 10B, the axial location of each point 1030 may correspond to a coordinate on the z-axis, and may be expressed as a z-coordinate ($Z_{1030i}$). To determine the corresponding z-coordinate of control point "f" ($Z_f$), a difference between the z-coordinate $Z_{1030i}$ and the corresponding desired underexposure $\delta_{1007i}$ for each intersection point 1030 may be determined. The maximum value of the differences between $Z_{1030i}$ and $\delta_{1007i}$ may be the axial or z-coordinate of control point "f" ($Z_f$). For the current example, $Z_f$ may be expressed by the following equation:

$$Z_f=\max[(Z_{1030a}-\delta_{1007a}),(Z_{1030b}-\delta_{1007b}),(Z_{1030e}-\delta_{1007e}),(Z_{1030f}-\epsilon_{1007f})]$$

Accordingly, the axial coordinate of control point "f" may be determined based on the cutting edges of cutting elements 1028*a*, 1028*b*, 1029*e* and 1028*f*. The axial coordinates of other points (not expressly shown) along cross-sectional line 1010 may be similarly determined to determine the axial curvature and coordinates of cross-sectional line 1010. FIG. 10C illustrates an example of the axial coordinates and curvature of cross-sectional line 1010 such that DOCC 1002 may control the depth of cut of drill bit 1001 to the desired depth of cut $\Delta_1$ within the radial swath defined by $R_A$ and $R_B$.

The above mentioned process may be repeated to determine the axial coordinates and curvature of other cross-sectional lines associated with DOCC 1002 such that DOCC 1002 may be designed according to the coordinates of the cross-sectional lines. At least one cross sectional line may be used to design a three dimensional surface of DOCC 1002. Additionally, in some embodiments, a cross sectional line may be selected such that all the points on the cross sectional line have the same angular coordinate. Accordingly, DOCC 1002 may provide depth of cut control to substantially obtain the desired depth of cut $\Delta_1$ within the radial swath defined by $R_A$ and $R_B$.

To more easily manufacture DOCC 1002, in some instances, the axial coordinates of cross-sectional line 1010 and any other cross-sectional lines may be smoothed by curve fitting technologies. For example, if DOCC 1002 is designed as an MDR based on calculated cross sectional line 1010, then cross sectional line 1010 may be fit by one or more circular lines. Each of the circular lines may have a center and a radius that are used to design the MDR. As another example, if DOCC 1002 is designed as an impact arrestor, a plurality of cross-sectional lines 1010 may be used. Each of the cross-sectional lines may be fit by one or more circular lines. Two fitted cross-sectional lines may form the two ends of the impact arrestor similar to that shown in FIG. 6C.

Figure 10D:
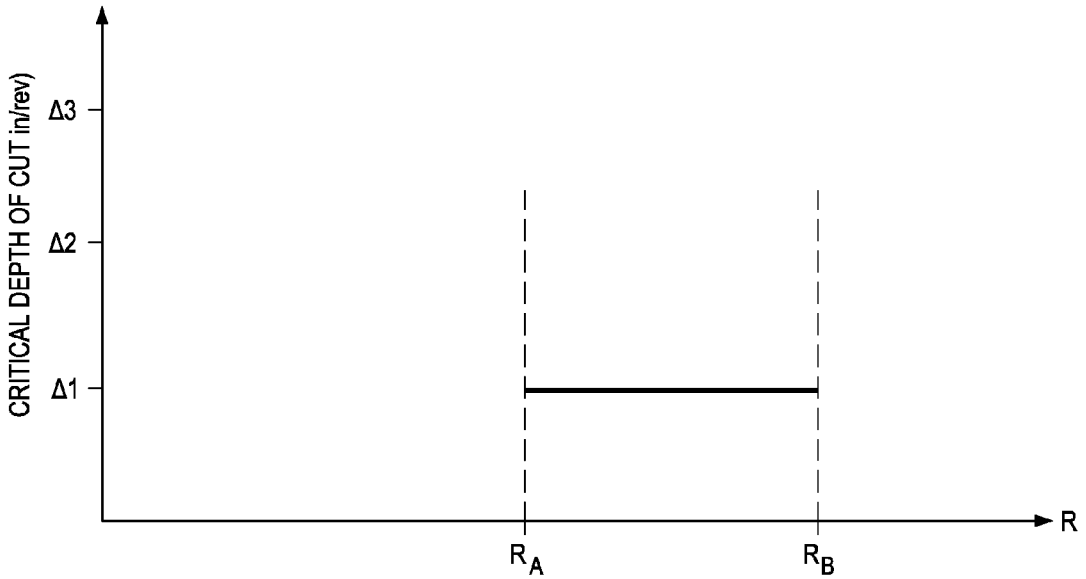
FIG. 10D illustrates a critical depth of cut control curve of the drill bit of FIGS. 10A-10C, in accordance with some embodiments of the present disclosure.

FIG. 10D illustrates a critical depth of cut control curve (described in further detail below) of drill bit 1001. The critical depth of cut control curve indicates that the critical depth of cut of radial swath 1008 between radial coordinates $R_A$ and $R_B$ may be substantially even and constant. Therefore, FIG. 10D indicates that the desired depth of cut ($\Delta_1$) of drill bit 1001, as controlled by DOCC 1002, may be substantially constant by taking in account all the cutting elements with depths of cut that may be affected by DOCC 1002 and design DOCC 1002 accordingly.

Modifications, additions, or omissions may be made to FIGS. 10A-10D without departing from the scope of the present disclosure. For example, although DOCC 1002 is depicted as having a particular shape, DOCC 1002 may have any appropriate shape. Additionally, it is understood that any number of cross-sectional lines and points along the cross-sectional lines may be selected to determine a desired axial curvature of DOCC 1002. Further, as disclosed below with respect to FIGS. 12-15, although only one DOCC 1002 is depicted on drill bit 1001, drill bit 1001 may include any number of DOCCs configured to control the depth of cut of the cutting elements associated with any number of radial swaths of drill bit 1001. Further, the desired depth of cut of drill bit 1001 may vary according to the radial coordinate (distance from the center of drill bit 1001 in the radial plane).

Figure 11A:
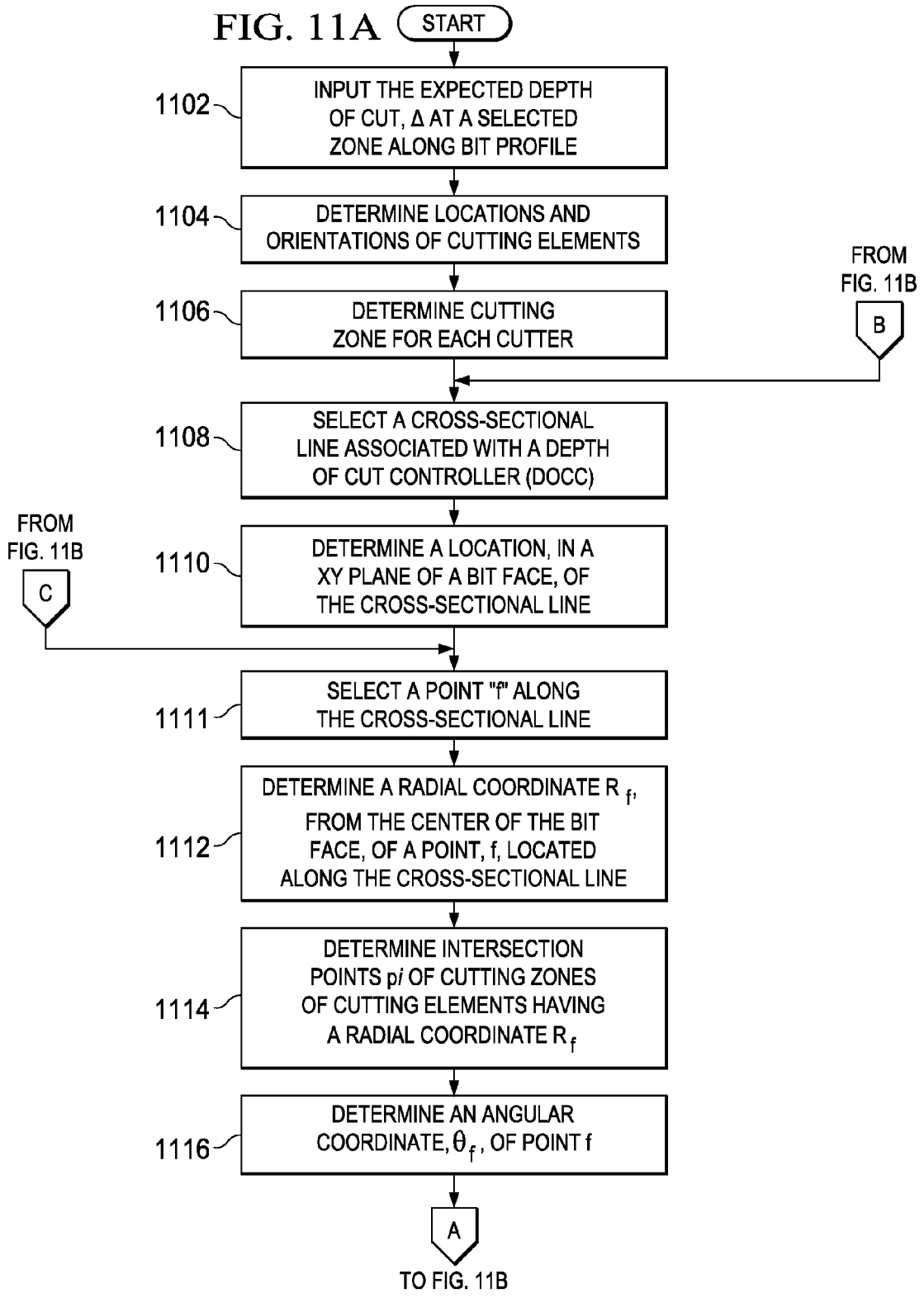
FIGS. 11A and 11B illustrate a flow chart of an example method for configuring a DOCC, in accordance with some embodiments of the present disclosure.
Figure 11B:
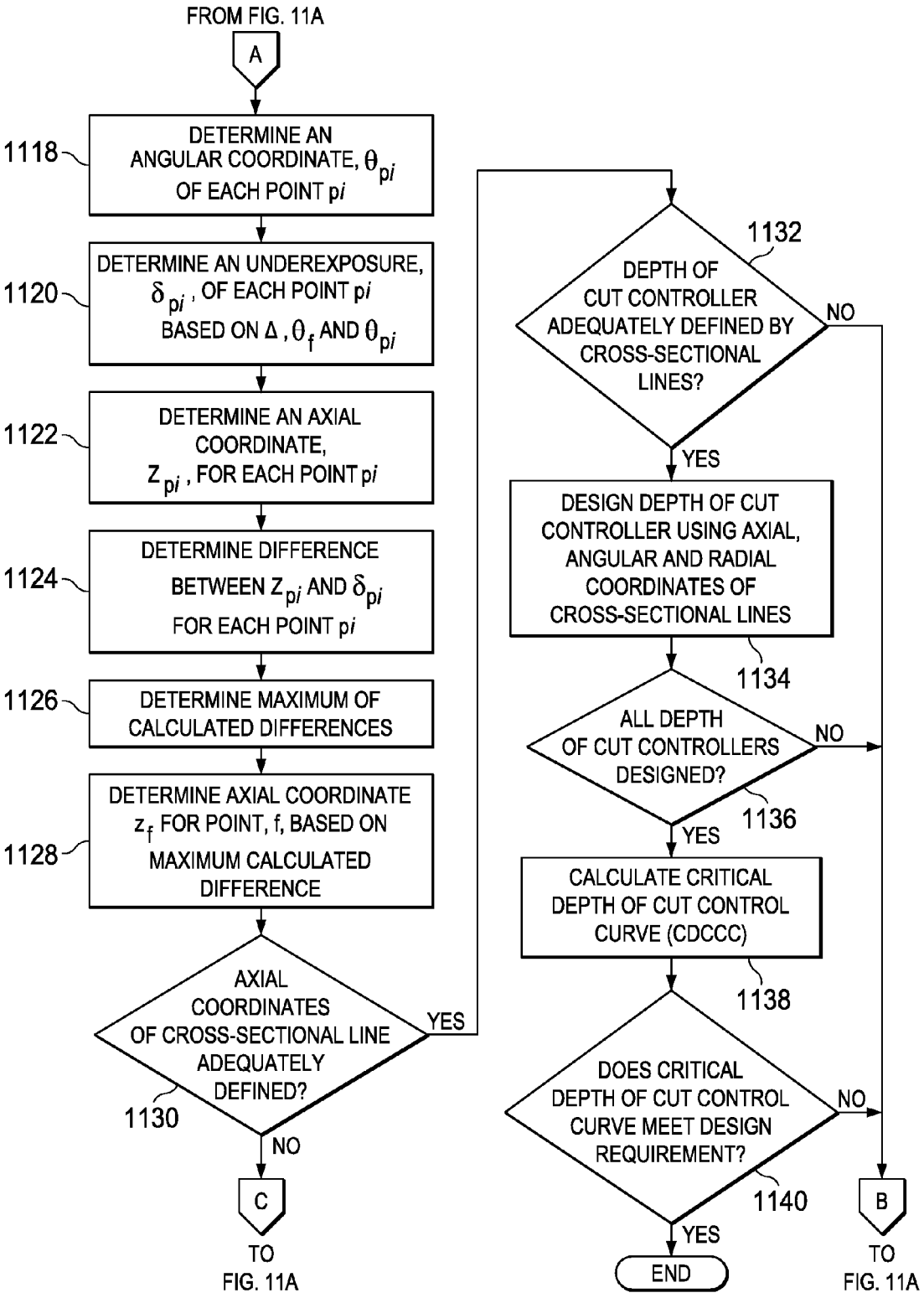

FIGS. 11A and 11B illustrate a flow chart of an example method 1100 for designing a DOCC (e.g., DOCC 1002 of FIGS. 10A-10B) according to the cutting zones of one or more cutting elements with depths of cut that may be affected by the DOCC. The steps of method 1100 may be performed by an engineering tool. In the illustrated embodiment the cutting structures of the bit including at least the locations and orientations of all cutting elements may have been previously designed. However in other embodiments, method 1100 may include steps for designing the cutting structure of the drill bit.

Method 1100 may start, and at step 1102, the engineering tool may determine a desired critical depth of cut control ($\Delta$) at a selected zone (e.g., cone zone, nose zone, shoulder zone, gage zone, etc.) along a bit profile. The zone may be associated with a radial swath of the drill bit. At step 1104, the locations and orientations of cutting elements located within the swath may be determined. Additionally, at step 1106 the engineering tool may create a 3D cutter/rock interaction model that may determine the cutting zone and the cutting edge for each cutting element.

At step 1108, the engineering tool may select a cross-sectional line (e.g., cross-sectional line 1010) that may be associated with a DOCC that may be configured to control the depth of cut of a radial swath (e.g., radial swath 1008 of FIGS. 10A-10B) of the drill bit. At step 1110, the location of the cross-sectional line in a plane perpendicular to the rotational axis of the drill bit (e.g., the xy plane of FIG. 10) may be determined. The location of the cross-sectional line may be selected such that the cross-sectional line intersects the radial swath and is located on a blade (e.g., cross-sectional line 1010 intersects radial swath 1008 and is located on blade 1026*a* in FIG. 10A).

At step 1111, a control point "f" along the cross-sectional line may be selected. Control point "f" may be any point that is located along the cross-sectional line and that may be located within the radial swath. At step 1112, the radial coordinate $R_f$ of control point "f" may be determined. $R_f$ may indicate the distance of control point "f" from the center of the drill bit in the radial plane. Intersection points pi of the cutting edges of one or more cutting elements having radial coordinate $R_f$ may be determined at step 1114. At step 1116, an angular coordinate of control point "f" ($\theta_f$) may be determined and at step 1118 an angular coordinate of each intersection point pi ($\theta_{pi}$) may be determined.

The engineering tool may determine a desired underexposure of each point pi ($\delta_{pi}$) with respect to control point "f" at step 1120. As explained above with respect to FIG. 10, the underexposure $\delta_{pi}$ of each intersection point pi may be determined based on a desired critical depth of cut $\Delta$ of the drill bit in the rotational path of point "f." The underexposure $\delta_{pi}$ for each intersection point pi may also be based on the relationship of angular coordinate $\theta_f$ with respect to the respective angular coordinate $\theta_{pi}$.

At step 1122, an axial coordinate for each intersection point pi ($Z_{pi}$) may be determined and a difference between $Z_{pi}$ and the respective underexposure $\delta_{pi}$ may be determined at step 1124, similar to that described above in FIG. 10 (e.g., $Z_{pi}-\delta_{pi}$). In one embodiment, the engineering tool may determine a maximum of the difference between $Z_{pi}$ and $\delta_{pi}$ calculated for each intersection point pi at step 1126. At step 1128, the axial coordinate of control point "f" ($Z_f$) may be determined based on the maximum calculated difference, similar to that described above in FIG. 10.

At step 1130, the engineering tool may determine whether the axial coordinates of enough control points of the cross-sectional line (e.g., control point "f") have been determined to adequately define the axial coordinate of the cross-sectional line. If the axial coordinates of more control points are needed, method 1100 may return to step 1111 where the engineering tool may select another control point along the cross-sectional line, otherwise, method 1100 may proceed to step 1132. The number of control points along a cross sectional line may be determined by a desired distance between two neighbor control points, (dr), and the length of the cross sectional line, (Lc). For example, if Lc is 1 inch, and dr is 0.1," then the number of control points may be Lc/dr+1=11. In some embodiments, dr may be between 0.01" to 0.2".

If the axial coordinates of enough cross-sectional lines have been determined, the engineering tool may proceed to step 1132, otherwise, the engineering tool may return to step 1111. At step 1132, the engineering tool may determine whether the axial, radial and angular coordinates of a sufficient number of cross-sectional lines have been determined for the DOCC to adequately define the DOCC. The number of cross-sectional lines may be determined by the size and the shape of a DOCC. For example, if a hemispherical component (e.g., an MDR) is selected as a DOCC, then only one cross sectional line may be used. If an impact arrestor (semi-cylinder like) is selected, then a plurality of cross-sectional lines may be used. If a sufficient number have been determined, method 1100 may proceed to step 1134, otherwise method 1100 may return to step 1108 to select another cross-sectional line associated with the DOCC.

At step 1134, the engineering tool may use the axial, angular and radial coordinates of the cross-sectional lines to configure the DOCC such that the DOCC has substantially the same axial, angular and radial coordinates as the cross-sectional lines. In some instances, the three dimensional surface of the DOCC that may correspond to the axial curvature of the cross-sectional lines may be designed by smoothing the axial coordinates of the surface using a two dimensional interpolation method such as the MATLAB® function called interp2.

At step 1136, the engineering tool may determine whether all of the desired DOCCs for the drill bit have been designed. If no, method 1100 may return to step 1108 to select a cross-sectional line for another DOCC that is to be designed; if yes, method 1100 may proceed to step 1138, where the engineering tool may calculate a critical depth of cut control curve CDCCC for the drill bit, as explained in more detail below.

The engineering tool may determine whether the CDCCC indicates that the drill bit meets the design requirements at step 1140. If no, method 1100 may return to step 1108 and various changes may be made to the design of one or more DOCCs of the drill bit. For example, the number of control points "f" may be increased, the number of cross-sectional lines for a DOCC may be increased, or any combination thereof. The angular locations of cross sectional lines may also be changed. Additionally, more DOCCs may be added to improve the CDCCC. If the CDCCC indicates that the drill bit meets the design requirements, method 1100 may end. Consequently, method 1100 may be used to design and configure a DOCC according to the cutting edges of all cutting elements within a radial swath of a drill bit such that the drill bit may have a substantially constant depth of cut as controlled by the DOCC.

Method 1100 may be repeated for designing and configuring another DOCC within the same radial swath at the same expected depth of cut beginning at step 1108. Method 1100 may also be repeated for designing and configuring another DOCC within another radial swath of a drill bit by inputting another expected depth of cut, Δ, at step 1102. Modifications, additions, or omissions may be made to method 1100 without departing from the scope of the present disclosure. For example, each step may include additional steps. Additionally, the order of the steps as described may be changed. For example, although the steps have been described in sequential order, it is understood that one or more steps may be performed at the same time.

As mentioned above, a DOCC may be configured to control the depth of cut of a plurality of cutting elements within a certain radial swath of a drill bit (e.g., rotational paths 508 and 1008 of FIGS. 5 and 10 respectively). Additionally, as mentioned above, a drill bit may include more than one DOCC that may be configured to control the depth of cut of the same cutting elements within the radial swath of the drill bit, to control the depth of cut of a plurality of cutting elements located within different radial swaths of the drill bit, or any combination thereof. Multiple DOCCs may also be used to reduce imbalance forces when DOCCs are in contact with formation. FIGS. 12-14 illustrate example configurations of drill bits including multiple DOCCs.

Figure 12A:
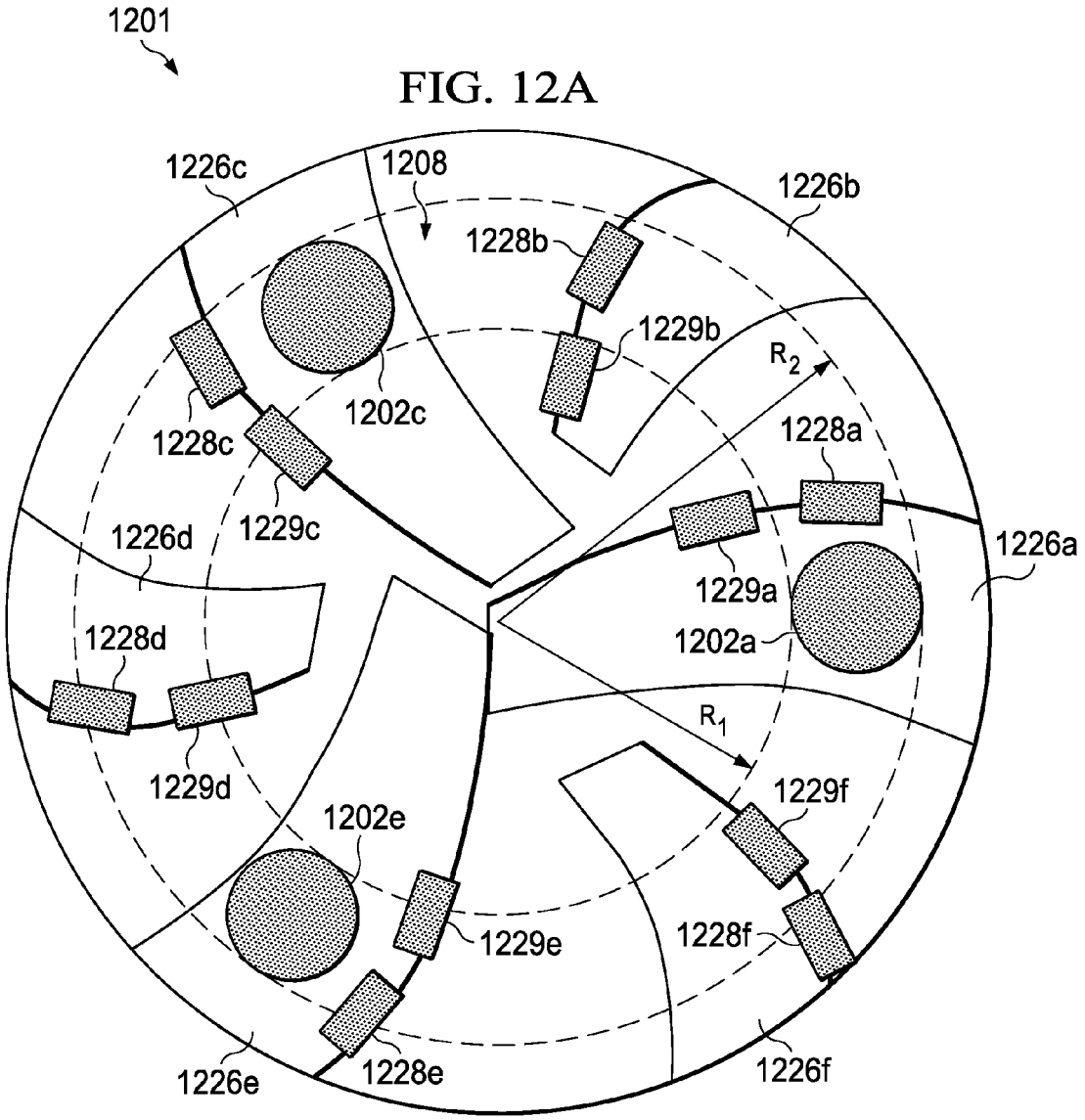
FIG. 12A illustrates a drill bit that includes a plurality of DOCCs configured to control the depth of cut of a drill bit, in accordance with some embodiments of the present disclosure.
Figure 12B:
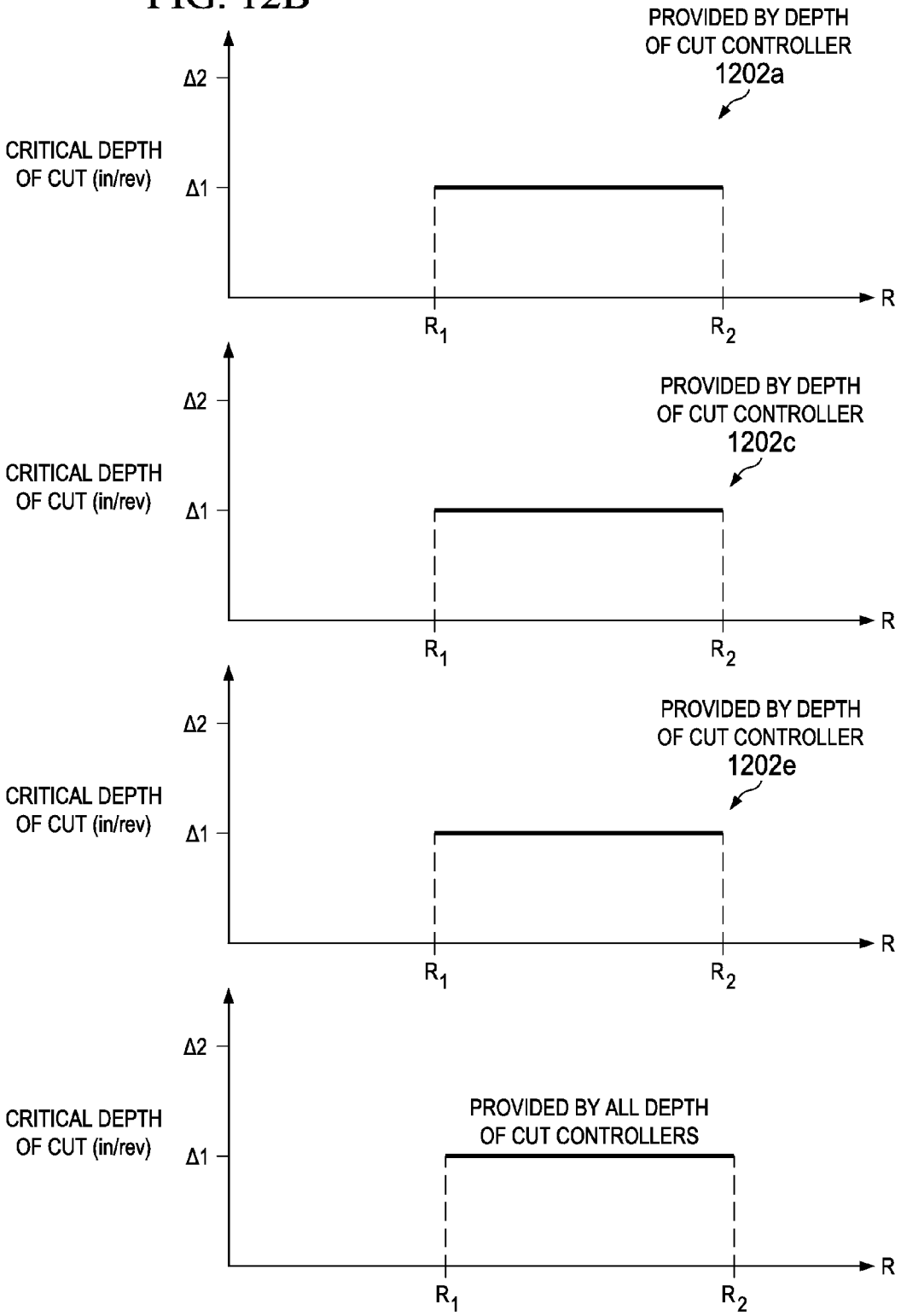
FIG. 12B illustrates a critical depth of cut control curve of the drill bit of FIG. 12A, in accordance with some embodiments of the present disclosure.

FIG. 12A illustrates the bit face of a drill bit 1201 that includes DOCCs 1202*a*, 1202*c* and 1202*e* configured to control the depth of cut of drill bit 1201. In the illustrated embodiment, DOCCs 1202 may each be configured such that drill bit 1201 has a critical depth of cut of $\Delta_1$ within a radial swath 1208, as shown in FIG. 12B. Radial swath 1208 may be defined as being located between a first radial coordinate $R_1$ and a second radial coordinate $R_2$. Each DOCC 1202 may be configured based on the cutting edges of cutting elements 1228 and 1229 that may intersect with radial swath 1208, similarly to as disclosed above with respect to DOCC 1002 of FIGS. 10A-10D.

FIG. 12B illustrates a critical depth of cut control curve (described in further detail below) of drill bit 1201. The critical depth of cut control curve indicates that the critical depth of cut of radial swath 1208 between radial coordinates $R_1$ and $R_2$ may be substantially even and constant. Therefore, FIG. 12B indicates that DOCCs 1202 may be configured to provide a substantially constant depth of cut control for drill bit 1201 at radial swath 1208.

Additionally, DOCCs 1202 may be disposed on blades 1226 such that the lateral forces created by DOCCs 1202 may be substantially balanced as drill bit 1201 drills at or over critical depth of cut $\Delta_1$. In the illustrated embodiment, DOCC 1202*a* may be disposed on a blade 1226*a*, DOCC 1202*c* may be disposed on a blade 1226*c* and DOCC 1202*e* may be disposed on a blade 1226*e*. DOCCs 1202 may be placed on the respective blades 1226 such that DOCCs 1202 are spaced approximately 120 degrees apart to more evenly balance the lateral forces created by DOCCs 1202 of drill bit 1201. Therefore, DOCCs 1202 may be configured to provide a substantially constant depth of cut control for drill bit 1201 at radial swath 1208 and that may improve the force balance conditions of drill bit 1201.

Modifications, additions or omissions may be made to FIG. 12 without departing from the scope of the present disclosure. For example, although DOCCs 1202 are depicted as being substantially rounded, DOCCs 1202 may be configured to have any suitable shape depending on the design constraints and considerations of DOCCs 1202. Additionally, although each DOCC 1202 is configured to control the depth of cut of drill bit 1208 at radial swath 1208, each DOCC 1202 may be configured to control the depth of cut of drill bit 1208 at different radial swaths, as described below with respect to DOCCs 1302 in FIGS. 13A-13E.

Figure 13A:
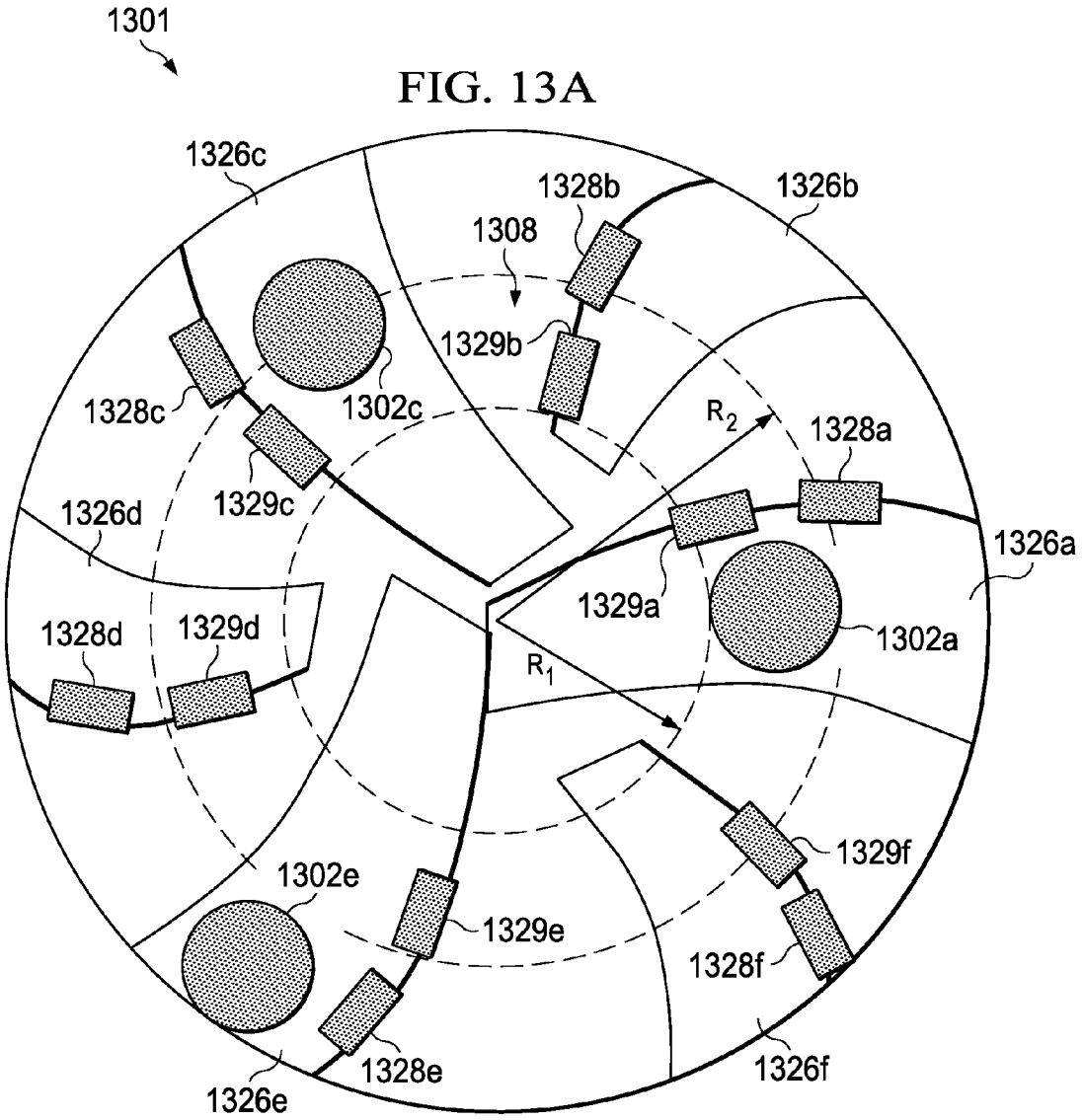
FIG. 13A illustrates another example of a drill bit that includes a plurality of DOCCs configured to control the depth of cut of the drill bit, in accordance with some embodiments of the present disclosure.
Figure 13B:
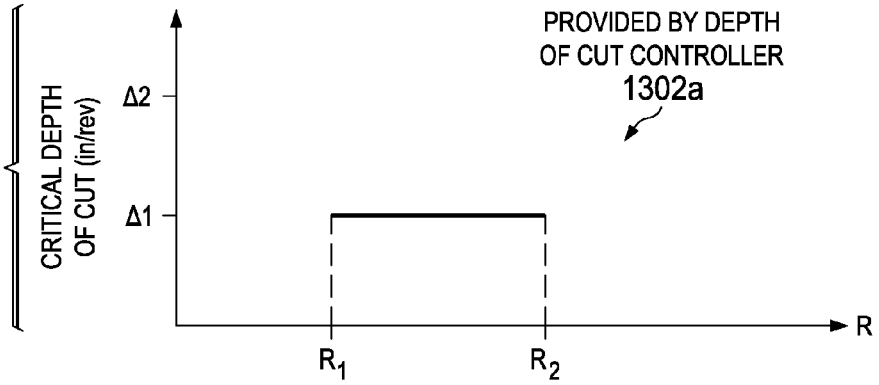
FIGS. 13B-13E illustrate critical depth of cut control curves of the drill bit of FIG. 13A, in accordance with some embodiments of the present disclosure.
Figure 13C:
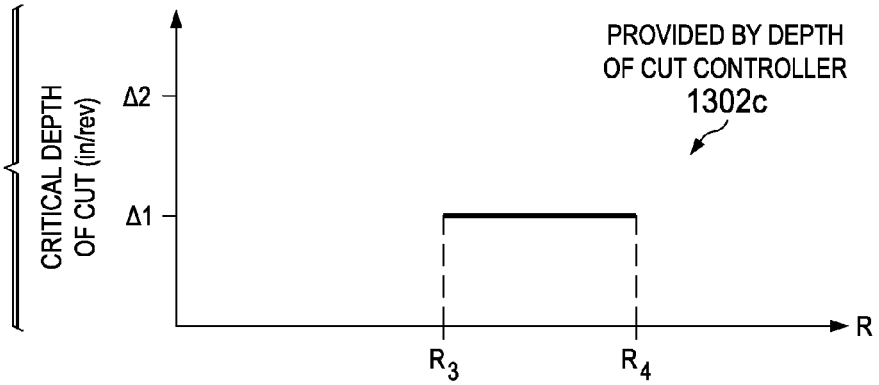
Figure 13D:
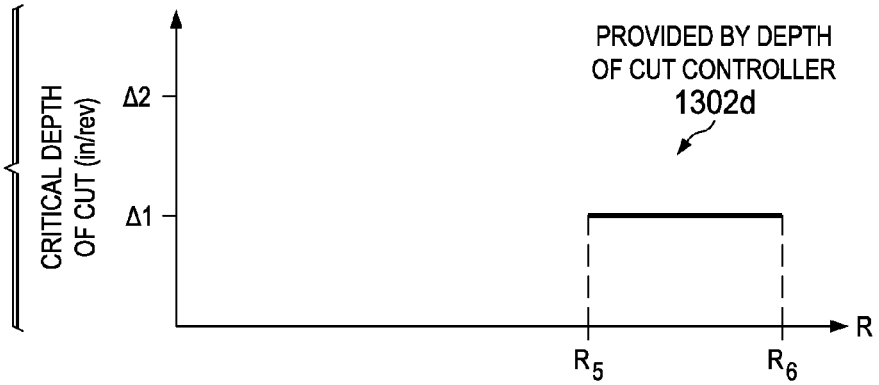

FIG. 13A illustrates the bit face of a drill bit 1301 that includes DOCCs 1302*a*, 1302*c* and 1302*e* configured to control the depth of cut of drill bit 1301. In the illustrated embodiment, DOCC 1302*a* may be configured such that drill bit 1301 has a critical depth of cut of $\Delta_1$ within a radial swath 1308 defined as being located between a first radial coordinate $R_1$ and a second radial coordinate $R_2$, as shown in FIGS. 13A and 13B. In the illustrated embodiment, the inner and outer edges of DOCC 1302*a* may be associated with radial coordinates $R_1$ and $R_2$ respectively, as shown in FIG. 13A. DOCC 1302*c* may be configured such that drill bit 1301 has a critical depth of cut of $\Delta_1$ within a radial swath (not expressly shown in FIG. 13A) defined as being located between a third radial coordinate $R_3$ and a fourth radial coordinate $R_4$ (not expressly shown in FIG. 13A), illustrated in FIG. 13C. In the illustrated embodiment, the inner and outer edges of DOCC 1302*b* may be associated with radial coordinates $R_3$ and $R_4$ respectively. Additionally, DOCC 1302*e* may be configured such that drill bit 1301 has a critical depth of cut of $\Delta_1$ within a radial swath (not expressly shown in FIG. 13A) defined as being located between a fifth radial coordinate $R_5$ and a sixth radial coordinate $R_6$ (not expressly shown in FIG. 13A), illustrated in FIG. 13D. In the illustrated embodiment, the inner and outer edges of DOCC 1302*e* may be associated with radial coordinates $R_5$ and $R_6$ respectively.

Figure 13E:
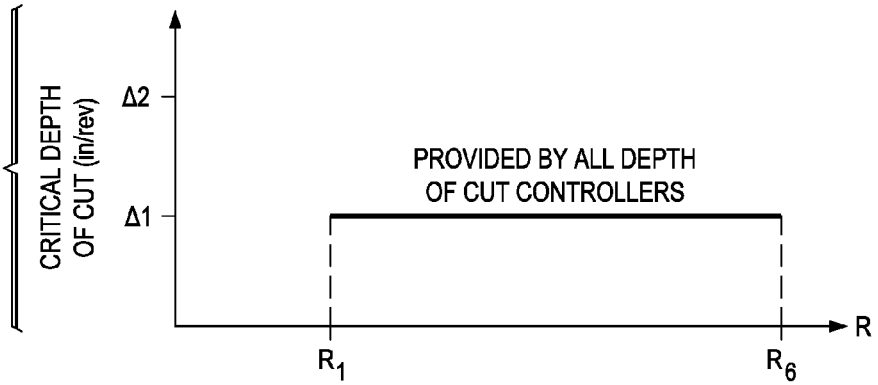

Each DOCC 1302 may be configured based on the cutting edges of cutting elements 1328 and 1329 that may intersect with the respective radial swaths associated with each DOCC 1302 as disclosed above with respect to DOCC 1002 of FIG. 10. FIGS. 13B-13E illustrate critical depth of cut control curves (described in further detail below) of drill bit 1301. The critical depth of cut control curves indicate that the critical depth of cut of the radial swaths defined by radial coordinates $R_1$, $R_2$, $R_3$, $R_4$, $R_5$ and $R_6$ may be substantially even and constant. Therefore, FIGS. 13B-13E indicate that DOCCs 1302*a*, 1302*c* and 1302*e* may provide a combined depth of cut control for a radial swath defined by radius $R_1$ and radius $R_6$, as shown in FIG. 13E.

Additionally, similar to DOCCs 1202 of FIG. 12A, DOCCs 1302 may be disposed on blades 1326 such that the lateral forces created by DOCCs 1302 may substantially be balanced as drill bit 1301 drills at or over critical depth of cut $\Delta_1$. In the illustrated embodiment, DOCC 1302*a* may be disposed on a blade 1326*a*, DOCC 1302*c* may be disposed on a blade 1326*c* and DOCC 1302*e* may be disposed on a blade 1326*e*. DOCCs 1302 may be placed on the respective blades 1326 such that DOCCs 1302 are spaced approximately 120 degrees apart to more evenly balance the lateral forces created by DOCCs 1302 of drill bit 1301. Therefore, DOCCs 1302 may be configured to provide a substantially constant depth of cut control for drill bit 1301 at a radial swath defined as being located between radial coordinate $R_1$ and radial coordinate $R_6$ and that may improve the force balance conditions of drill bit 1301.

Modifications, additions or omissions may be made to FIGS. 13A-13E without departing from the scope of the present disclosure. For example, although DOCCs 1302 are depicted as being substantially round, DOCCs 1302 may be configured to have any suitable shape depending on the design constraints and considerations of DOCCs 1302. Additionally, although drill bit 1302 includes a specific number of DOCCs 1302, drill bit 1301 may include more or fewer DOCCs 1302. For example, drill bit 1301 may include two DOCCs 1302 spaced 180 degrees apart. Additionally, drill bit 1302 may include other DOCCs configured to provide a different critical depth of cut for a different radial swath of drill bit 1301, as described below with respect to DOCCs 1402 in FIGS. 14A-14D.

Figure 14A:
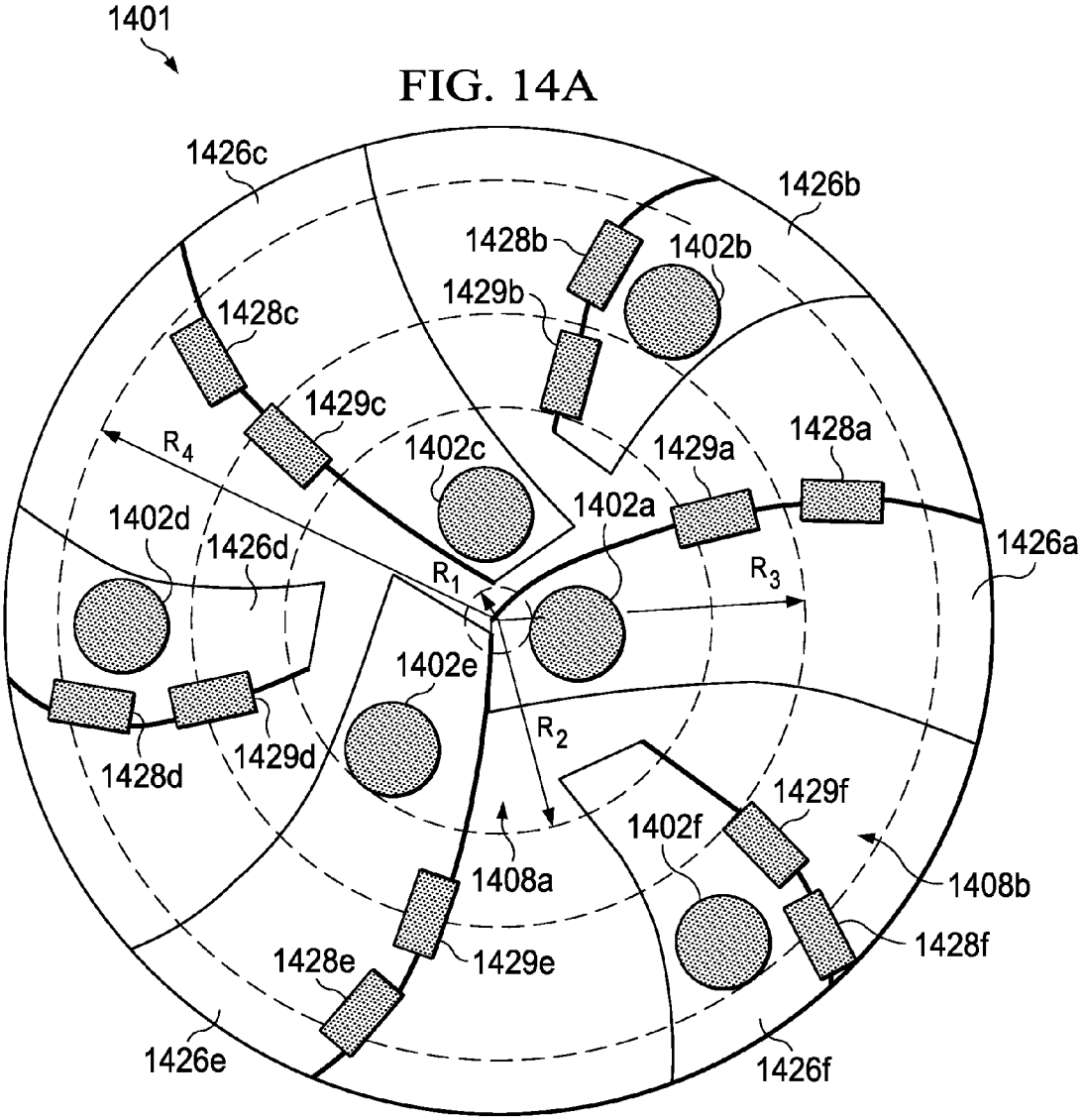
FIG. 14A illustrates another example of a drill bit that includes a plurality of DOCCs configured to control the depth of cut of the drill bit, in accordance with some embodiments of the present disclosure.
Figure 14B:
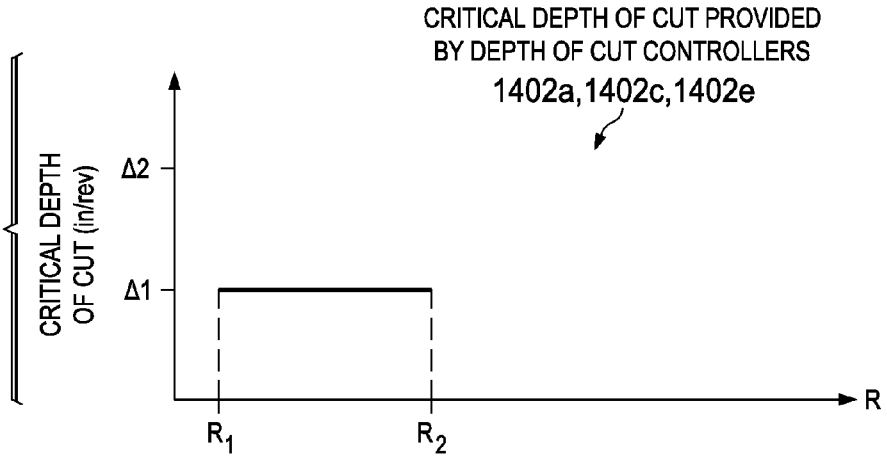
FIGS. 14B-14D illustrate critical depth of cut control curves of the drill bit of FIG. 14A, in accordance with some embodiments of the present disclosure.

FIG. 14A illustrates the bit face of a drill bit 1401 that includes DOCCs 1402*a*, 1402*b*, 1402*c*, 1402*d*, 1402*e* and 1402*f* configured to control the depth of cut of drill bit 1401. In the illustrated embodiment, DOCCs 1402*a*, 1402*c* and 1402*e* may be configured such that drill bit 1401 has a critical depth of cut of $\Delta_1$ within a radial swath 1408*a* defined as being located between a first radial coordinate $R_1$ and a second radial coordinate $R_2$, as shown in FIGS. 14A and 14B.

Figure 14C:
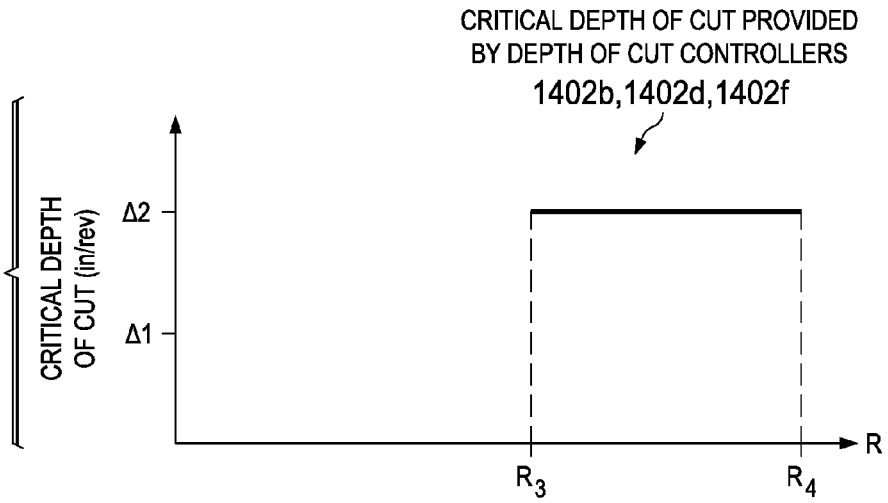
Figure 14D:
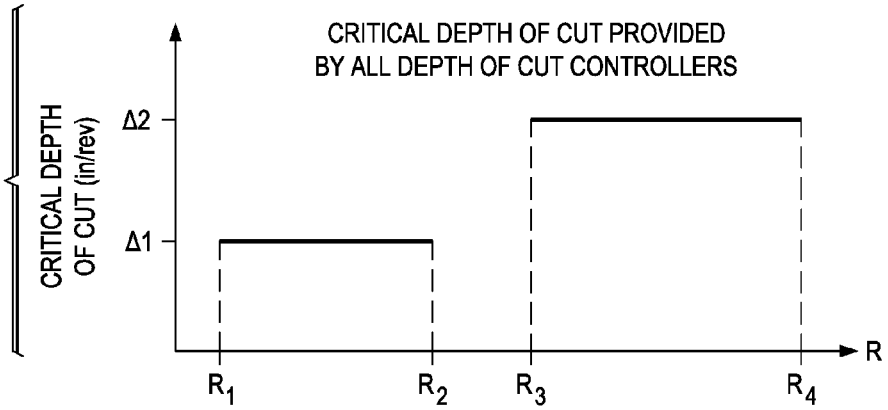

Additionally, DOCCs 1402*b*, 1402*d* and 1402*f* may be configured such that drill bit 1401 has a critical depth of cut of $\Delta_2$ within a radial swath 1408*b* defined as being located between a third radial coordinate $R_3$ and a fourth radial coordinate $R_4$ as shown in FIGS. 14A and 14C. Accordingly, DOCCs 1402 may be configured such that drill bit 1401 has a first critical depth of cut $\Delta_1$ for radial swath 1408*a* and a second critical depth of cut $\Delta_2$ for radial swath 1408*b*, as illustrated in FIGS. 14A and 14D. Each DOCC 1402 may be configured based on the cutting edges of cutting elements 1428 and 1429 that may intersect with the respective radial swaths 1408 associated with each DOCC 1402, as disclosed above. Additionally, similarly to DOCCs 1202 of FIG. 12A, and DOCCs 1302 of FIG. 13A, DOCCs 1402 may be disposed on blades 1426 such that lateral forces created by DOCCs 1402 may substantially be balanced as drill bit 1401 drills at or over critical depth of cut Δ1.

Therefore, drill bit 1401 may include DOCCs 1402 configured according to the cutting zones of cutting elements 1428 and 1429. Additionally, as illustrated by critical depth of cut control curves illustrated in FIGS. 14B-14D, DOCCs 1402*a*, 1402*c* and 1402*e* may be configured to provide a substantially constant depth of cut control for drill bit 1401 at radial swath 1408*a* based on a first desired critical depth of cut for radial swath 1408*a*. Further DOCCs 1402*b*, 1402*d* and 1402*f* may be configured to provide a substantially constant depth of cut control for drill bit 1401 at radial swath 1408*b* based on a second desired critical depth of cut for radial swath 1408*b*. Also, DOCCs 1402 may be located on blades 1426 to improve the force balance conditions of drill bit 1401.

Modifications, additions or omissions may be made to FIGS. 14A-14D without departing from the scope of the present disclosure. For example, although DOCCs 1402 are depicted as being substantially round, DOCCs 1402 may be configured to have any suitable shape depending on the design constraints and considerations of DOCCs 1402. Additionally, although drill bit 1402 includes a specific number of DOCCs 1402, drill bit 1402 may include more or fewer DOCCs 1402.

As shown above, a DOCC may be placed on one of a plurality of blades of a drill bit to provide constant depth of cut control for a particular radial swath of the drill bit. Therefore, selection of one of the plurality of blades for placement of a DOCC may be achieved. FIGS. 15A-15F illustrate a design process that may be used to select a blade for placement of the DOCC, in accordance with some embodiments of the present disclosure.

Figure 15A:
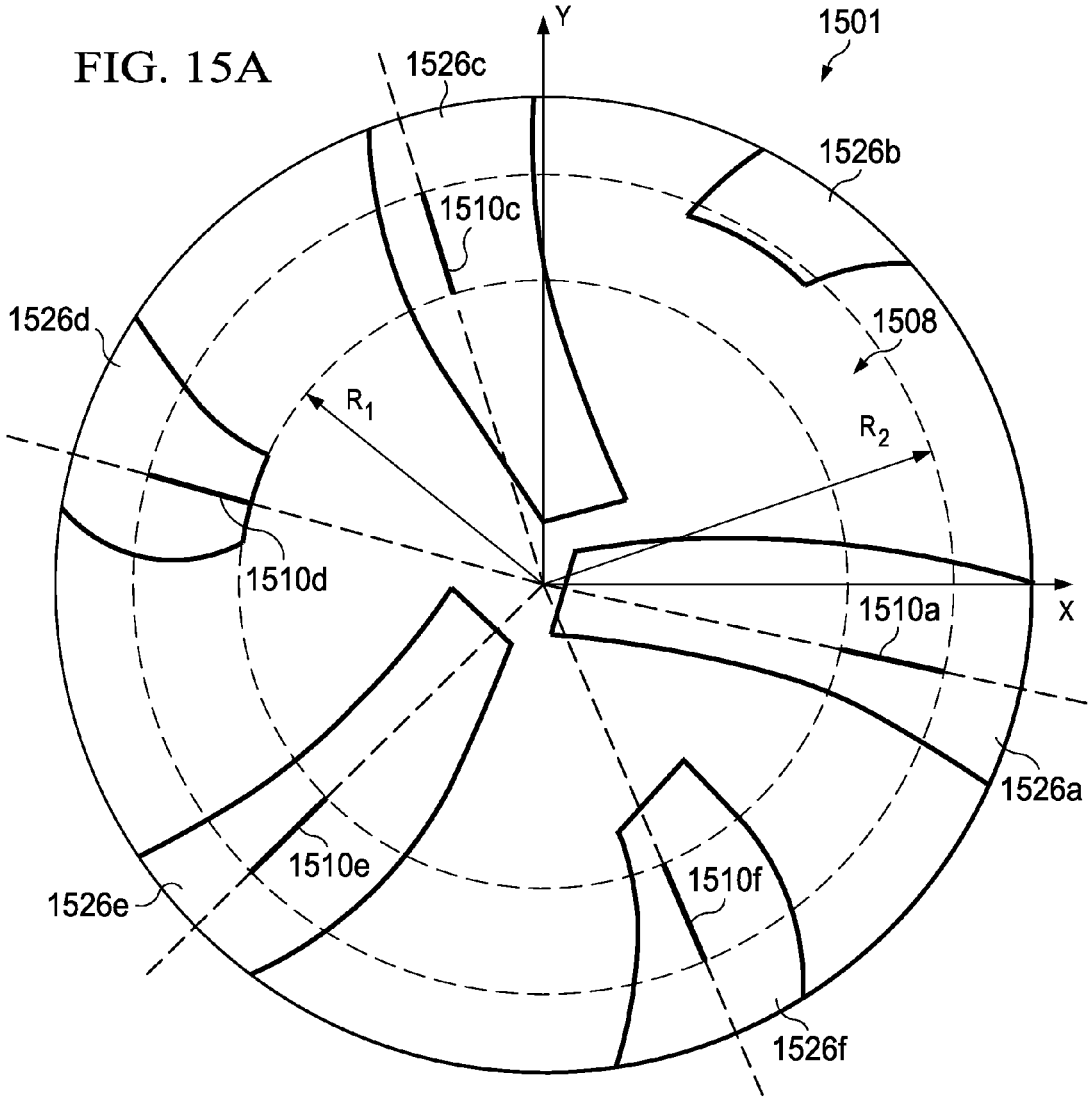
FIG. 15A illustrates a drill bit that includes a plurality of blades that may include a DOCC configured to control the depth of cut of a drill bit, in accordance with some embodiments of the present disclosure.

FIG. 15A illustrates the bit face of a drill bit 1501 that includes a plurality of blades 1526 that may include a DOCC configured to control the depth of cut of drill bit 1501 for a radial swath 1508. It can be seen that blades 1526*a*, 1526*c*, 1526*d*, 1526*e* and 1526*f* each may intersect radial swath 1508 such that a DOCC may be placed on any one of blades 1526*a*, 1526*c*, 1526*d*, 1526*e* and 1526*f* to control the depth of cut of drill bit 1501 at radial swath 1508. However, in some instances not all the blades may include a DOCC, therefore, it may be determined on which of blades 1526*a*, 1526*c*, 1526*d*, 1526*e* and 1526*f* to place a DOCC.

To determine on which of blades 1526*a*, 1526*c*, 1526*d*, 1526*e* and 1526*f* to place a DOCC, axial, radial and angular coordinates for a cross-sectional line 1510 may be determined for each of blades 1526*a*, 1526*c*, 1526*d*, 1526*e* and 1526*f*. The coordinates for each cross-sectional line 1510 may be determined based on the cutting edges of cutting elements (not expressly shown) located within radial swath 1508 and a desired critical depth of cut for radial swath 1508 similar to the determination of the coordinates of cross-sectional lines as describe with respect to FIG. 10 (e.g., determining the coordinates of cross-sectional lines 1010). For example, axial, radial and angular coordinates may be determined for cross-sectional lines 1510*a*, 1510*c*, 1510*d*, 1510*e* and 1510*f* located on blades 1526*a*, 1526*c*, 1526*d*, 1526*e* and 1526*f* respectively.

Figure 15B:
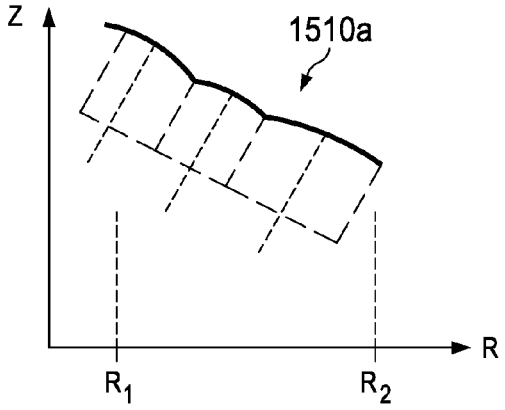
FIGS. 15B-15F illustrate example axial and radial coordinates of cross-sectional lines located between a first radial coordinate and a second radial coordinate, in accordance with some embodiments of the present disclosure.
Figure 15C:
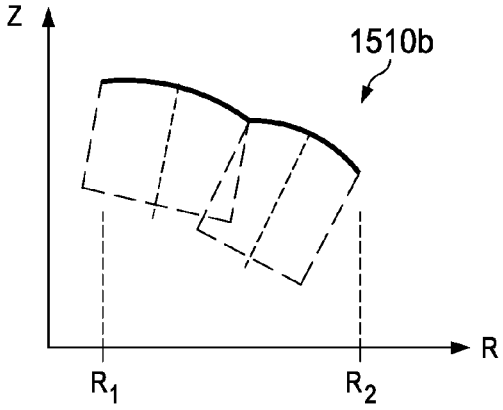
Figure 15D:
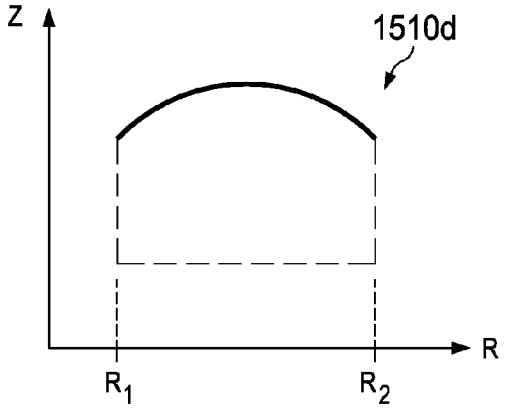
Figure 15E:
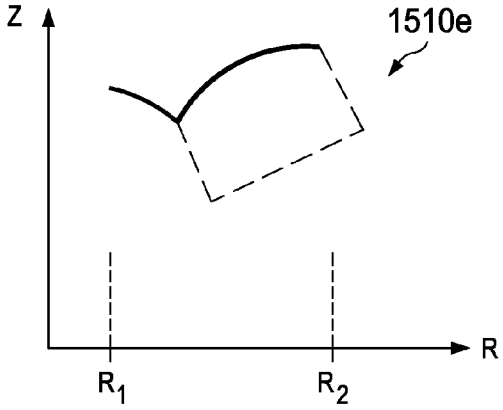
Figure 15F:
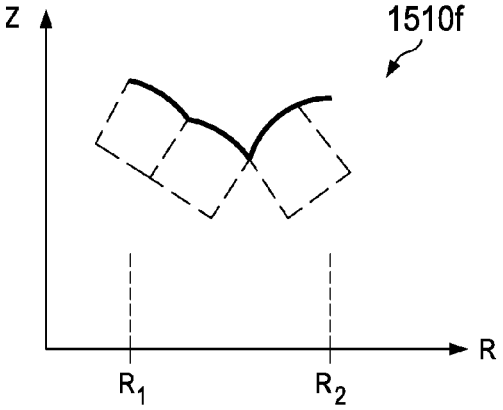

FIGS. 15B-15F illustrate example axial and radial coordinates of cross-sectional lines 1510*a*, 1510*c*, 1510*d*, 1510*e* and 1510*f*, respectively between a first radial coordinate $R_1$ and a second radial coordinate $R_2$ that define radial swath 1508. FIG. 15B illustrates that the axial curvature of cross-sectional line 1510*a* may be approximated using the curvature of three circles. Therefore a DOCC placed on blade 1526*a* may have a surface with a curvature that may be approximated with the three circular lines fit for cross-sectional line 1510*a*. Accordingly, three semi-spheres may be used to form this DOCC. FIG. 15C illustrates that the axial curvature of cross-sectional line 1510*b* may be approximated using two circles. Therefore a DOCC placed on blade 1526*b* may have a surface with a curvature that may be approximated with the two circular lines fit for cross-sectional line 1510*b*. Accordingly, two semi-spheres may be used to form this DOCC. FIG. 15D illustrates that the axial curvature of cross-sectional line 1510*d* may be approximated with one circle. Therefore a DOCC placed on blade 1526*d* may have a surface with a curvature that may be approximated with the one circular line fit for cross-sectional line 1510*d*. One semi-sphere may be used to form this DOCC. FIG. 15E illustrates that the axial curvature of cross-sectional line 1510*e* may be approximated using two circles. Therefore a DOCC placed on blade 1526*e* may have a surface with a curvature that may be approximated with the two circles fit for cross-sectional line 1510*e*. Accordingly, two semi-spheres may be used to form this DOCC. Additionally, FIG. 15F illustrates that cross-sectional line 1510*f* may be approximated using three circular lines. Therefore a DOCC placed on blade 1526*f* may have a surface with a curvature that may be approximated with the three circular lines fit for cross-sectional line 1510*f*.

As shown by FIGS. 15B-15F, in some instances, it may be advantageous to place a DOCC on blade 1526*d* because a DOCC placed on blade 1526*d* may have a simple surface that may be easier to manufacture than DOCCs placed on other blades 1526. Additionally, in some embodiments, cross-sectional line 1510*d* may be associated with a DOCC (not expressly shown in FIG. 15A) that may be placed immediately behind a cutting element also located on blade 1526*d* (not expressly shown in FIG. 15A). Further, the radial length of cross-sectional line 1510*d*, (which in the illustrated embodiment may be equal to $R_2-R_1$), may be fully located within the cutting zone of the cutting element located on blade 1526*d*. In such an instance, the DOCC associated with cross-sectional line 1526*d* may be configured based on the cutting edge of the cutting element directly in front of the DOCC using method 700 described above, which may also simplify the design of drill bit 1501.

However, if lateral imbalance force created by DOCCs is a concern, it may be desirable in other instances to place a DOCC on each of blades 1526*a*, 1526*c* and 1526*e* such that the DOCCs are approximately 120 degrees apart. Therefore, FIG. 15 illustrate how the location of a DOCC within radial swath 1508 may be determined to control the depth of cut of drill bit 1501 along radial swath 1508, depending on various design considerations.

Modifications, additions or omissions may be made to FIG. 15 without departing from the scope of the present disclosure. For example, the number of blades 1526, the size of swath 1508, the number of blades that may substantially intersect swath 1508, etc., may vary in accordance with other embodiments of the present disclosure. Additionally, the axial curvatures of cross-sectional lines 1510 may vary depending on various design constraints and configurations of drill bit 1501.

As mentioned above, the depth of cut of a drill bit may be controlled by a blade in addition to a DOCC. Therefore, a blade surface may be configured according to the present disclosure such that it may control the depth of cut of a radial swath of a drill bit based on the cutting edges of one or more cutting elements located in the radial swath.

Figure 16A:
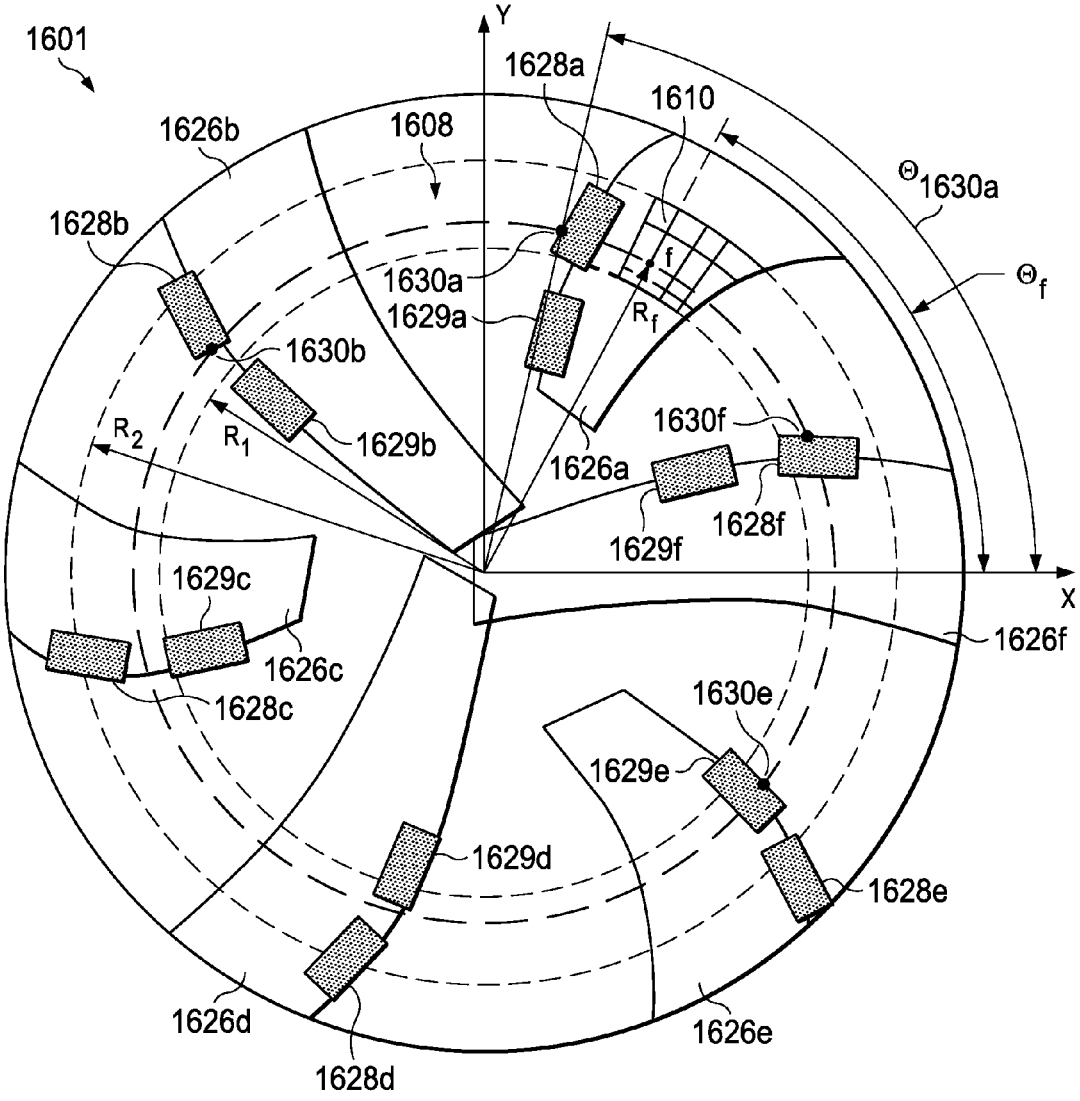
FIG. 16A illustrates the face of a drill bit with a blade configured to control the depth of cut of the drill bit, in accordance with some embodiments of the present disclosure.
Figure 16B:
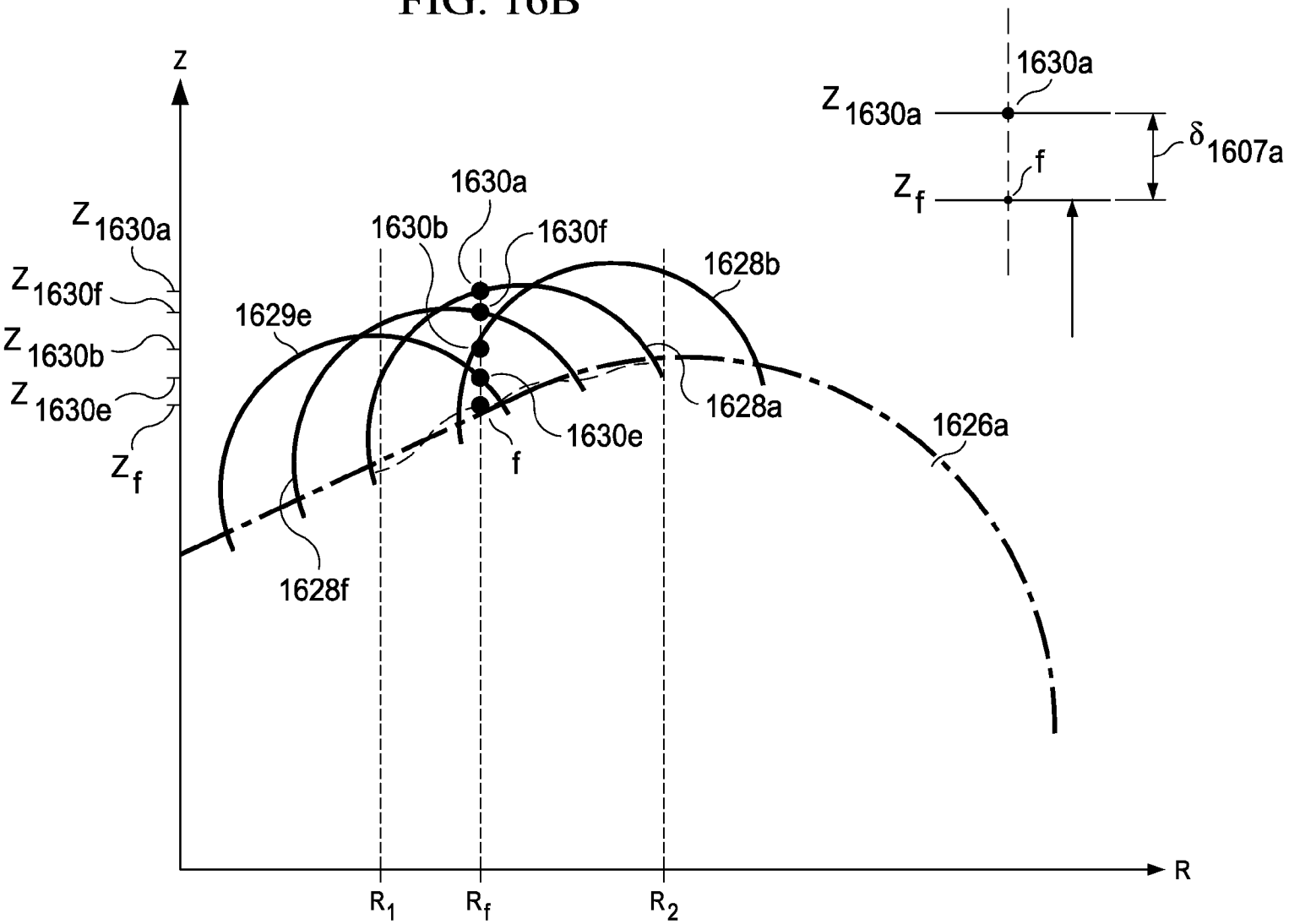
FIG. 16B, illustrates a graph of a bit face profile of the bit face illustrated in FIG. 16A, in accordance with some embodiments of the present disclosure.

FIGS. 16A and 16B illustrate a blade 1626 configured to control the depth of cut of cutting elements 1628 and 1629 of a drill bit 1601. FIG. 16A illustrates the face of drill bit 1601 that may include blades 1626, outer cutting elements 1628 and inner cutting elements 1629 disposed on blades 1626, similar to drill bit 1001 of FIG. 10A.

In the current example, a portion of blade 1626*a* may be configured to provide a desired depth of cut $\Delta_1$ (shown in FIG. 16C) for the cutting elements located within a radial swath 1608 of drill bit 1601. Radial swath 1608 may be defined between a first radial coordinate $R_1$ and a second radial coordinate $R_2$. Similar to DOCC 1002 described with respect to FIGS. 10A-10D, the axial coordinates of blade 1626*a* may be configured based on one or more cross-sectional lines 1610, which may be configured based on a desired depth of cut $\Delta_1$ of swath 1608. Additionally, the axial, radial and angular coordinates of cross-sectional line 1610 may be determined based on the cutting edges of cutting elements 1628 and/or 1629 that may be intersect radial swath 1608. The axial, radial and angular coordinates of cross-sectional line 1610 may be determined similarly to the axial, radial and angular coordinates of cross-sectional line 1010 described with respect to FIG. 10.

For example, cross-sectional line 1610 may be divided into a series of control points between an inner end and outer end of cross-sectional line 1610 (e.g., a control point "f"). The radial coordinate of control point "f" ($R_f$, depicted in FIG. 16B) may be determined. Once $R_f$ is determined, intersection points 1630 of the cutting edges of one or more cutting elements 1628 and/or 1629 having radial coordinate $R_f$ may be determined. Accordingly, intersection points 1630 of the cutting elements may have the same rotational path as control point "f" and, thus, may have a depth of cut that may be affected by the surface of blade 1626 at point "f." In the illustrated embodiment, as depicted in FIG. 16B, the rotational path of control point "f" may intersect the cutting edge of cutting element 1628*a* at intersection point 1630*a*, the cutting edge of cutting element 1628*b* at intersection point 1630*b*, the cutting edge of cutting element 1629*e* at intersection point 1630*e* and the cutting edge of cutting element 1628*f* at intersection point 1630*f*.

Similarly to that described above with respect to FIGS. 10 and 11, the axial coordinate of blade 1626*a* at control point "f" may be determined according to a desired underexposure ($\delta_{1607i}$) of control point "f" with respect to each intersection point 1630. FIG. 16B depicts the desired underexposure $\delta_{1607i}$ of control point "f" with respect to each intersection point 1630. The desired underexposure $\delta_{1607i}$ of control point "f" with respect to each intersection point 1630 may be determined substantially similarly to that described above with respect to underexposures $\delta_{607i}$, $\delta_{807i}$ and $\delta_{1007i}$, described above, and may be based on the desired critical depth of cut $\Delta_1$ and the angular location of control point "f" ($\theta_f$) and each point 1630 ($\theta_{1630i}$). For example, the desired underexposure of control point "f" with respect to intersection point 1630*a* may be expressed by the following equation:

$$\delta_{1607a}=\Delta_1*(360-(\theta_f-\theta_{1630a}))/360$$

In the above equation, $\theta_f$ and $\theta_{1630a}$ may be expressed in degrees, and "360" may represent one full revolution of approximately 360 degrees. Accordingly, in instances where $\theta_f$ and $\theta_{1630a}$ may be expressed in radians, "360" may be replaced by "2π." Further, in the above equation, the resultant angle of "$(\theta_f-\theta_{1630a})$" ($\Delta_\theta$) may be defined as always being positive. Therefore, if resultant angle $\Delta_\theta$ is negative, then $\Delta_\theta$ may be made positive by adding 360 degrees (or 2π radians) to $\Delta_\theta$. The desired underexposure of control point "f" with respect to intersection points 1630*b*, 1630*e* and 1630*f* ($\delta_{1607b}$, $\delta_{1607e}$ and $\delta_{1607f}$, respectively) may be similarly determined.

Once the desired underexposure of control point "f" with respect to each intersection point is determined, the axial coordinate of control point "f" may be determined based on the difference between the axial coordinates of each intersection point 1630 and the desired underexposure with respect to each intersection point 1630. For example, in FIG. 16B, the axial location of each point 1630 may correspond with a coordinate on the z-axis, and may be expressed as a z-coordinate $Z_{1630i}$. To determine the corresponding z-coordinate of control point "f" ($Z_f$) a difference between the z-coordinate $Z_{1630i}$ and the corresponding desired underexposure $\delta_{1607i}$ for each intersection point 1630 may be determined. The maximum value of the differences between $Z_{1630i}$ and $\delta_{1607i}$ may be the axial or z-coordinate of control point "f" ($Z_f$). For the current example, $Z_f$ in FIG. 16 may be expressed by the following equation:

$$Z_f=\max[(Z_{1630a}-\delta_{1607a}),(Z_{1630b}-\delta_{1607b}),(Z_{1630e}-\delta_{1607e}),(Z_{1630f}-\delta_{1607f})]$$

Accordingly, the axial coordinate of control point "f" may be determined based on the cutting edges of cutting elements 1628*a*, 1628*b*, 1629*e* and 1628*f*. The axial coordinates of other control points along cross-sectional line 1610 may be similarly determined to determine the axial curvature and coordinates of cross-sectional line 1610.

The above mentioned process may be repeated to determine the axial coordinates and curvature of other cross-sectional lines associated with blade 1626*a* such that blade 1626*a* may provide depth of cut control to substantially obtain the desired depth of cut $\Delta_1$ within the radial swath defined by $R_1$ and $R_2$. The surface of blade 1626*a* may be manufactured such that the axial coordinates of blade 1626*a* substantially match the determined axial coordinates of the cross-sectional lines at the same angular and radial locations. The cross-sectional lines may be used to form a three dimensional surface of the blade 1626*a*. To more easily manufacture the surface of blade 1626*a*, in some instances, the 3D surface may be smoothed using a two dimensional interpolation method such as the MATLAB® function called interp2, similarly to described above with respect to DOCC 1002 in FIG. 10.

Figure 16C:
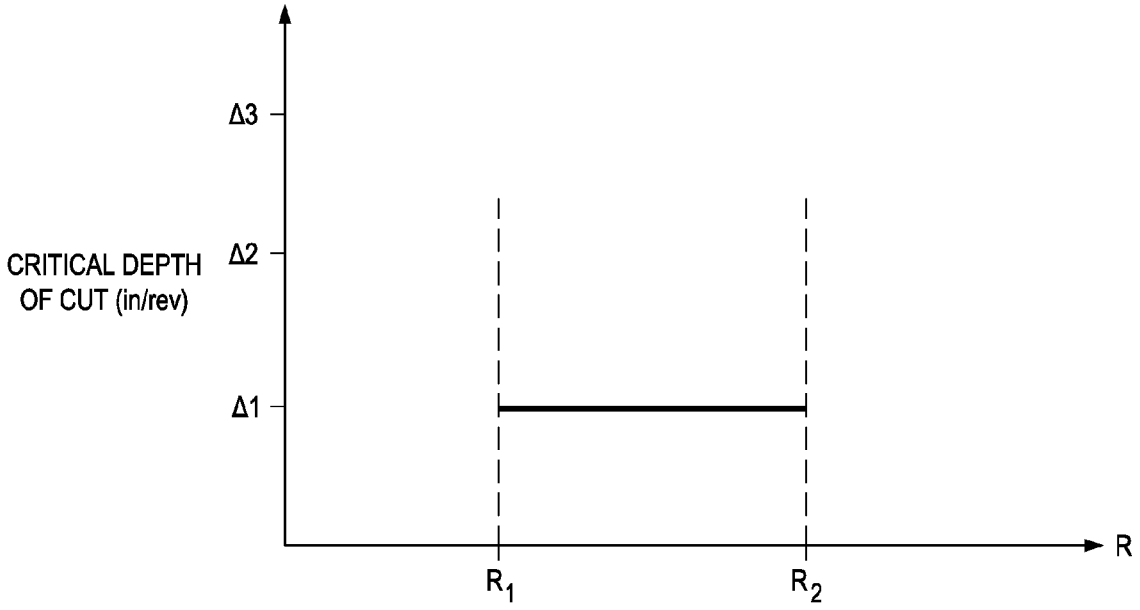
FIG. 16C illustrates a critical depth of cut control curve of the drill bit of FIGS. 16A and 16B, in accordance with some embodiments of the present disclosure.

FIG. 16C illustrates a critical depth of cut control curve (described in further detail below) of drill bit 1601. The critical depth of cut control curve indicates that the critical depth of cut of radial swath 1608 between radial coordinates $R_1$ and $R_2$ may be substantially even and constant. Therefore, FIG. 16C indicates that the desired depth of cut ($\Delta_1$) of drill bit 1601, as controlled by the surface of blade 1626*a*, may be substantially constant by taking in account all the cutting elements with depths of cut that may be affected by the surface of blade 1626*a*.

Modifications, additions, or omissions may be made to FIGS. 16A-16C without departing from the scope of the present disclosure. For example, it is understood that any number of cross-sectional lines and points along the cross-sectional lines may be determined to determine a desired axial curvature of the surface of blade 1626*a*. Further, as disclosed below with respect to FIGS. 18 and 19, although only one blade 1626 (e.g., blade 1626*a*) is depicted as controlling the depth of cut of drill bit 1601, any number of blades 1626 may be configured to control the depth of cut of any number of radial swaths of drill bit 1601. Further, the desired depth of cut of drill bit 1601 may vary according to the radial location (distance from the center of drill bit 1601 in the radial plane) along drill bit 1601. Additionally, the size of radial swath 1608 may be larger or smaller than that specifically depicted in FIGS. 16A-16C. Further, it is understood that any suitable portion of a blade 1626 may be configured to control the depth of cut of drill bit 1601. For example, in some instances the trailing edge and/or the leading edge of blade 1626 may be configured to control the depth of cut of drill bit 1601.

Figure 17A:
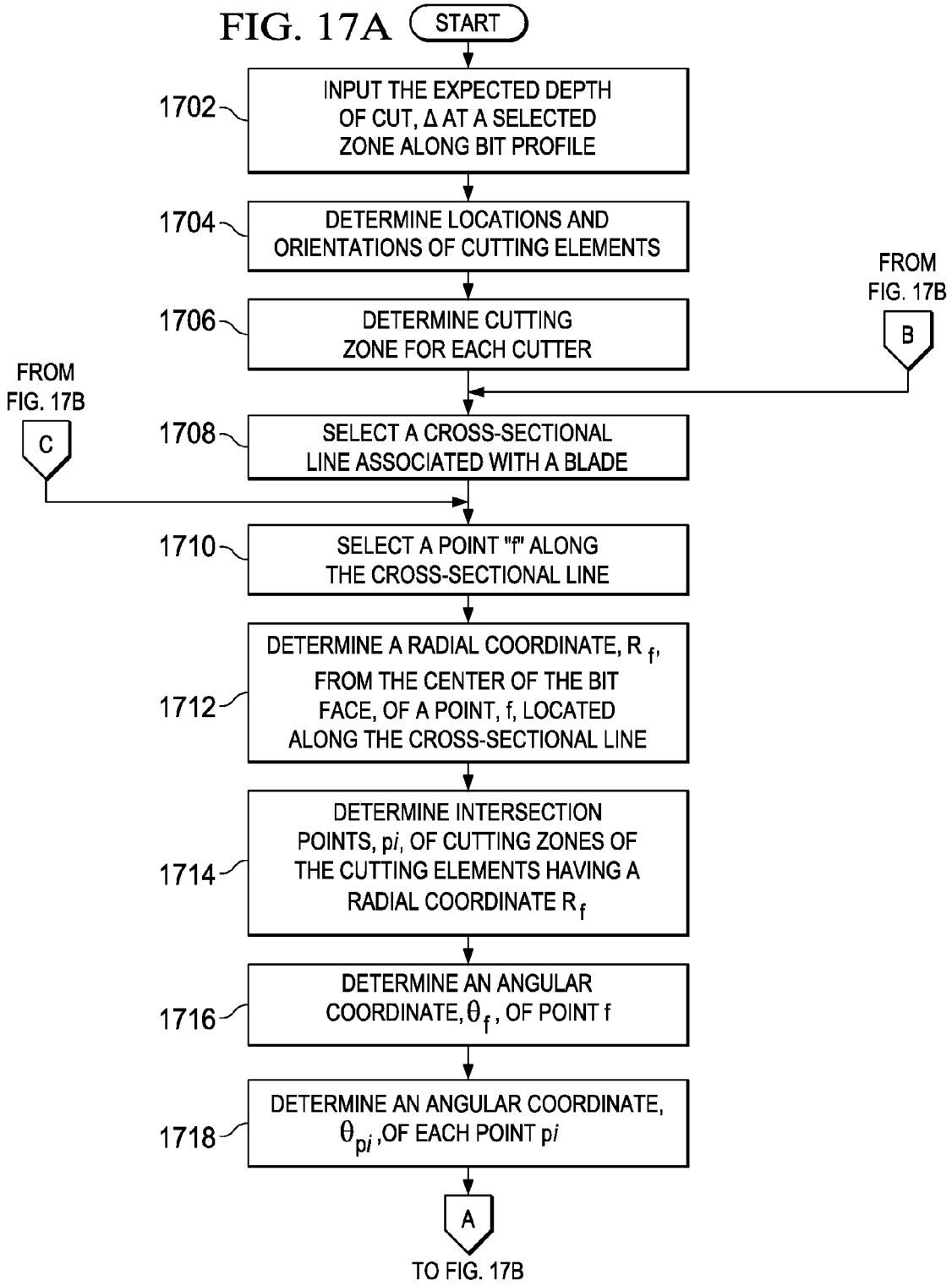
FIGS. 17A and 17B illustrate a flow chart of an example method for configuring the surface of a blade, in accordance with some embodiments of the present disclosure.
Figure 17B:
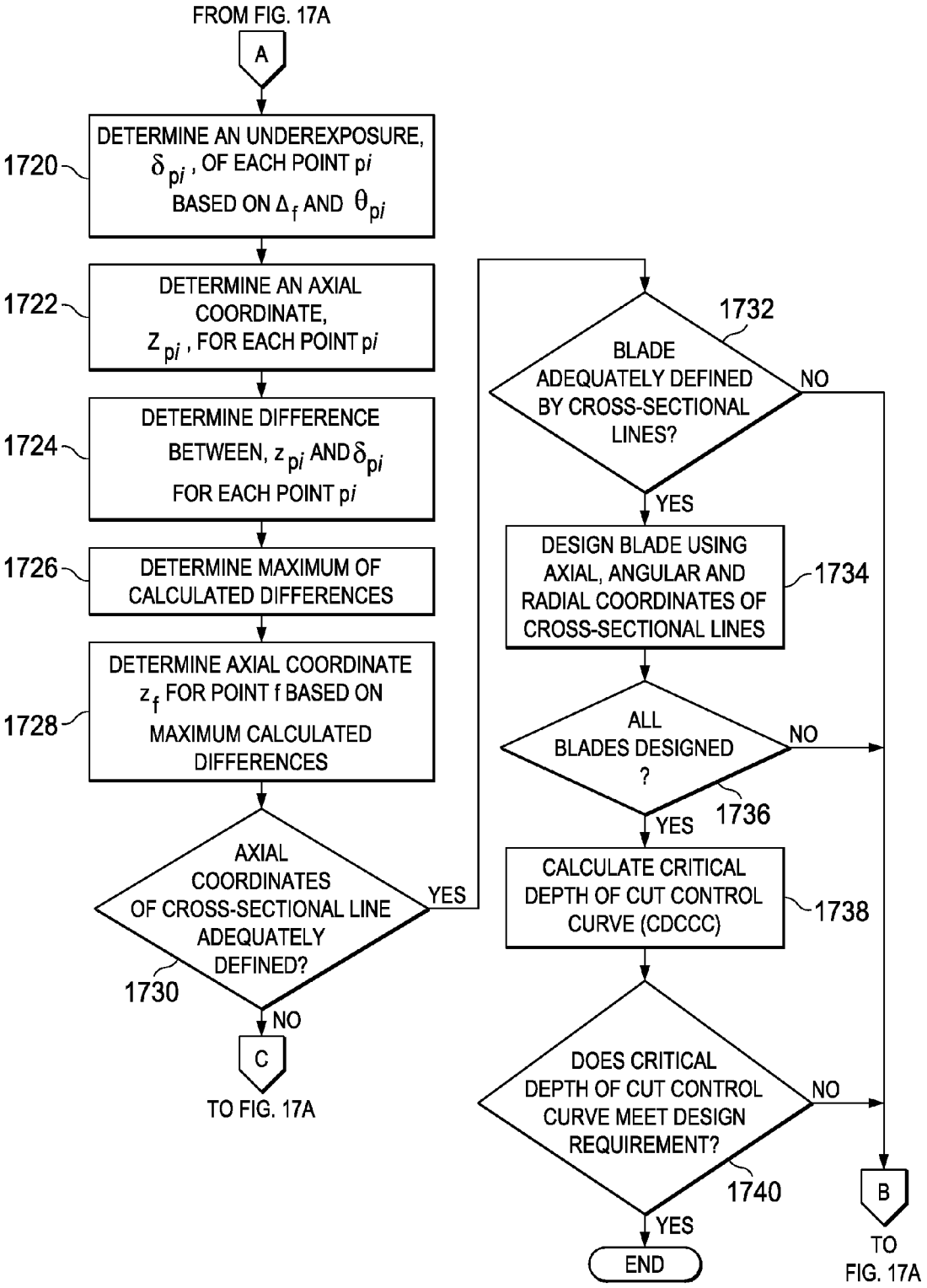

FIGS. 17A and 17B illustrate a flow chart of an example method 1700 for configuring the surface of a blade (e.g., blade 1626*a* of FIGS. 16A-16B) according to the cutting edges of the cutting elements with depths of cut that may be affected by at least a portion of the blade. In some embodiments, the blade surface may be configured for all the cutting elements with depths of cut that may be affected by at least a portion of the blade. The steps of method 1700 may be performed by an engineering tool, similar to methods 1100 described above. In the illustrated embodiment the cutting structures of the bit including at least the locations and orientations of all cutting elements may have been previously designed. However in other embodiments, method 1700 may include steps for designing the cutting structure of the drill bit.

Method 1700 may start, and at step 1702, the engineering tool may determine desired critical depth of cut control, Δ, at a selected zone (e.g., cone zone, nose zone, shoulder zone, gage zone, etc.) along a bit profile, substantially similar to as done with respect to step 1102 of method 1100. The zone may be associated with a radial swath of the drill bit. At step 1704, the locations and orientations of cutting elements within the swath may be determined. Additionally, at step 1706 the engineering tool may create a 3D cutter/rock interaction model that may determine the cutting zone and the cutting edge for each cutting element.

At step 1708, the engineering tool may select a cross-sectional line (e.g., cross-sectional line 1610 of FIG. 16A) that may be associated with a blade and may intersect a radial swath (e.g., radial swath 1608) with a desired critical depth of cut. At step 1710, a control point "f" along the cross-sectional line may be selected and at step 1712 the radial coordinate $R_f$ of control point "f" may be determined. $R_f$ may indicate the distance of control point "f" from the center of the drill bit. Intersection points pi of the cutting edges of one or more cutting elements having the radial coordinate $R_f$ may be determined at step 1714. At step 1716, an angular coordinate of control point "f" ($\theta_f$) may be determined and at step 1718 an angular coordinate of each intersection point pi ($\theta_{pi}$) may be determined.

The engineering tool may determine a desired underexposure of each intersection point pi ($\delta_{pi}$) with respect to control point "f" at step 1720. As explained above with respect to FIGS. 10, 11 and 16, the underexposure $\delta_{pi}$ of each intersection point pi may be determined based on a desired critical depth of cut Δ of the drill bit in the rotational path of control point "f." The underexposure $\delta_{pi}$ for each intersection point pi may also be based on the relationship of angular coordinate $\theta_f$ with respect to a respective angular coordinate $\theta_{pi}$.

At step 1722, an axial coordinate for each intersection point pi ($Z_{pi}$) may be determined and a difference between $Z_{pi}$ and the respective underexposure $\delta_{pi}$ may be determined at step 1724, similar to that described above in FIG. 16 (e.g., $Z_{pi}-\delta_{pi}$). In one embodiment, the engineering tool may determine a maximum of the difference between $Z_{pi}$ and $\delta_{pi}$ calculated for each point pi at step 1726. At step 1728, the axial coordinate of control point "f" ($Z_f$) may be determined based on the maximum calculated difference, similar to that described above in FIG. 16.

At step 1730, the engineering tool may determine whether the axial coordinates of a sufficient number of control points (e.g., control point "f") of the cross-sectional line have been determined to adequately define the axial position of the cross-sectional line. If the axial coordinates of more control points are needed, method 1700 may return to step 1710 where the engineering tool may select another control point along the cross-sectional line, otherwise, method 1700 may proceed to step 1732.

At step 1732, the engineering tool may determine whether the axial, radial and angular positions of a sufficient number of cross-sectional lines have been determined for the blade within the radial swath to adequately define the surface of the blade. If yes, method 1700 may proceed to step 1734, otherwise method 1700 may return to step 1708 to select another cross-sectional line associated with the blade and radial swath.

At step 1734, the engineering tool may use the axial, angular and radial coordinates of the cross-sectional lines to configure the blade surface. In some instances, the three dimensional surface of the blade that may correspond with the axial curvature of the cross-sectional lines may be designed by smoothing the surface using a two dimensional interpolation t method such as the MATLAB® function called interp2.

At step 1736, the engineering tool may determine whether all of the blade surfaces of the drill bit configured to control the depth of cut of the drill bit have been designed. If no, method 1700 may return to step 1708 to select a cross-sectional line for another blade that is to be designed to control the depth of cut of the drill bit for a particular radial swath. In some instances, the other blade may be configured to control the depth of cut for the same radial swath. In other instances the other blade may be configured to control the depth of cut for a different radial swath. If all the blade surfaces of the drill bit are sufficiently designed, method 1700 may proceed to step 1738 where the engineering tool may calculate a critical depth of cut control curve (CDCCC) for the drill bit, as explained in more detail below.

The engineering tool may determine whether the CDCCC indicates that the drill bit meets the design requirements at step 1740. If no, method 1700 may return to step 1708 and various changes may be made to the design of one or more blade surfaces. If yes, method 1700 may end. Consequently, method 1700 may be used to design and configure a blade to control the depth of cut of a drill bit according to the cutting edges of the cutting elements within a swath of the drill bit (e.g., all the cutting elements within the swath).

Method 1700 may be repeated for designing and configuring another blade within the same radial swath at the same expected depth of cut beginning at step 1708. Method 1700 may also be repeated for designing and configuring blades within another radial swath of a drill bit by inputting another expected depth of cut, Δ, at step 1702.

Modifications, additions, or omissions may be made to method 1700 without departing from the scope of the present disclosure. For example, each step may include additional steps. Additionally, the order of the steps as described may be changed. For example, although the steps have been described in sequential order, it is understood that one or more steps may be performed at the same time.

As mentioned above a drill bit may include more than one blade that may be configured to control the depth of cut of the cutting elements within the same swath of the drill bit, to control the depth of cut of different swaths of the drill bit, or any combination thereof. Additionally, different sections of a blade may be configured to control the depth of cut of different radial swaths of a drill bit according to different desired critical depths of cut at the different radial swaths. FIGS. 18 and 19 illustrate example configurations of blades configured to control the depth of cut of drill bits.

Figure 18A:
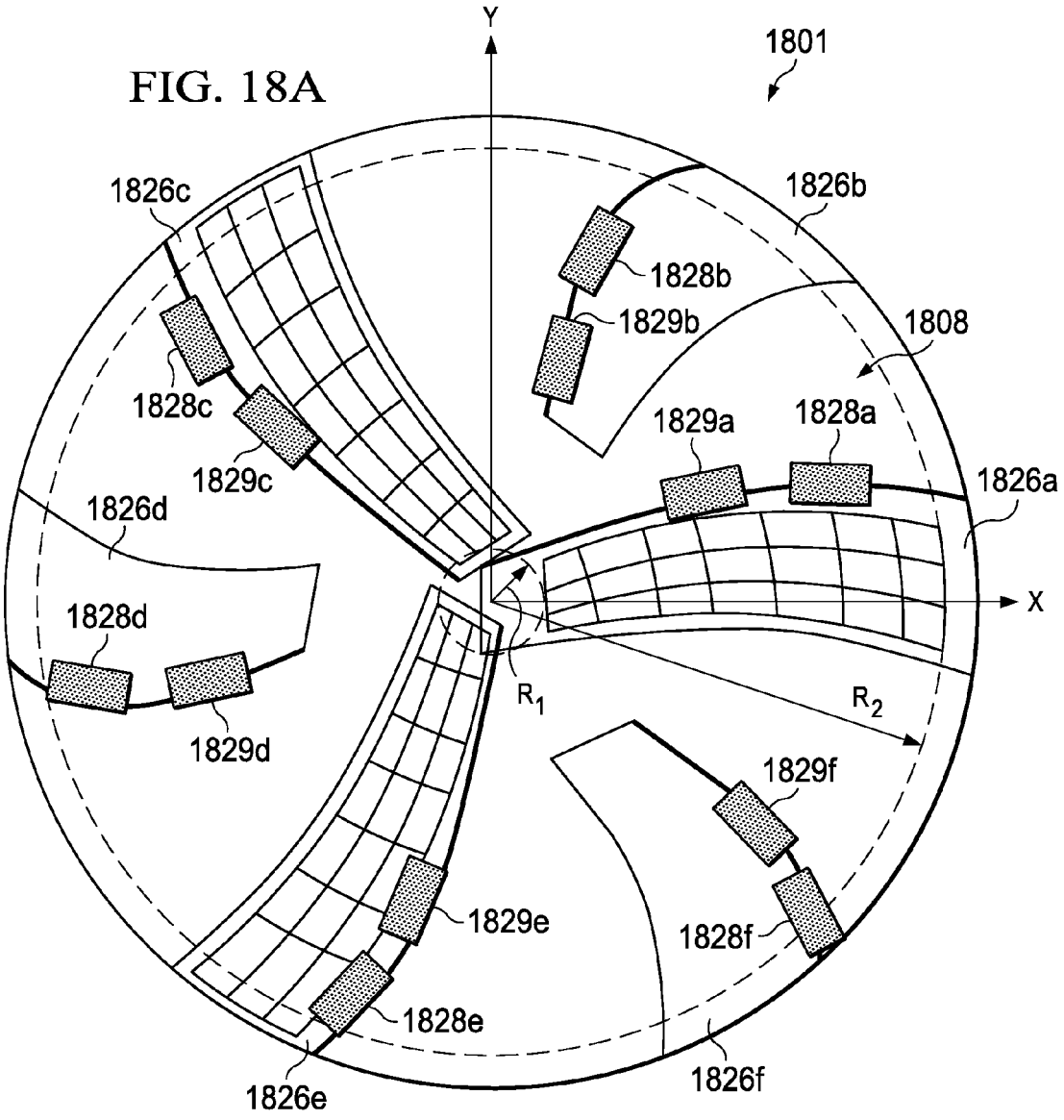
FIG. 18A illustrates an example of a drill bit that includes a plurality of blades configured to control the depth of cut of the drill bit, in accordance with some embodiments of the present disclosure.
Figure 18B:
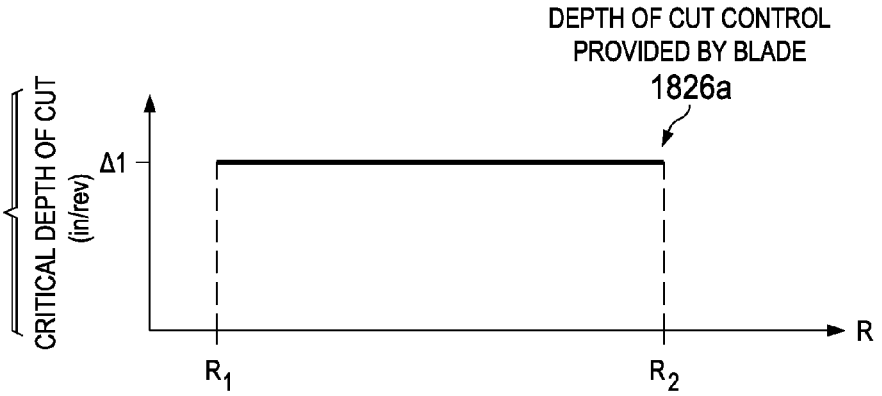
FIGS. 18B-18E illustrate critical depth of cut control curves of the drill bit of FIG. 18A, in accordance with some embodiments of the present disclosure.
Figure 18C:
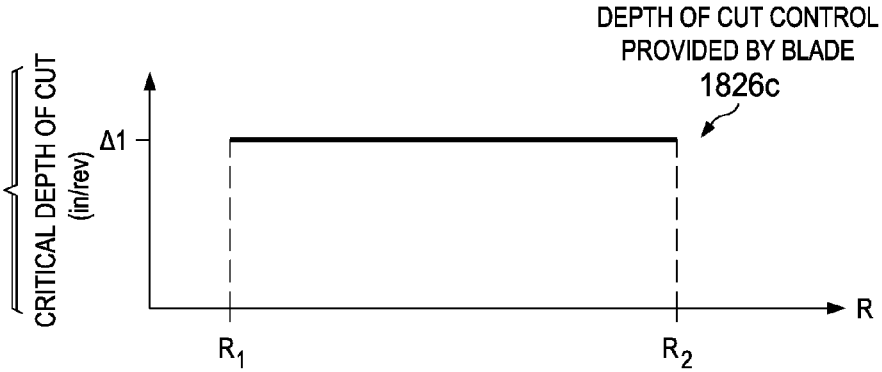
Figure 18D:
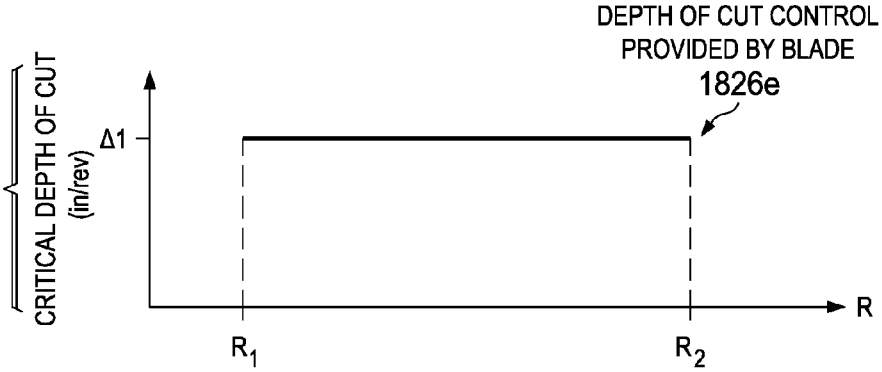

FIG. 18A illustrates an example bit face of a drill bit 1801 that includes blades 1826*a*, 1826*c* and 1826*e* configured to control the depth of cut of drill bit 1801. In the illustrated embodiment, blades 1826*a*, 1826*c* and 1826*e* may be configured to control the depth of cut of drill bit 1801 to have a critical depth of cut $\Delta_1$ for radial swath 1808. Radial swath 1808 may be defined by a first radial coordinate $R_1$ and a second radial coordinate $R_2$, and in the illustrated embodiment may substantially cover the face of drill bit 1801. The surfaces of blades 1826*a*, 1826*c* and 1826*e* may be configured respectively to control the depth of cut of cutting elements 1828 and 1829 located within the swath as described above.

Figure 18E:
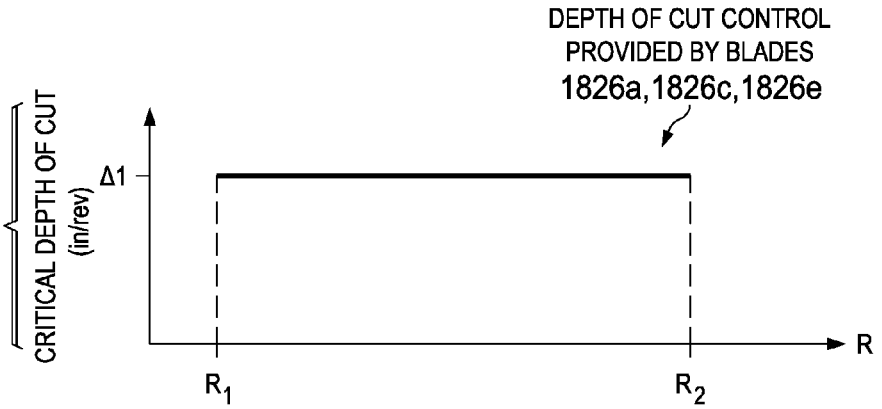

FIGS. 18B-18E illustrate critical depth of cut control curves (described in further detail below) of drill bit 1801. The critical depth of cut control curves indicate that the critical depth of cut of radial swath 1808 ($\Delta_1$) defined by radial coordinates $R_1$ and $R_2$ may be substantially even and constant. Therefore, FIGS. 18B-18E indicate that the blade surfaces of blades 1826*a*, 1826*c*, and 1826*e* may provide a combined depth of cut control for a radial swath defined by radius $R_1$ and radius $R_2$, as shown in FIG. 18E.

Additionally, in the illustrated embodiment blades 1826*a*, 1826*c* and 1826*e* may be selected to control the depth of cut of drill bit 1801 based on the spacing of blades 1826*a*, 1826*c* and 1826*e*. Blades 1826*a*, 1826*c* and 1826*e* may be spaced approximately 120 degrees from each other such that the lateral forces created by blades 1826*a*, 1826*c* and 1826*e* may be substantially balanced while drilling. Therefore, blades 1826*a*, 1826*c* and 1826*e* may be configured to control the depth of cut of drill bit 1801 based on cutting elements 1828 and 1829 located within the swath to provide a substantially constant depth of cut control for drill bit 1801 at swath 1608. Additionally, blades 1826*a*, 1826*c* and 1826*e* may be configured such that the lateral forces created by these blades of drill bit 1801 may be substantially balanced.

Modifications, additions or omissions may be made to drill bit 1801 without departing from the scope of the present disclosure. For example, blades 1826 may be configured to control the depth of cut according to different critical depths of cut of different radial swaths as disclosed in more detail below with respect to blades 1926 in FIGS. 19A-19D.

Figure 19A:
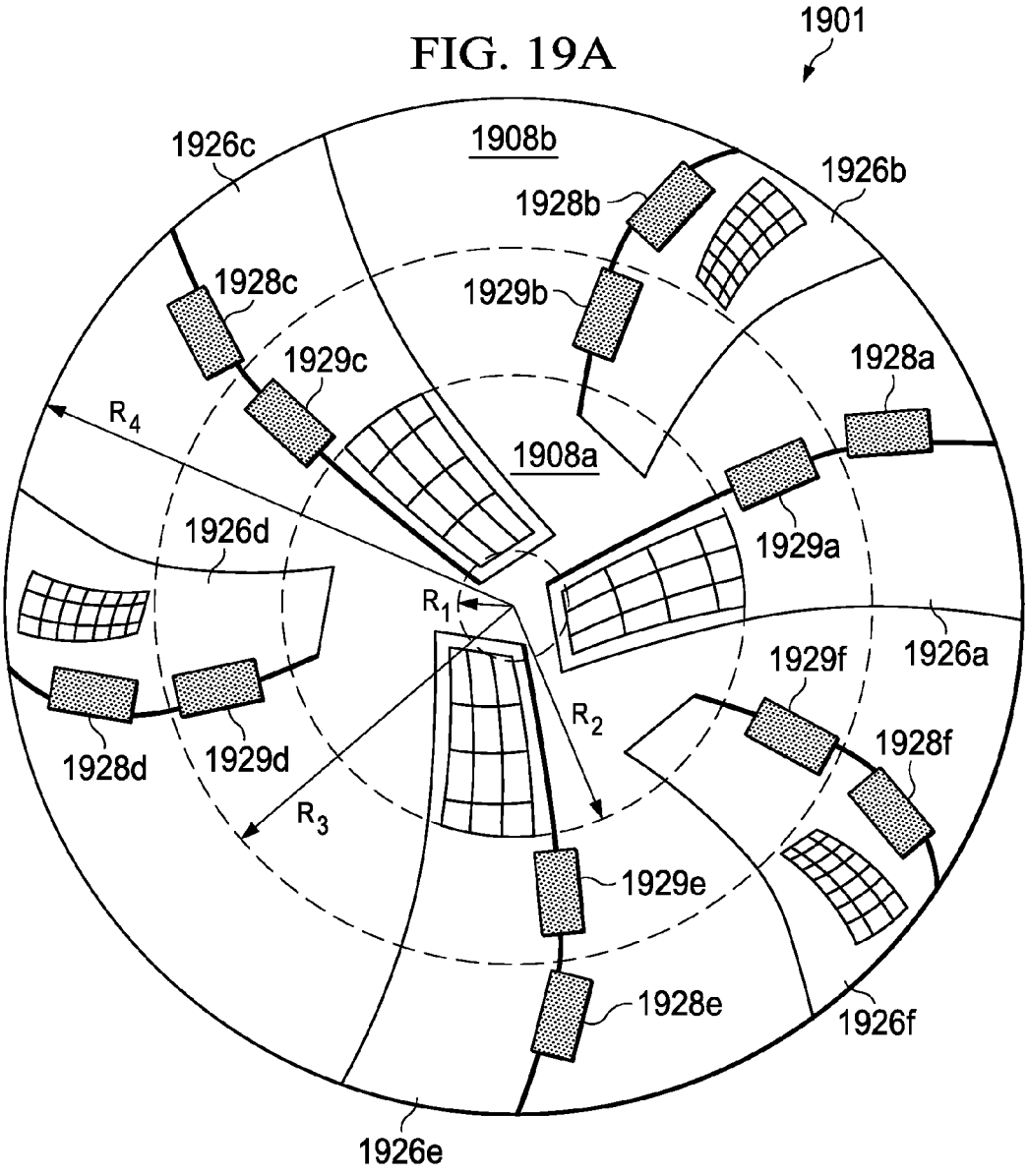
FIG. 19A illustrates another example of a drill bit that includes a plurality of blades configured to control the depth of cut of the drill bit according to different critical depths of cut for different radial swaths of the drill bit, in accordance with some embodiments of the present disclosure.
Figure 19B:
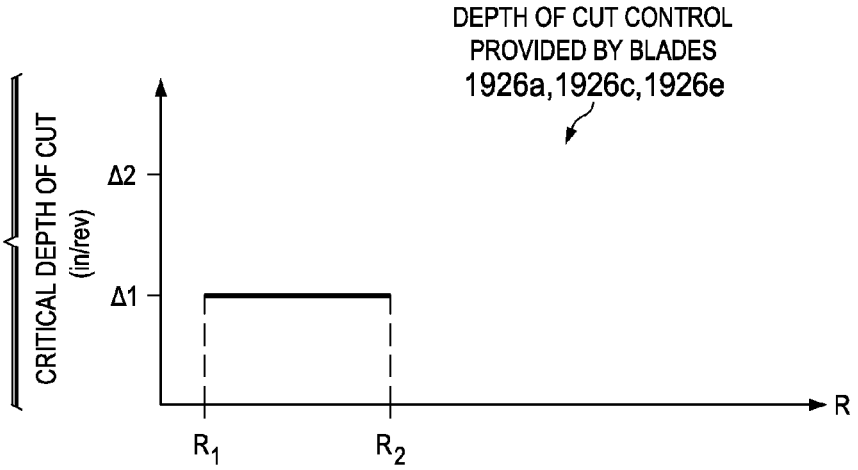
FIGS. 19B-19D illustrate critical depth of cut control curves of the drill bit of FIG. 19A, in accordance with some embodiments of the present disclosure.
Figure 19C:
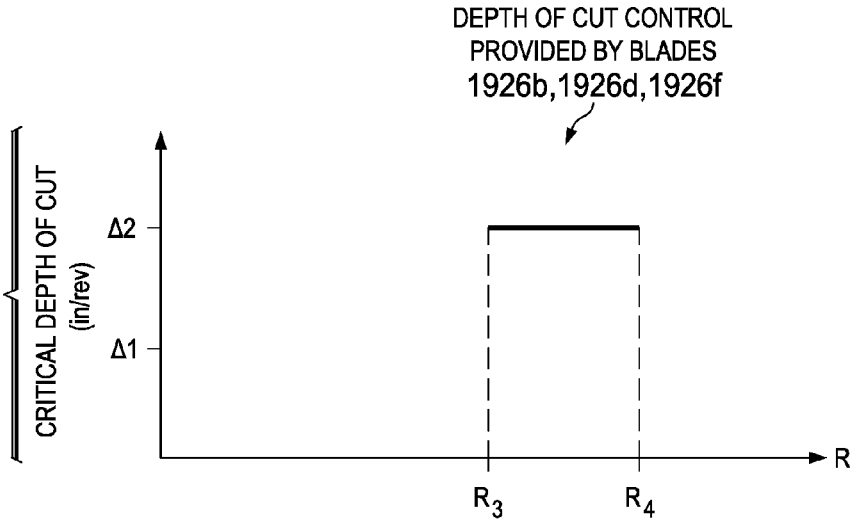
Figure 19D:
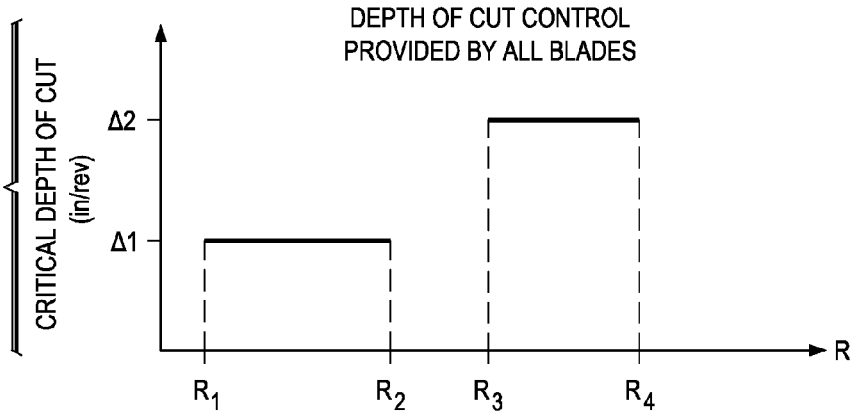

FIG. 19A illustrates an example drill bit 1901 that includes blades 1926 configured to control the depth of cut of drill bit 1901 according to different critical depths of cut for different radial swaths of drill bit 1901. In the illustrated embodiment, blades 1926*a*, 1926*c* and 1926*e* may be configured to control the depth of cut of drill bit 1901 to have a first critical depth of cut $\Delta_1$ for radial swath 1908*a*, as illustrated by FIG. 19B. Radial swath 1908*a* may be defined by a first radial coordinate $R_1$ and a second radial coordinate $R_2$. Blades 1926*b*, 1926*d* and 1926*f* may be configured to control the depth of cut of drill bit 1901 to have a second critical depth of cut $\Delta_2$ as illustrated by FIG. 19C. In the illustrated embodiment, radial swath 1908*b* may be defined by a third radial coordinate $R_3$ and a fourth radial coordinate $R_4$. The overall critical depth of cut as controlled by blades 1926*a*-1926*f* for drill bit 1901 is illustrated by FIG. 19D. The surfaces of blades 1926*a*-1926*f* may be configured to control the depth of cut based on cutting elements 1928 and 1929 located within the radial swaths according to the present disclosure, as described above.

As shown by the critical depth of cut control curve of FIG. 19B, the surfaces of blades 1926*a*, 1926*c*, and 1926*e* may be configured according to the present disclosure to provide a substantially constant depth of cut control of radial swath 1908*a* defined by radial coordinates $R_1$ and $R_2$. FIG. 19C illustrates another critical depth of cut control curve of drill bit 1901 that indicates that the surfaces of blades 1926*b*, 1926*d*, and 1926*f* may be configured according to the present disclosure to provide a substantially constant depth of cut control of radial swath 1908*b* defined by radial coordinates $R_3$ and $R_4$. FIG. 19D illustrates a critical depth of cut control curve indicating the substantially constant depth of cut of radial swaths 1908*a* and 1908*b* of drill bit 1901.

Additionally, in the illustrated embodiment, blades 1926*a*, 1926*c* and 1926*e* may be selected to control the depth of cut of drill bit 1901 for radial swath 1908*a* based on the spacing of blades 1926*a*, 1926*c* and 1926*e*. Blades 1926*a*, 1926*c* and

1926*e* may be spaced approximately 120 degrees from each other such that the lateral forces created by blades 1926*a*, 1926*c* and 1926*e* may be substantially balanced while drilling. Further, in the illustrated embodiment, blades 1926*b*, 1926*d* and 1926*f* may be selected to control the depth of cut of drill bit 1901 for radial swath 1908*b* based on the spacing of blades 1926*b*, 1926*d* and 1926*f*. Blades 1926*b*, 1926*d* and 1926*f* may also be spaced approximately 120 degrees from each other such that the lateral forces created by blades 1926*b*, 1926*d* and 1926*f* may be substantially balanced while drilling.

Modifications, additions or omissions may be made to drill bit 1901 without departing from the scope of the present disclosure. For example, blades 1926*a*, 1926*c* and 1926*e* may be respectively configured according to second critical depth of cut $\Delta_2$ for radial swath 1908*b* in addition to being configured according to first critical depth of cut $\Delta_1$ for radial swath 1908*a*. And blades 1926*b*, 1926*d* and 1926*f* may be respectively configured according to first critical depth of cut $\Delta_1$ for radial swath 1908*a* in addition to being configured according to second critical depth of cut $\Delta_2$ for radial swath 1908*b*.

As mentioned above, the depth of cut of a drill bit may be analyzed by calculating a critical depth of cut control curve (CDCCC) for a radial swath of the drill bit as provided by the DOCCs, blade, or any combination thereof, located within the radial swath. The CDCCC may be based on a critical depth of cut associated with a plurality of radial coordinates.

Figure 20A:
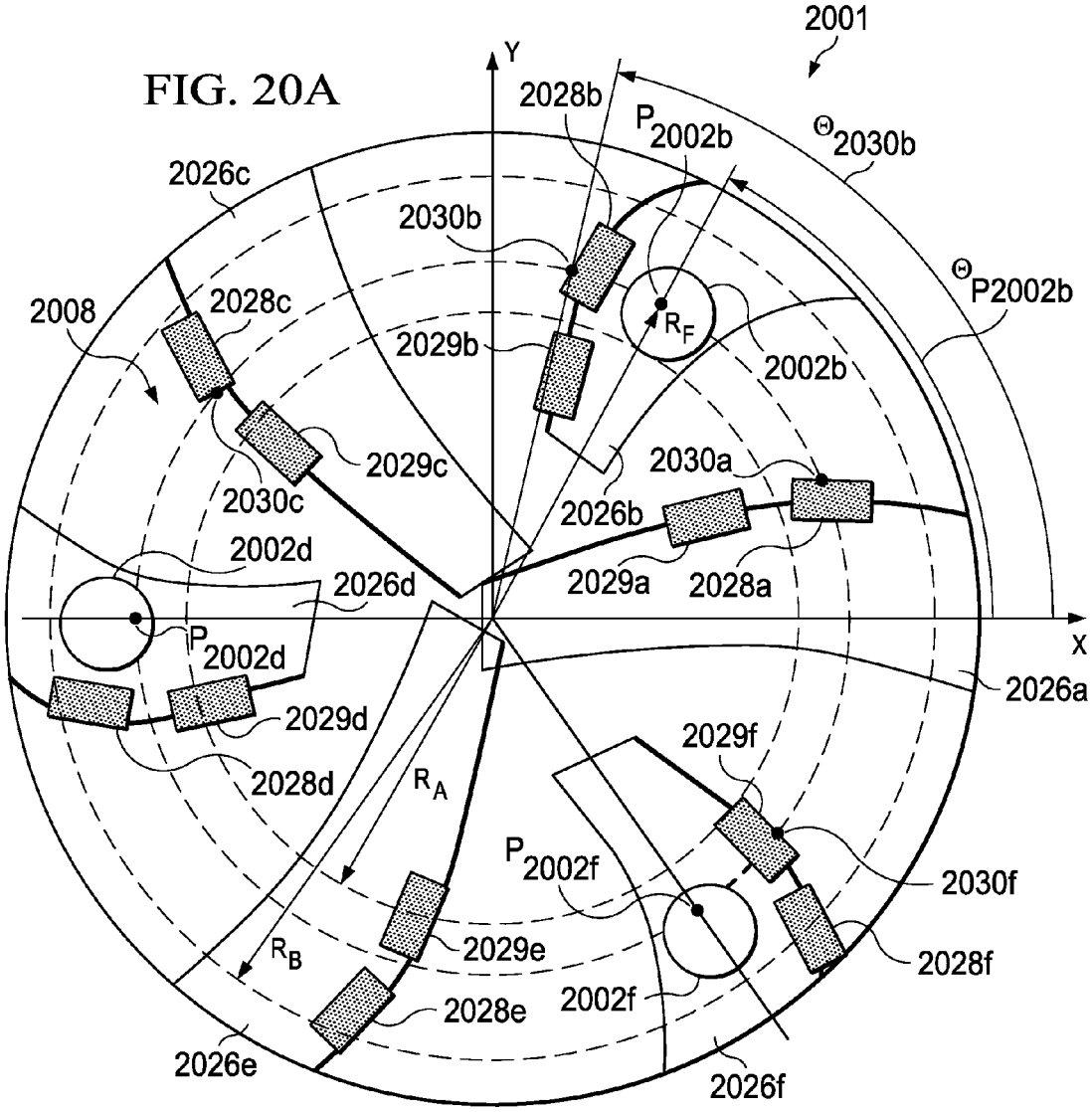
FIG. 20A illustrates the face of a drill bit for which a critical depth of cut control curve (CDCCC) may be determined, in accordance with some embodiments of the present disclosure.
Figure 20B:
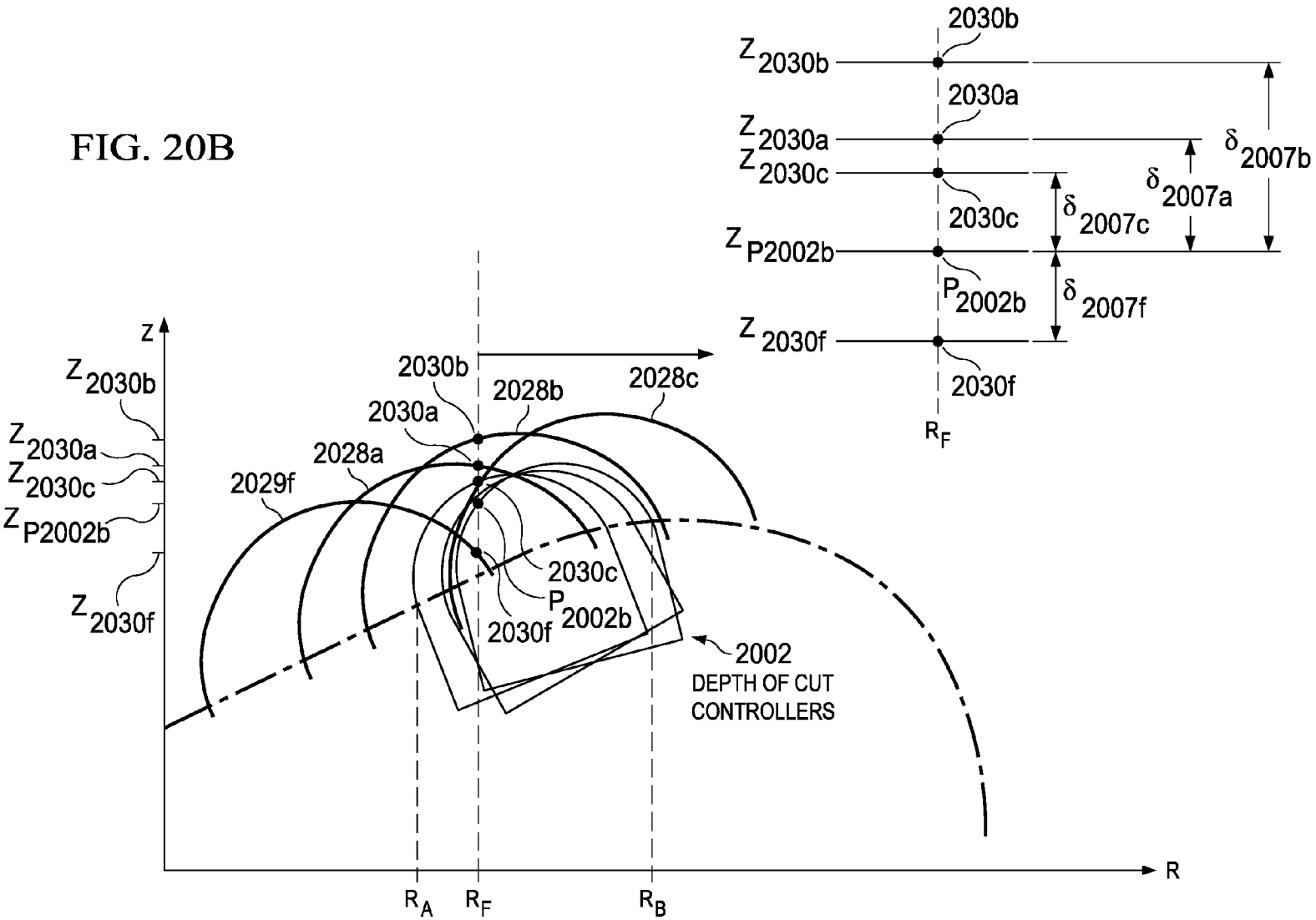
FIG. 20B illustrates a bit face profile of the drill bit depicted in FIG. 20A, in accordance with some embodiments of the present disclosure.

FIG. 20A illustrates the face of a drill bit 2001 for which a critical depth of cut control curve (CDCCC) may be determined, in accordance with some embodiments of the present disclosure. FIG. 20B illustrates a bit face profile of drill bit 2001 of FIG. 20A.

Drill bit 2001 may include a plurality of blades 2026 that may include cutting elements 2028 and 2029. Additionally, blades 2026*b*, 2026*d* and 2026*f* may include DOCC 2002*b*, DOCC 2002*d* and DOCC 2002*f*, respectively, that may be configured to control the depth of cut of drill bit 2001. DOCCs 2002*b*, 2002*d* and 2002*f* may be configured and designed according to the desired critical depth of cut of drill bit 2001 within a radial swath intersected by DOCCs 2002*b*, 2002*d* and 2002*f* as described in detail above.

As mentioned above, the critical depth of cut of drill bit 2001 may be determined for a radial location along drill bit 2001. For example, drill bit 2001 may include a radial coordinate $R_F$ that may intersect with DOCC 2002*b* at a control point $P_{2002b}$, DOCC 2002*d* at a control point $P_{2002d}$, and DOCC 2002*f* at a control point $P_{2002f}$. Additionally, radial coordinate $R_F$ may intersect cutting elements 2028*a*, 2028*b*, 2028*c*, and 2029*f* at cutlet points 2030*a*, 2030*b*, 2030*c*, and 2030*f*, respectively, of the cutting edges of cutting elements 2028*a*, 2028*b*, 2028*c*, and 2029*f*, respectively.

The angular coordinates of control points $P_{2002b}$, $P_{2002d}$ and $P_{2002f}$ ($\theta_{P2002b}$, $\theta_{P2002d}$ and $\theta_{P2002f}$, respectively) may be determined along with the angular coordinates of cutlet points 2030*a*, 2030*b*, 2030*c* and 2030*f* ($\theta_{2030a}$, $\theta_{2030b}$, $\theta_{2030c}$ and $\theta_{2030f}$, respectively). A depth of cut control provided by each of control points $P_{2002b}$, $P_{2002d}$ and $P_{2002f}$ with respect to each of cutlet points 2030*a*, 2030*b*, 2030*c* and 2030*f* may be determined. The depth of cut control provided by each of control points $P_{2002b}$, $P_{2002d}$ and $P_{2002f}$ may be based on the underexposure ($\delta_{2007i}$ depicted in FIG. 20B) of each of points $P_{2002i}$ with respect to each of cutlet points 2030 and the angular coordinates of points $P_{2002i}$ with respect to cutlet points 2030.

For example, the depth of cut of cutting element 2028*b* at cutlet point 2030*b* controlled by point $P_{2002b}$ of DOCC 2002*b* ($\Delta_{2030b}$) may be determined using the angular coordinates of point $P_{2002b}$ and cutlet point 2030*b* ($\theta_{P2002b}$ and $\theta_{2030b}$, respectively), which are depicted in FIG. 20A. Additionally, $\Delta_{2030b}$ may be based on the axial underexposure ($\delta_{2007b}$) of the axial coordinate of point $P_{2002b}$ ($Z_{P2002b}$) with respect to the axial coordinate of intersection point 2030*b* ($Z_{2030b}$), as depicted in FIG. 20B. In some embodiments, $\Delta_{2030b}$ may be determined using the following equations:

$$\Delta_{203b}=\delta_{2007b}*360/(360-(\theta_{P2002b}-\theta_{2030b}))\text{; and}$$

$$\delta_{2007b}=Z_{2030b}-Z_{P2002b}.$$

In the first of the above equations, $\theta_{P2002b}$ and $\theta_{2030b}$ may be expressed in degrees and "360" may represent a full rotation about the face of drill bit 2001. Therefore, in instances where $\theta_{P2002b}$ and $\theta_{2030b}$ are expressed in radians, the numbers "360" in the first of the above equations may be changed to "2λ." Further, in the above equation, the resultant angle of "$(\theta_{P2002b}-\theta_{2030b})$" ($\Delta_\theta$) may be defined as always being positive. Therefore, if resultant angle $\Delta_\theta$ is negative, then $\Delta_\theta$ may be made positive by adding 360 degrees (or 2π radians) to $\Delta_\theta$. Similar equations may be used to determine the depth of cut of cutting elements 2028*a*, 2028*c*, and 2029*f* as controlled by control point $P_{2002b}$ at cutlet points 2030*a*, 2030*c* and 2030*f*, respectively ($\Delta_{2030a}$, $\Delta_{2030c}$ and $\Delta_{2030f}$, respectively).

The critical depth of cut provided by point $P_{2002b}$ ($\Delta_{P2002b}$) may be the maximum of $\Delta_{2030a}$, $\Delta_{2030b}$, $\Delta_{2030c}$ and $\Delta_{2030f}$ and may be expressed by the following equation:

$$\Delta_{P2002b}=\max[\Delta_{2030a},\Delta_{2030b},\Delta_{2030c},\Delta_{2030f}].$$

The critical depth of cut provided by points $P_{2002d}$ and $P_{2002f}$ ($\Delta_{P2002d}$ and $\Delta_{P2002f}$, respectively) at radial coordinate $R_F$ may be similarly determined. The overall critical depth of cut of drill bit 2001 at radial coordinate $R_F$ ($\Delta_{RF}$) may be based on the minimum of $\Delta_{P2002b}$, $\Delta_{P2002d}$ and $\Delta_{P2002f}$ and may be expressed by the following equation:

$$\Delta_{RF}=\min[\Delta_{P2002b},\Delta_{P2002d},\Delta_{P2002f}].$$

Accordingly, the overall critical depth of cut of drill bit 2001 at radial coordinate $R_F$ ($\Delta_{RF}$) may be determined based on the points where DOCCs 2002 and cutting elements 2028/2029 intersect $R_F$. Although not expressly shown here, it is understood that the overall critical depth of cut of drill bit 2001 at radial coordinate $R_F$ ($\Delta_{RF}$) may also be affected by control points $P_{2026i}$ (not expressly shown in FIGS. 20A and 20B) that may be associated with blades 2026 configured to control the depth of cut of drill bit 2001 at radial coordinate $R_F$. In such instances, a critical depth of cut provided by each control point $P_{2026i}$ ($\Delta_{P2026i}$) may be determined. Each critical depth of cut $\Delta_{P2026i}$ for each control point $P_{2026i}$ may be included with critical depth of cuts $\Delta_{P2002i}$ in determining the minimum critical depth of cut at $R_F$ to calculate the overall critical depth of cut $\Delta_{RF}$ at radial location $R_F$.

To determine a critical depth of cut control curve of drill bit 2001, the overall critical depth of cut at a series of radial locations $R_f$ ($\Delta_{Rf}$) anywhere from the center of drill bit 2001 to the edge of drill bit 2001 may be determined to generate a curve that represents the critical depth of cut as a function of the radius of drill bit 2001. In the illustrated embodiment, DOCCs 2002*b*, 2002*d*, and 2002*f* may be configured to control the depth of cut of drill bit 2001 for a radial swath 2008 defined as being located between a first radial coordinate $R_A$ and a second radial coordinate $R_B$. Accordingly, the overall critical depth of cut may be determined for a series of radial coordinates $R_f$ that are within radial swath 2008 and located between $R_A$ and $R_B$, as disclosed above. Once the overall critical depths of cuts for a sufficient number of radial coordinates $R_f$ are determined, the overall critical depth of cut may be graphed as a function of the radial coordinates $R_f$.

Figure 20C:
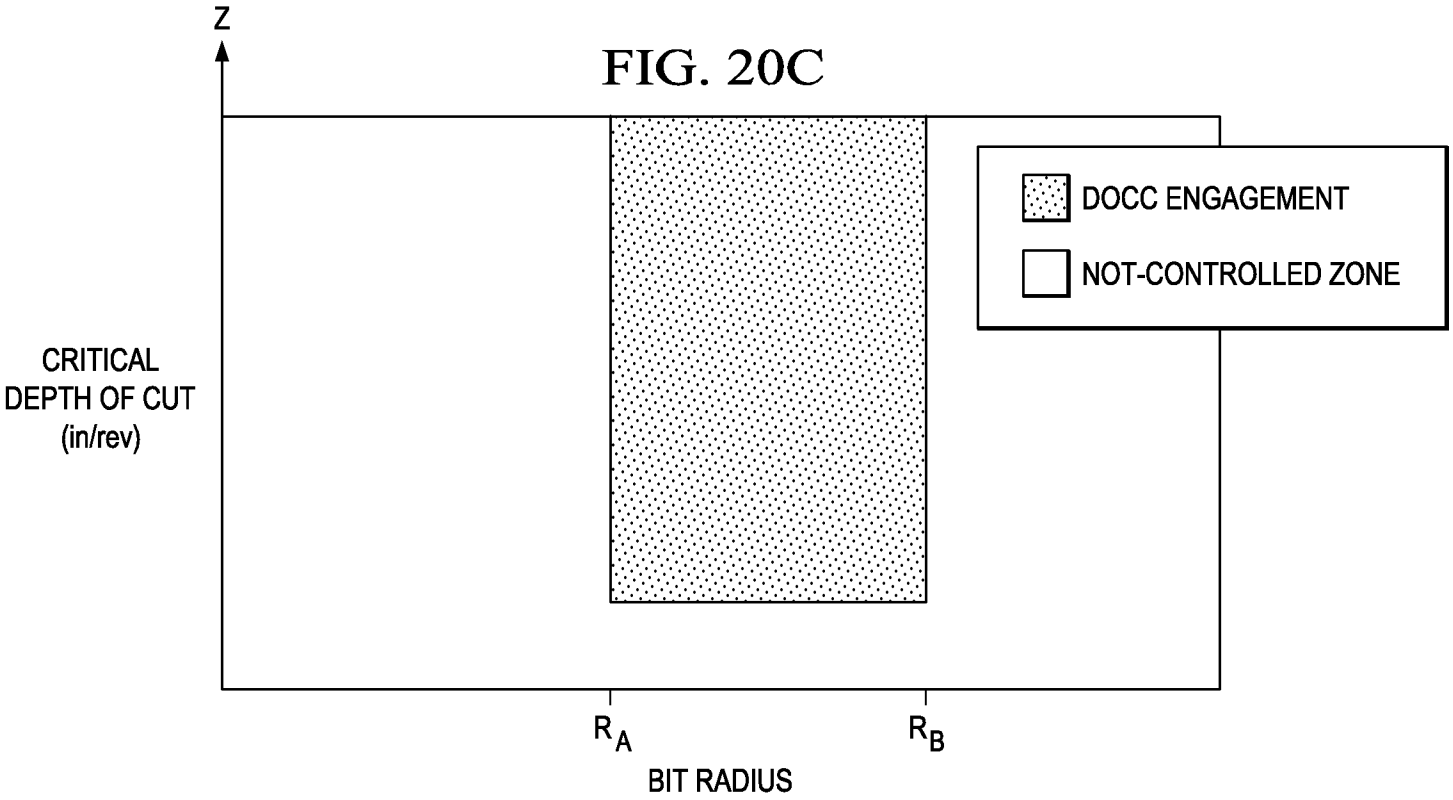
FIG. 20C illustrates a critical depth of cut control curve for a drill bit, in accordance with some embodiments of the present disclosure.

FIG. 20C illustrates a critical depth of cut control curve for drill bit 2001, in accordance with some embodiments of the present disclosure. FIG. 20C illustrates that the critical depth of cut between radial coordinates $R_A$ and $R_B$ may be substantially uniform, indicating that DOCCs 2002*b*, 2002*d* and 2002*f* may be sufficiently configured to provide a substantially even depth of cut control between $R_A$ and $R_B$.

Modifications, additions or omissions may be made to FIGS. 20A-20C without departing from the scope of the present disclosure. For example, as discussed above, blades 2026, DOCCs 2002 or any combination thereof may affect the critical depth of cut at one or more radial coordinates and the critical depth of cut may be determined accordingly.

Figure 21:
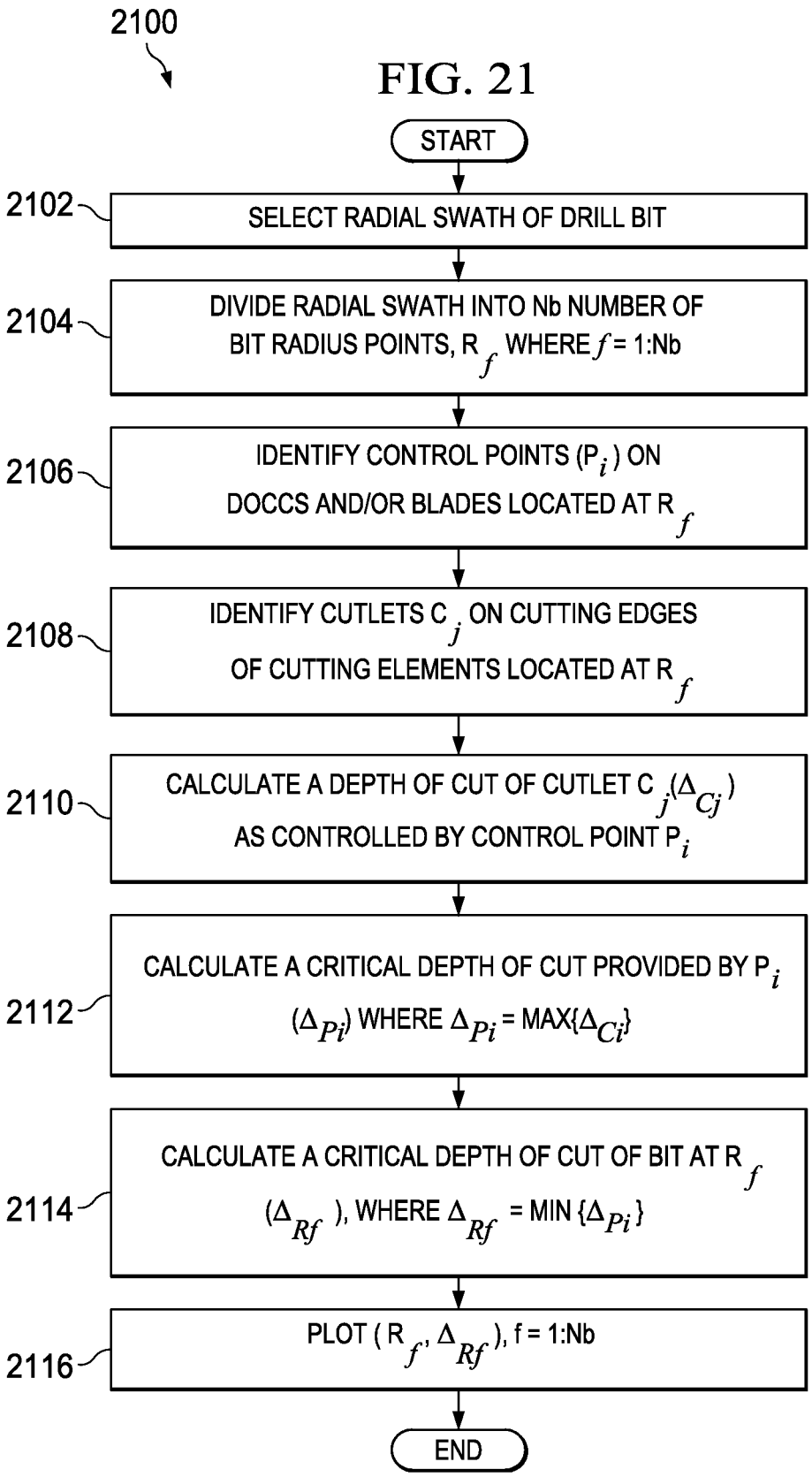
FIG. 21 illustrates an example method of determining and generating a critical depth of cut control curve, in accordance with some embodiments of the present disclosure.

FIG. 21 illustrates an example method 2100 of determining and generating a CDCCC in accordance with some embodiments of the present disclosure. Similar to methods 700, 900, 1100 and 1700, method 2100 may be performed by any suitable engineering tool. In the illustrated embodiment, the cutting structures of the bit, including at least the locations and orientations of all cutting elements and DOCCs, may have been previously designed. However in other embodiments, method 2100 may include steps for designing the cutting structure of the drill bit. For illustrative purposes, method 2100 is described with respect to drill bit 2001 of FIGS. 20A-20C; however, method 2100 may be used to determine the CDCCC of any suitable drill bit.

Method 2100 may start, and at step 2102, the engineering tool may select a radial swath of drill bit 2001 for analyzing the critical depth of cut within the selected radial swath. In some instances the selected radial swath may include the entire face of drill bit 2001 and in other instances the selected radial swath may be a portion of the face of drill bit 2001. For example, the engineering tool may select radial swath 2008 as defined between radial coordinates $R_A$ and $R_B$ and controlled by DOCCs 2002*b*, 2002*d* and 2002*f*, shown in FIGS. 20A-20C.

At step 2104, the engineering tool may divide the selected radial swath (e.g., radial swath 2008) into a number, Nb, of radial coordinates ($R_f$) such as radial coordinate $R_F$ described in FIGS. 20A and 20B. For example, radial swath 2008 may be divided into nine radial coordinates such that Nb for radial swath 2008 may be equal to nine. The variable "f" may represent a number from one to Nb for each radial coordinate within the radial swath. For example, "$R_1$" may represent the radial coordinate of the inside edge of a radial swath. Accordingly, for radial swath 2008, "$R_1$" may be approximately equal to $R_A$. As a further example, "$R_{Nb}$" may represent the radial coordinate of the outside edge of a radial swath. Therefore, for radial swath 2008, "$R_{Nb}$" may be approximately equal to $R_B$.

At step 2106, the engineering tool may select a radial coordinate $R_f$ and may identify control points ($P_i$) at may be located at the selected radial coordinate $R_f$ and associated with a DOCC and/or blade. For example, the engineering tool may select radial coordinate $R_F$ and may identify control points $P_{2002i}$ and $P_{2026i}$ associated with DOCCs 2002 and/or blades 2026 and located at radial coordinate $R_F$, as described above with respect to FIGS. 20A and 20B.

At step 2108, for the radial coordinate $R_f$ selected in step 2106, the engineering tool may identify cutlet points ($C_j$) each located at the selected radial coordinate $R_f$ and associated with the cutting edges of cutting elements. For example, the engineering tool may identify cutlet points 2030*a*, 2030*b*, 2030*c* and 2030*f* located at radial coordinate $R_F$ and associated with the cutting edges of cutting elements 2028*a*, 2028*b*, 2028*c*, and 2029*f*, respectively, as described and shown with respect to FIGS. 20A and 20B.

At step 2110, the engineering tool may select a control point $P_i$ and may calculate a depth of cut for each cutlet $C_j$ as controlled by the selected control point $P_i$ ($\Delta_{Cj}$), as described above with respect to FIGS. 20A and 20B. For example, the engineering tool may determine the depth of cut of cutlets 2030*a*, 2030*b*, 2030*c*, and 2030*f* as controlled by control point $P_{2002b}$ ($\Delta_{2030a}$, $\Delta_{2030b}$, $\Delta_{2030c}$, and $\Delta_{2030f}$, respectively) by using the following equations:

$$\Delta_{2030a}=\delta_{2007a}*360/(360-(\theta_{P2002b}-\theta_{2030a}));$$

$$\delta_{2007a}=Z_{2030a}-Z_{P2002b};$$

$$\Delta_{2030b}=\delta_{2007b}*360/(360-(\theta_{P2002b}-\theta_{2030b}));$$

$$\delta_{2007b}=Z_{2030b}-Z_{P2002b};$$

$$\Delta_{2030c}=\delta_{2007c}*360/(360-(\theta_{P2002b}-\theta_{2030c}));$$

$$\delta_{2007c}=Z_{2030c}-Z_{P2002b};$$

$$\Delta_{2030f}=\delta_{2007f}*360/(360-(\theta_{P2002b}-\theta_{2030f}));\text{ and}$$

$$\delta_{2007f}=Z_{2030f}-Z_{P2002b}.$$

At step 2112, the engineering tool may calculate the critical depth of cut provided by the selected control point ($\Delta_{Pi}$) by determining the maximum value of the depths of cut of the cutlets $C_j$ as controlled by the selected control point $P_i$ ($\Delta_{Cj}$) and calculated in step 2110. This determination may be expressed by the following equation:

$$\Delta_{Pi}=\max\{\Delta_{Cj}\}.$$

For example, control point $P_{2002b}$ may be selected in step 2110 and the depths of cut for cutlets 2030*a*, 2030*b*, 2030*c*, and 2030*f* as controlled by control point $P_{2002b}$ ($\Delta_{2030a}$, $\Delta_{2030b}$, $\Delta_{2030c}$, and $\Delta_{2030f}$, respectively) may also be determined in step 2110, as shown above. Accordingly, the critical depth of cut provided by control point $P_{2002b}$ ($\Delta_{P2002b}$) may be calculated at step 2112 using the following equation:

$$\Delta_{P2002b}=\max[\Delta_{2030a},\Delta_{2030b},\Delta_{2030c},\Delta_{2030f}].$$

The engineering tool may repeat steps 2110 and 2112 for all of the control points $P_i$ identified in step 2106 to determine the critical depth of cut provided by all control points $P_i$ located at radial coordinate $R_f$. For example, the engineering tool may perform steps 2110 and 2112 with respect to control points $P_{2002d}$ and $P_{2002f}$ to determine the critical depth of cut provided by control points $P_{2002d}$ and $P_{2002f}$ with respect to cutlets 2030*a*, 2030*b*, 2030*c*, and 2030*f* at radial coordinate $R_F$ shown in FIGS. 20A and 20B (e.g., $\Delta_{P2002d}$ and $\Delta_{P2002f}$, respectively).

At step 2114, the engineering tool may calculate an overall critical depth of cut at the radial coordinate $R_f$ ($\Delta_{Rf}$) selected in step 2106. The engineering tool may calculate the overall critical depth of cut at the selected radial coordinate $R_f$ ($\Delta_{Rf}$) by determining a minimum value of the critical depths of cut of control points $P_i$ ($\Delta_{Pi}$) determined in steps 2110 and 2112. This determination may be expressed by the following equation:

$$\Delta_{Rf}=\min\{\Delta_{Pi}\}.$$

For example, the engineering tool may determine the overall critical depth of cut at radial coordinate $R_F$ of FIGS. 20A and 20B by using the following equation:

$$\Delta_{RF}=\min[\Delta_{P2002b},\Delta_{P2002d},\Delta_{P2002f}].$$

The engineering tool may repeat steps 2106 through 2114 to determine the overall critical depth of cut at all the radial coordinates $R_f$ generated at step 2104.

At step 2116, the engineering tool may plot the overall critical depth of cut ($\Delta_{Rf}$) for each radial coordinate $R_f$, as a function of each radial coordinate $R_f$. Accordingly, a critical depth of cut control curve may be calculated and plotted for the radial swath associated with the radial coordinates $R_f$. For example, the engineering tool may plot the overall critical depth of cut for each radial coordinate $R_f$ located within radial swath 2008, such that the critical depth of cut control curve for swath 2008 may be determined and plotted, as depicted in FIG. 20C. Following step 2116, method 2100 may end. Accordingly, method 2100 may be used to calculate and plot a critical depth of cut control curve of a drill bit. The critical depth of cut control curve may be used to determine whether the drill bit provides a substantially even control of the depth of cut of the drill bit. Therefore, the critical depth of cut control curve may be used to modify the DOCCs and/or blades of the drill bit configured to control the depth of cut of the drill bit.

Modifications, additions, or omissions may be made to method 2100 without departing from the scope of the present disclosure. For example, the order of the steps may be performed in a different manner than that described and some steps may be performed at the same time. Additionally, each individual step may include additional steps without departing from the scope of the present disclosure.

Although the present disclosure has been described with several embodiments, various changes and modifications may be suggested to one skilled in the art. For example, although the present disclosure describes the configurations of blades and DOCCs with respect to drill bits, the same principles may be used to control the depth of cut of any suitable drilling tool according to the present disclosure. It is intended that the present disclosure encompasses such changes and modifications as fall within the scope of the appended claims.

What is claimed is:

1. A method of designing a drill bit, comprising:

selecting a radial swath associated with a bit face of a drill bit, the radial swath having an area on the bit face located between a first radial coordinate and a second radial coordinate;

identifying a plurality of cutting elements disposed on the bit face that each include at least a portion located within the radial swath, the plurality of cutting elements including all the cutting elements located on the bit face that each include at least a portion located within the first radial swath;

identifying a depth of cut controller (DOCC) disposed on the bit face and configured to control a depth of cut of the portions of the plurality of cutting elements located within the radial swath;

calculating a critical depth of cut associated with the radial swath and DOCC based on a depth of cut associated with each portion of the plurality of cutting elements located within the radial swath and controlled by the DOCC; and adjusting a design parameter of the DOCC according to the calculated critical depth of cut.

2. The method of claim 1, further comprising:

calculating an axial underexposure between the DOCC and each of the portions of the plurality of cutting elements located within the radial swath; and calculating the depth of cut associated with each portion of the plurality of cutting elements located within the radial swath and controlled by the DOCC based on the axial underexposure between the DOCC and each of the portions of the plurality of cutting elements.

3. The method of claim 1, further comprising:

determining an angular coordinate and a radial coordinate associated with a control point located within the radial swath and associated with the DOCC, the radial coordinate and the angular coordinate being defined in a plane that is substantially perpendicular to the bit rotational axis;

determining cutlet points associated with the plurality of cutting elements, the cutlet points having approximately the same radial coordinate as the control point;

determining an angular coordinate associated with each of the cutlet points; and calculating a depth of cut associated with each cutlet point and controlled by the control point of the DOCC based on the angular coordinate of the control point and the angular coordinates of each of the cutlet points.

4. The method of claim 3, further comprising:

determining a maximum value for the depth of cut based on the depth of cut associated with each cutlet point; and determining a critical depth of cut associated with the radial swath at the radial coordinate of the control point based on the maximum value for the depth of cut.

5. The method of claim 3, further comprising:

determining a plurality of angular and radial coordinates each associated with one of a plurality of control points located within the radial swath and associated with the DOCC;

determining a plurality of cutlet points each associated with one of the plurality of cutting elements, each of the plurality of cutlet points having approximately the same radial coordinate as its associated control point;

determining an angular coordinate associated with each of the plurality of cutlet points; and calculating a depth of cut associated with each of the plurality of cutlet points as controlled by one of the plurality of control points of the DOCC based on the angular coordinates of the plurality of control points and the angular coordinates of the cutlet points having approximately the same radial coordinate as their respective control point.

6. The method of claim 5, further comprising:

calculating the critical depth of cut associated with the radial swath at each of the radial coordinates of each of the plurality of control points; and generating a critical depth of cut control curve based on the critical depth of cut associated with each of the plurality of control points.

7. he method of claim 5, further comprising selecting the plurality of control points based on the plurality of control points each having the same angular coordinate and being associated with a cross-sectional line that intersects the first radial swath.

8. The method of claim 1, further comprising:

identifying a plurality of DOCCs disposed on the bit face and configured to control the depth of cut of the drill bit within the radial swath;

calculating a critical depth of cut associated with each DOCC based on a depth of cut of each portion of the plurality of cutting elements located within the radial swath and controlled by each DOCC respectively; and calculating the critical depth of cut associated with the radial swath based on the critical depth of cut associated with each DOCC.

9. The method of claim 8, further comprising:

determining a minimum value for the critical depth of cut based on the critical depths of cut associated with the DOCCs; and calculating the critical depth of cut associated with the radial swath based on the minimum value for the critical depth of cut.

10. The method of claim 1, wherein each portion of the plurality of cutting elements includes a cutting edge of its associated cutting element, the cutting edge located within a cutting zone of the cutting element.

11. The method of claim 1, wherein the design parameter of the DOCC comprises at least one of an axial coordinate, an angular coordinate, a radial coordinate, a height, a width, and a surface curvature.

12. A method of designing a drill bit, comprising:

selecting a radial location associated with a bit face of a drill bit;

identifying a plurality of control points, each control point approximately located at the selected radial location and associated with one of a plurality of depth of cut controllers (DOCCs) disposed on the bit face;

identifying a plurality of cutlets on cutting edges of cutting elements that are disposed on the bit face, each cutlet approximately located at the selected radial location;

calculating a depth of cut for each of the cutlets as controlled by each of the control points;

calculating a critical depth of cut for each control point by calculating a maximum value of the calculated depth of cut for each of the cutlets as controlled by the respective control point;

calculating an overall critical depth of cut at the radial location by calculating a minimum value of the calculated critical depth of cut for each control point; and adjusting a drill bit design parameter in response to the overall critical depth of cut.

13. The method of claim 12, further comprising:

selecting a plurality of radial locations associated with the bit face of the drill bit;

calculating an overall critical depth of cut for each of the plurality of radial locations; and generating a critical depth of cut control curve based on the overall critical depth of cut for each of the plurality of radial locations.

14. The method of claim 13, further comprising plotting the overall critical depth of cut for each of the plurality of radial locations as a function of the respective radial locations to generate the critical depth of cut control curve.

15. The method of claim 12, wherein the drill bit design parameter comprises a design parameter of at least one of the plurality of DOCCs.

16. The method of claim 15, wherein the design parameter of one or more of the plurality of DOCCs comprises at least one of an axial coordinate, an angular coordinate, a radial coordinate, a height, a width, and a surface curvature.

* * * * *